US007056179B2

(12) United States Patent
Courtney

(10) Patent No.: US 7,056,179 B2
(45) Date of Patent: Jun. 6, 2006

(54) COMBINATION INFLATOR AND MANIFOLD ASSEMBLY

(76) Inventor: William L. Courtney, 1990 Highway One, Elk, CA (US) 95432

( * ) Notice: Subject to any disclaimer, the term of this patent is extended or adjusted under 35 U.S.C. 154(b) by 0 days.

(21) Appl. No.: 10/407,805

(22) Filed: Apr. 4, 2003

(65) Prior Publication Data

US 2004/0002270 A1 Jan. 1, 2004

Related U.S. Application Data

(60) Provisional application No. 60/449,992, filed on Feb. 25, 2003, provisional application No. 60/370,585, filed on Apr. 5, 2002.

(51) Int. Cl.
*B63C 9/125* (2006.01)

(52) U.S. Cl. ..... 441/90

(58) Field of Classification Search ..... 441/12, 441/83, 345, 40, 90; 114/345
See application file for complete search history.

(56) References Cited

U.S. PATENT DOCUMENTS 2,390,199 A * 12/1945 Walsh ..... 441/41
3,340,553 A * 9/1967 Jones ..... 441/12
4,228,556 A * 10/1980 Searls ..... 441/11
5,520,486 A * 5/1996 Van Wyck ..... 405/186
5,868,095 A * 2/1999 Zeromski et al. ..... 114/345
6,223,678 B1 * 5/2001 Haller et al. ..... 114/347
6,481,366 B1 * 11/2002 Patera ..... 116/209

* cited by examiner

*Primary Examiner*—Stephen Avila
(74) *Attorney, Agent, or Firm*—Daniel S. Polley, P.A.

(57) ABSTRACT

A variable volume raft containing adjustable ratio and amounts of air and or water. The buoyancy and ballast of the raft are routinely adjusted to accommodate additional occupants and changing weather conditions. A manual pump can be the primary or back up source for initial inflation. The torque pump twisted by hand or amplified by a lever arm generates air pressure for maintenance and repairing deflating lacerations at sea. The pumps collector gathers and pressurizes rain water for drinking in one chamber while pressurizing sea water as a stabilizing ballast in another chamber. A double hull or full floor chamber allows huge variations in buoyancy or ballast as dictated by changing needs for stability versus mobility. A compressed liquid or two-part foam confers puncture resistance to a portion of the raft. A thrown self-righting manual air horn, worn water-activated air horns and water activated transmitted signals, mark the site for rescuers.

19 Claims, 57 Drawing Sheets

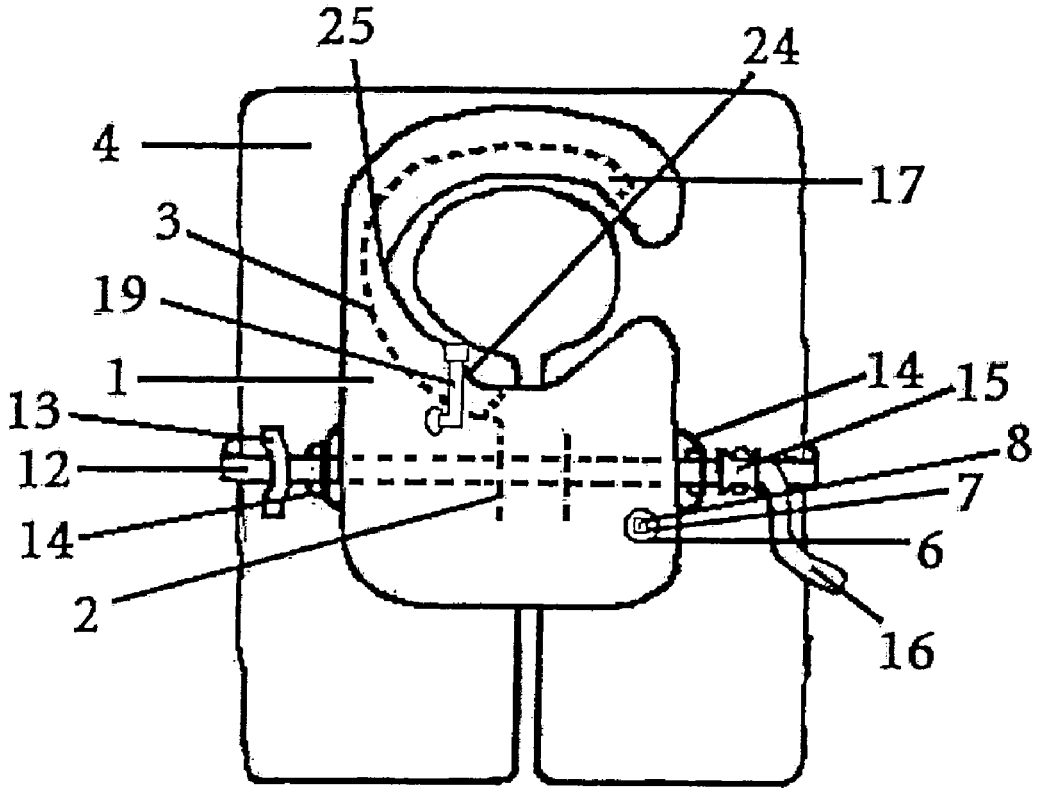
Figure 1
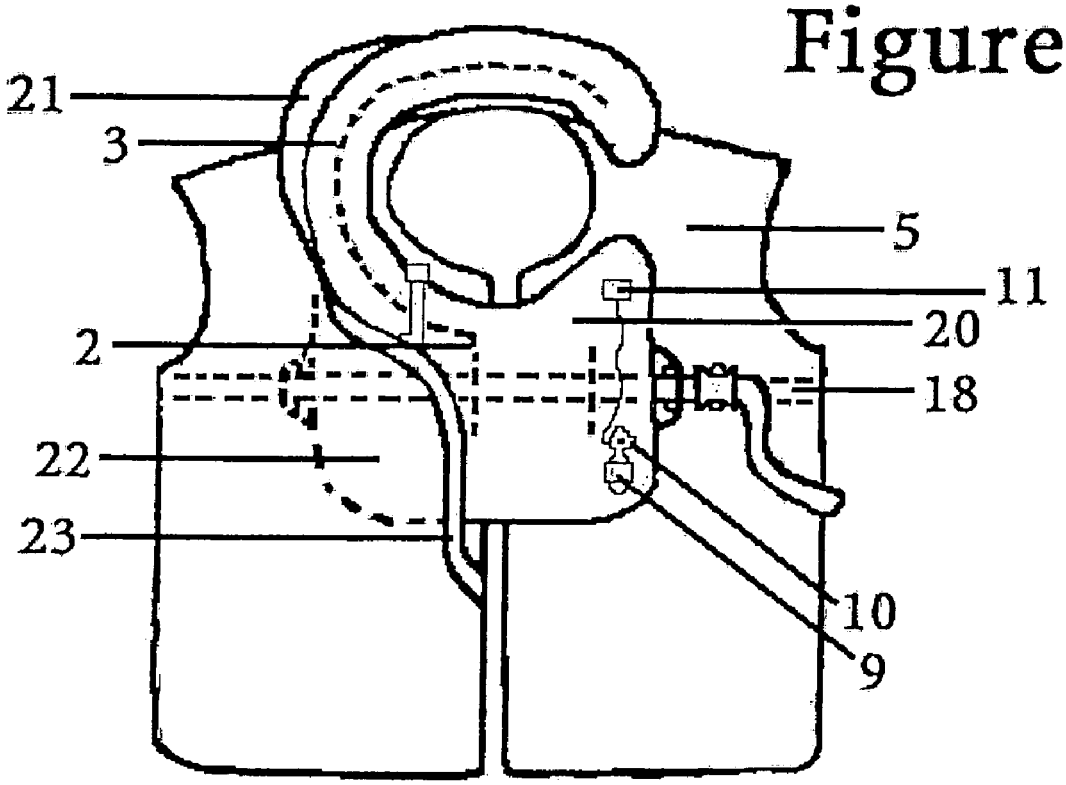

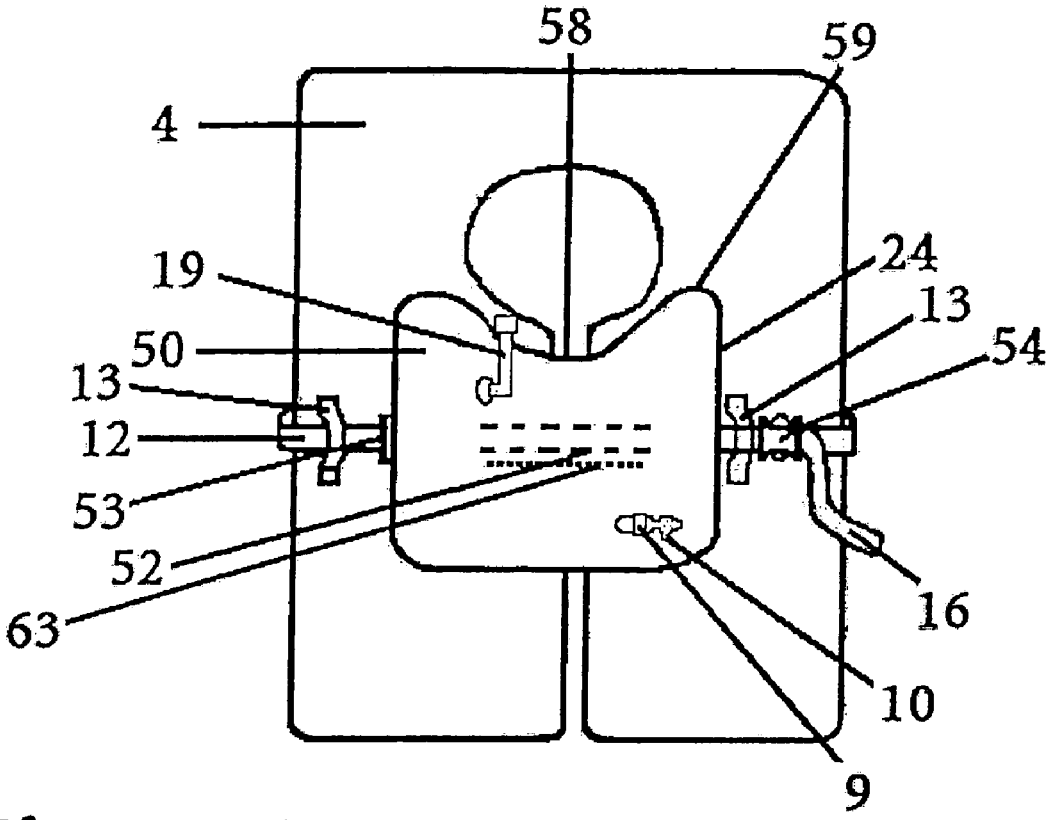
Figure 3
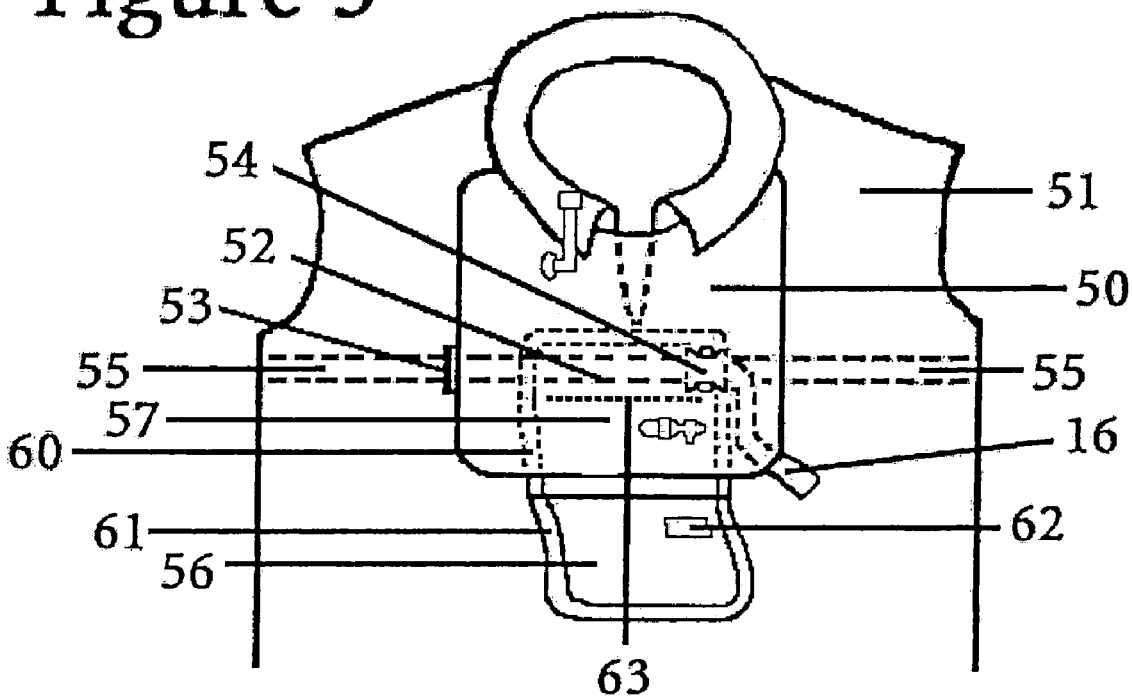

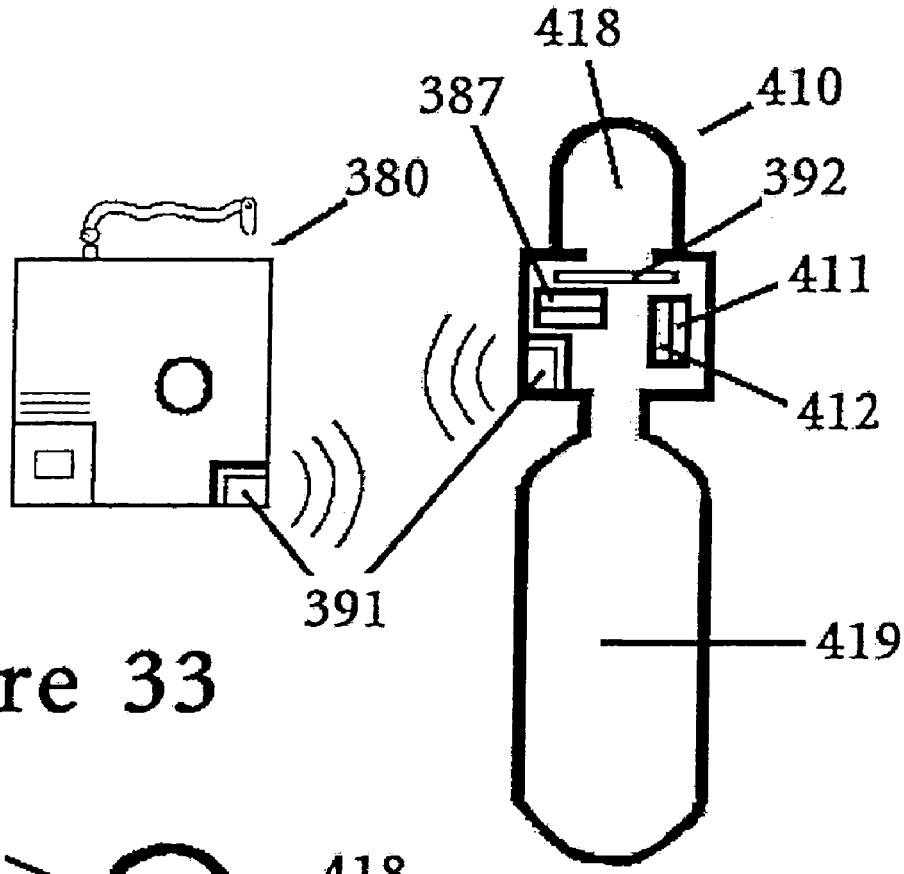
Figure 33
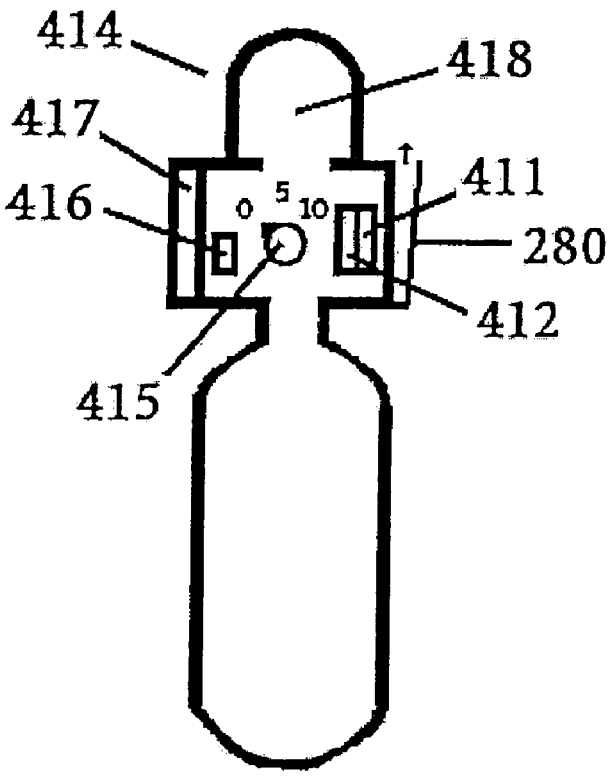

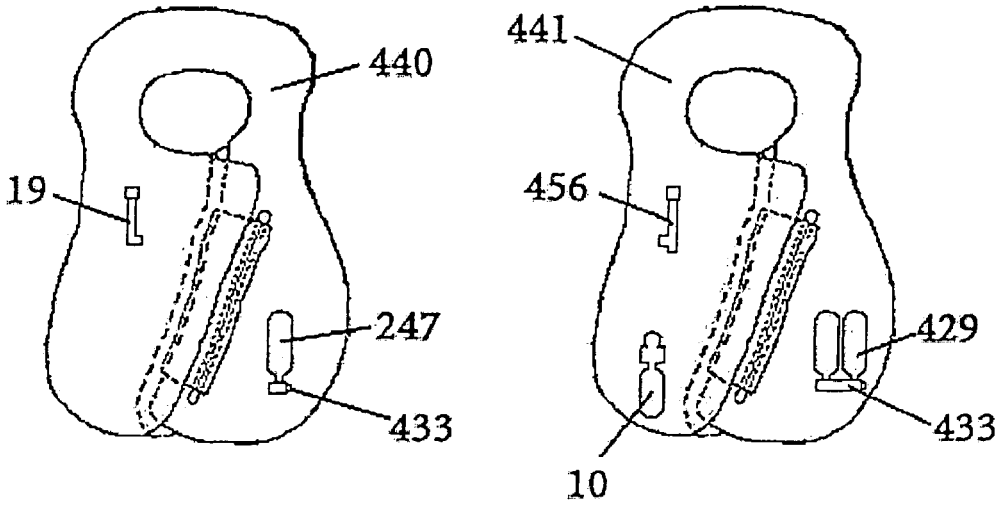
Figure 35
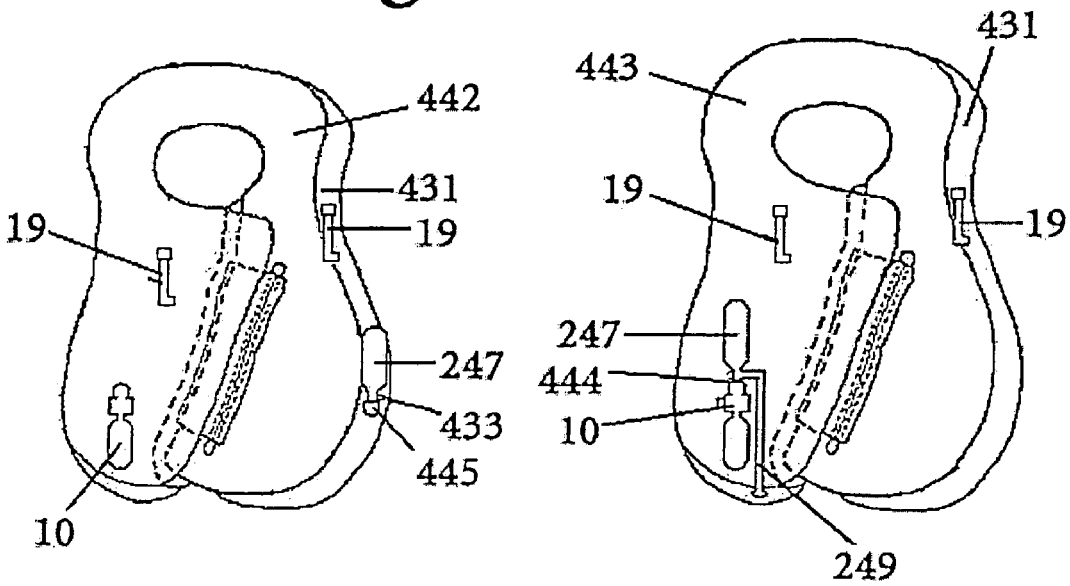

COMBINATION INFLATOR AND MANIFOLD ASSEMBLY

This application claims priority to and the benefit of U.S. Provisional Application Ser. No. 60/449,992, filed on Feb. 25, 2003 (entitled "Throw-able or Wearable, Self-Orienting, Manual or Water Activated Air Horn for Signaling a Man Over Board") and U.S. Provisional Application Ser. No. 60/370,585, filed Apr. 5, 2002 (both applications are incorporated by reference).

BACKGROUND OF THE INVENTION

1. Field of the Invention

The present invention relates to life rafts, flotation aids and signaling devices for the man over board. More particularly to the use of manual means of pneumatic and hydraulic manipulation of chambers, floors or hulls of the life raft whose volume can now be continuously adjusted to meet changes in occupant load, weather conditions and availability or rain water to be stored for drinking. The present invention also relates to the provision of airway protective flotation aids, multi-modal thrown, self orienting manual and water activated signaling devices for the Man Over Board ("MOB"). More particularly to the application of compressed liquid gas and foam and use of a water-activated switch to alert rescuers while providing buoyancy and conserving warmth.

2. Description of the Prior Art

Life rafts rely upon compressed gas to achieve structural integrity. Instantaneous deployment is an expectation of life raft performance that ties the life raft to compressed gas inflation with the steel cylinder's burden of weight, bulk, cost and maintenance. Further the strict reliance upon compressed gas inflation limits the internal volume to displacements compatible with acceptably sized cylinders. While large offshore sailboats can afford the cost, can carry the weight and have the space to spare for a compressed gas inflated life raft it is the small vessel which ply the same ocean without a buoyant alternative outside of their life jacket. While a life jacket is critical in surviving an unexpected water entry, it is well established that for many temperate coastal waters personal flotation devices ("PFD") mediated airway protection improves survival only for 30 to 60 minutes. Without a water exit strategy completed within that time period the survivor even while floating face up in their PFD dies of exposure.

Needless to say the vast majority of boating fatalities occur on vessels less than 26 feet in length. It is not coincidental that the it is the small vessel which has neither the space nor budget to afford a traditional compressed gas life raft system that bears the consequences. The large steel cylinder used to inflate the single person life raft is stored with the raft in a pan beneath the pilot's ejection seat. The jet has the capacity to store and carry the compressed gas system required for inflating the one-person life raft but that same size raft with its requisite inflation is much to bulky, rigid and heavy for routine inclusion in the flight deck jump suit, consequently the majority of flight deck crew blown off aircraft carriers are rarely found alive.

The continued reliance upon compressed gas to inflate even the smallest one person life raft has clearly blocked the consideration of life raft for use in ocean kayaks, personal water craft, small water craft yet alone garments and PFDs, without which survival success is clearly defined in minutes. The mandate for inflation of the life raft by compressed gas drove the designer to limit the size and function of a life raft to a single inflation of fixed-volume chambers. The chamber's capacity and design is fixed and limited to the size cylinder selected for a particular raft. The cost, weight and space of the first compressed gas cylinder clearly prohibits inclusion of a back up cylinder. Consequently, once the cylinder pressurizes the raft, its fixed-volume chambers are considered inviolate. Once the compressed gas cylinder is empty it is useless.

If you generally sail with a crew of four, you are likely to purchase a 4 person life raft. If unexpected guests joined you the day you need a life raft, you make concessions and overload the fixed-displacement provided by the 4 person raft/cylinder. If you are on a commercial vessel that has five 10-person life rafts and three do not release and the boat was slightly overloaded when it left the dock, you may find your self and twenty others trying to get in or hang on to a fixed-volume ten person life raft until it is awash beneath the load.

Books are filled with stories of survivors spending weeks, months, often many months at sea. The rule is that five vessels will motor past you before one sees you adrift in your life raft so it behooves you to be seen a lot and hope some vessel has a live pilot at the helm. After the first 48 hours of storms during which the drogue and perimeter Icelandic ballast system failed to prevent the raft from tumbling down the face of several waves, fair weather has finally returned. As you are recalling that the shipping lanes are only 10 miles down wind you feel the hydrodynamic drag or the same undersized self-filling Icelandic ballast system now markedly slowing your Course Made Good and wonder why the sea anchors are not also self-emptying.

The one general principle of extended survival at sea is, survival=water. It is recognized that you can go weeks or months with little or no food but without water, survival is measured in days. The air force ejection seat life raft is provide with three 9 oz containers of water but then a jets path and progress is continually monitored and search and rescue efforts are quickly launched if you stray from the flight plan. Even so 27 ounces of water seems marginal for survival at sea. You cannot carry enough for 30 or 144 days. While there are brief squalls, the torrential down pour quenches the survivors thirst for only a moment. The survivor never knows how long till the next cloud burst. If the survivor was able to collect a quart or gallon from the down pour, the raft's continual exposure to contaminating salt water spray and restless sleep is likely to upset any jury-rigged storage system sharing the two square feet allotted per person in a life raft. After the rain, the survivor bails out the rainwater in the bottom of the raft, washing off the salt crust, fish scales and fish remains as well as any residual excrement with now un-potable brackish rain water. Before the last rain is bailed the survivor loathes the searing afternoon sun and fears the return of unquenched thirst. The survivor is desirous of re-inflating the canopies arch for protection from the sun but lacks the intercostal strength to orally rigidify the canopy struts.

The 100+ day survival scenarios detail the ultraviolet damage to the raft, the loss of laminate, the abrasion that portends bladder failure. The gaunt survivor has no back up compressed gas cylinder and oral inflation has grown very difficult over the months. While the bon voyage revelers supplied the sailor with a high quality dual ring off shore life raft, the lower ring failed last month upon impacting a shipping container one night and now lies limp beneath the last buoyant perimeter ring separating the survivor from the sea. The survivor is concerned about the growing ulcers on his backside where he initially sustained lacerations when his sailboat pitch-poled through the night before sinking so fast that few supplies were gathered before he stepped up to the life raft. It seems the dorados know when he is no longer lying on his side and bash against the bottom of the raft seemingly with intention. If he only had a fishing pole he would pursue a revenge on those head bangers of the open ocean. There is already a slow leak where the dorados insist on trying to tear through the raft floor to chew on what's left of his backside poking down in the ocean.

Thus there is need for a raft that can be quickly inflated without dependence upon compressed gas inflation. A system that can inflate the raft within the 30 minute window of opportunity in order to avoid the loss of consciousness due to exposure. A system that will allow a chamber deflated secondary to puncture to be repaired and re-inflated at sea to full structural and functional pressure. An inflation system that can be used daily to support the rafts pneumatic structure as the raft fabric deteriorates in the scorching sun. An inflation system that can be operated by a weakened survivor. A raft and inflation system light enough for comfortable routine inclusion in garments, PFDs and small vessels. A raft whose displacement can be quickly increased or decreased to meet changing occupant loads and weather conditions. Since an under-loaded raft can be as dangerous as an overloaded life raft, the raft needs means for both filling and emptying a sea ballast system. A ballast system sized to create reliable adhesion to the water's surface at one moment but allow the drag to be just as quickly eliminated survival now demands the raft achieve a course made towards a trafficked shipping lane. In particular there remains a need for a raft that will allow rain water to be effectively captured and quickly transferred to a container that will protect the drinking water from salt water, fish remnants, urine other bodily by-products. A hydration chamber with means to assure the survivor that the all the water stored can be recovered from the raft lest delusion drives to survivor to slash the floor in a desperate attempt to recover entrapped drinking water. Further there is a need for the raft to insulate the survivor from hypothermic waters and cushion the survivor from the Dorados relentless banging on the bottom of the raft.

Current air horns can only be used when held in the upright position precluding their use as a thrown safety device. In positions other than vertical the liquefied/pressurized contents submerge the open vent and the liquefied contents spew from the horn. Their rapid conversion from liquid to gas is highly endothermic producing damage secondary to freezing where ever the contents land. If the arm is drawn over the head the liquefied gaseous contents are likely to be blown all over the head and face as well as hand and arm damaging or destroying the cornea and producing frost bums over exposed skin. Thus there is a need for a gaseous drawing system that only allows the gas contents of an aerosol can and not its liquefied gas contents to pass through the open valve.

Some air horns are actually negative when full and will sink. Under water they bubble rather than blare that is they are of no value in serving as a marker of a MOB. Thus there is a need for positive net buoyancy to keep the device on the surface Current air horns are restricted to up right usage as warned on the label yet once adapted to be thrown as a MOB Signaling device when they land in the water the air horns position at the waters surface is critical to their signaling function. Heavy long flared openings to the horn have cosmetic appeal to a device held upright on a vessel or dock yet the amplified ballast effect of the plastic on a leveraged arm positions the horn so that it submerges the horns exit orifice. Current air horn designs for upright land use enclose excessive buoyancy behind the axis of effective out of water operation. The rear buoyancy combines with the forward ballast of the dramatically flared portion of the horn to place the exit orifice in a water submerged position. Thus there is the need for the addition of closed cell foam or enclosed space within the horn and complementary high density ballast to orient the air horn as it goes through its dramatic loss of ballast as it liquefied gas contents are consumed keeping the MOB signaling horn pointed operationally into the air.

The amount and location of an air horns net buoyant moment shifts dramatically as the liquefied gas contents are converted to gas and then expelled through the open valve. When the air horn is full the liquefied contents in the metallic can assume a diametric position from the buoyant enclosed plastic horn portion. As mentioned some actually sink in the vertical position. As the liquefied contents are consumed the can goes from ballasting to buoyant and rises up going through a range of angles starting with 90 degrees when negative to 0 degrees when near empty. Thus there remains a need to add buoyancy if not ballast and buoyancy to assure the air horn does not sink and remains pointed in an out of the water position across its entire operational life cycle.

The oscillating membrane of commercially available air horns varies widely. The small 1.5-oz air personal air horn is designed to save construction costs. Inexpensive small horns fail within a minutes if the valve is held open. The larger horn designed for vessels up to 40 ft in length and measuring 10 inches are capable of continuous use with out the membrane failing under continuous exposure to freezing temperatures. The current air horn is designed for short blasts, even if the horn membrane is capable of extended use the can is so cold it can not be held with the bare hand.

Existing water activated systems used to inflated PFDs are so expensive as to preclude its inclusion in the air horn. Even if one could afford to but such a safety device many would be reluctant to use it given some rearm kits cost in excess of $49.00. The toddler's room is often monitored for breathing difficulties or other signs of distress by commonly found transmitters and receivers yet numerous toddlers drown each year when they fall unmonitored into the tub, toilet, pool or off the dock into a pond. The young toddler unable to speak cannot respond to his parent's calls and may have wandered into the basement or out of the house where he could come into harms way. The same child may be lost in the mall or park remaining silent despite their parent's plaintive calls and efforts to locate them. The older child may have wandered from their parent under the behest of a stranger when sudden the child becomes alarmed and wishes to reestablish contact.

Numerous toddlers drown each year when they fall unmonitored into the tub, toilet, pool or off the dock into a pond despite the common presence of transmitters found in the child's room often monitoring for breathing difficulties or other signs of distress. Currently the parent or guardian often carry a base station device on their person as they conduct their various activities or have a fixed station plugged in at their home office. It may be assumed the silence of child whose has just toddled out of their room is evidence that every thing is fine when in fact the child may have just fallen in a bathtub or back yard splash pool.

The young toddler just learning to speak may listen attentively rather than respond to his parent's urgent calls.

The child may have wandered into the basement or out of the house where he could come into harms way. The same child may have slipped into a different isle at the mall or have gotten lost at the park remaining silent despite their parent's plaintive calls and efforts to locate them. The older child may have wandered from their parent under the behest of a stranger when suddenly the child senses the mounting danger, becoming alarmed they may wish to re-establish contact with their parent.

Currently there are many distress signal markers and flashlights marked at water proof to hundreds if not thousands of feet. Such water proof flashlights are suggested for use in boating emergencies and for attachment to their life jackets yet it is widely accepted that a panicked, disoriented if not unconscious victim of an unexpected water entry may unable or simply have forget to turn on their distress light. Such waterproof flashlights contain a reliable housing, providing dry and protected power sources and already provide one modality of signaling. Clearly a steady 3.0 volt light maybe of little use during a daytime man over board incident. If a guest unfamiliar with the equipment attached to their PFD panics, becomes confused or unconsciousness the victim may not manually turn on their distress light even during a night time disaster at sea.

The reliability of the inflatable PFD remains a serious concern. The ability to accidentally re-install a spent CO2 cylinder along with the new water activated wafer leaves the PFD seemingly ready to provide buoyancy and corrective turning yet unable to in event of a man over board emergency. The threaded cylinder that was loosely installed or loosened during storage in a vibrating ship's locker in another frequent cause of inflatable failures in the real world. Further the vagaries of the welded fittings and whether or not the mold parting solution was fully removed prior to welding can lead to problems that may not appear until after the first or second inflation. Fully redundant chambers provide an improved level of protection at considerable cost of fixtures, fabric and bulk. Dual chambered PFDs, which share a common wall, provide the redundancy of inflators and cylinders at reduced cost but are more prone to a catastrophic failure due to puncture. The susceptibility of inflatables to puncture around shredded steel cable, railings or flotsam in the event of a disaster at sea is undeniable.

The inherently buoyant PFD retains efficacy despite puncture, laceration or even avulsion but corrective turning requires excessive bulk rarely found in fielded products. Unfortunately the desire to compromise on bulk has produced an enormous amount of fielded product which provides positive buoyancy but fails to provide airway protective corrective turning action. The real challenge is whether the bulky foam PFD will be worn at the time of the accident or merely stowed somewhere aboard ship to meet carriage requirements.

It is an unavoidable fact that the bulk of the inherently buoyant PFD or the hybrid construction in which a component of the displacement is also provided by an inflatable element, is so bulky, hot and uncomfortable as to be incompatible with routine wear by anyone other than children under mandate from parents and the legal system. Mandatory usage of the inherently buoyant PFD akin to motorcycle helmets and seat belts may someday dictate wearage not carriage as the law punishable by fine. Such a situation is so onerous as to be vehemently opposed by those profiting from the sale, use and maintenance of pleasure boating craft. Despite clear knowledge that the worn PFD is of profound value in surviving the boating accident, carriage laws persist as sufficient despite knowledge that the PFD, which is carried is unlikely to be located by the unexpected water entry victim. It is so unlikely that the victim will find their life jacket that life jackets are not designed nor tested for their ability to be donned while in the water. So like the motorcycle helmet at home in the garage or the seat belt lying by the motorist's side, for the vast majority the inherently buoyant PFD or hybrid PFD is merely going along for the ride. While current Hybrid PFDs offer the performance benefits of both classes of PFDs, the airway protective corrective turning of the inflatable and the rugged durability of the closed cell foam PFD, they provide no benefit when merely carried because they are to uncomfortable to be worn.

Hybrid, inflatable and inherently buoyant PFDs are currently the subject of enforced carriage because of the documented role of life jackets in preventing boating fatalities. Ultimately reduced fatalities will rely upon the institution of fines or the design of invisible, comfortable PFDs. While the soldier maybe coerced into wearing a midline crossing PFD the recreational boater will not routinely wear any PFD that crosses the midline due to its sense of confinement. A recreational garment based PFD to be worn must be able to operate whether the jacket is mandatory usage closed, partially closed or fully open. If the victim of an unexpected water entry is fortunate enough to be wearing their PFD of choice prior to the accident, the second most important aspect of surviving a man over board event is to be noticed as missing. Before crew remaining aboard to immediately can initiate search and recovery efforts they must become aware that someone has fallen overboard.

The PFD community has been challenged by the USCG to design a cost-effective 16 gm airway protective life jacket. Nothing currently exists that can provide corrective turning with the minimal amount of displacement provided by a 16 gm CO2 cylinder. The current inflator that works with the UL approved threaded 16 gm CO2 has a ⅜ inch neck. That same ⅜ inch inflator can also mount a 25 or 38 gm CO2 either of which can seriously over inflate a bladder designed to achieve 1.6 to 2 psi on 16 grams. Current safe assembly relies upon operator reading imprinted warnings on the PFD and cylinder.

For the solo sailor, the man over board event is a very serious. An airway protective life jacket only addresses the first hour of survival. Hypothermia is a rapidly disabling and lethal condition for which water exit is the primary solution. As with the bulky life jacket a bulky personal life raft is more likely to be left aboard than be routinely worn when in or around water. Past personal life rafts required large collection bags and tubes that increased the amount of bulk during storage. A bulky life raft might be carried as a life raft for a small outboard motorboat but the packed bulk restricts their acceptance or incorporation to bulky foul weather gear and large PFDs. While one or more inflatable floors in a life raft provide increased protection from the hypothermic effects of oceans upon which they are floating hypothermia from wind blowing across wet clothes remains a threat to extended safety and survival at sea. It is discouraging if not terrifying for a survivor resting on top of an inflated floor to have to get back into the water and push the hydrostatic collector to 5 foot of depth. Additionally certain children or adults are not tall enough to develop the 2.5 psi required to create the degree of rigidity necessary for acceptable performance of the life raft in a mounting sea state. There are inflatable life jackets that inflate upon contact with water or water pressure however the initial cost of an automatically inflated PFD as well as the re-arming costs remain prohibitive for many open boaters.

For helicopter water rescue personnel their only choice is to use a manually activated inflatable PFD or no life jacket, neither of which provide protection in the event the rescuer's impact with the water results in the loss of consciousness. Since it is their occupation to first jump from a hovering helicopter into the water then to swim rapidly to the aid of a drowning victim, any foam or automatically inflated PFD would seriously impair their ability to execute a swimming rescue. Current inflators require attachment with a torque wrench and there are no facilities in the field to convert manual to water activated to hydrostatic activated. The cost of the inflator when it can not be transferred between bladders is such that it limits designs, which might benefit from replacing one or more inflatable chambers of a PFD without having to throw away the costly inflator mechanism. The dry suit in particular the ballistics dry suit is a particular case with the air retention of the dry suit easily supports the ballast of the heavies to tactical plates. Ballistics dry suits provide puncture protection as long as the ballistics impact is restricted to the very limited area protected by the body armor. In the event of direct or fragment impact outside that zone the dry suit looses its air and take on water converting from buoyant to ballasting. Attachment of an inflatable PFD through the waterproof membrane has restricted the introduction of the ballistics dry suit PFD.

Accordingly there remains a need, which is provided by the present invention, for a convertible hybrid PFD in which the inflatable component can be transferred between the inherently buoyant PFD and a wide range of recreational garments. Ideally a cylinder of compressed liquid foam attached to the main, back up or sequential bladder allows for user or water-activated conversion of some or all of inflatable PFD into a hybrid PFD. A synergistic and evolving combination of the durability of foam with the wear-ability of garment integrated inflatable. The movement of pressurized gas across reeds, edges and diaphragms creates multiple oscillatory elements, alerting crew or parents to the sudden onset of a man over board event. The use of locking quarter turn inflator and CO2 cylinder specific housings prevents PFD failure due to loose cylinders and prevents mismatching over sized cylinders to small bladders. The planar raft with minimal compressed gas inflates a perimeter tube and vertical struts allowing the survivor to immediately exit the water. The self-inflating personal life raft benefits from a large bore flapper valve built into a differentially cut floor and is complemented by a small torque pump which allows the panicked survivor to completely inflate the raft from inside the raft if so desired. The small torque bag can be used to bail the boat, manage emesis, collect and store rain water and well as orienting the craft in a following sea. The larger hydrostatic pump collector can also function as a self inflating thermally protective survival bag for use with the personal life raft to control heat loss. A reusable water or disposable ionic-enhanced water detection switch can be used to signal any water submersion event from man over board to toddler in the toilet through transceiver devices currently in wide use. Micro circuitry allows a device to be worn at the collar of the young toddler that will float the oscillator and antenna at or above the water's surface even if the child's face is under water. It is designed to be tested daily to confirm operation of battery and circuitry. Its child friendly appearance and sound encourages compliance. Its two-part structure reduces the chance of ingestion. The water or ion enhanced water switch combined with a solenoid and cam can be combined into a flexible water activated inflator. An electronic delay allows water rescue personnel to prevent automatic inflation if they maintain consciousness during the rescuer's jump from the helicopter but in the event of unexpected loss of consciousness on impact the inflator after the delay will provide air way protective turning to the unconscious rescuer. Any PFD, but in particular the liquid foam convertible hybrid PFD, benefits from the disclosed user transferable inflator so that bladders once filled with foam can be replaced by deflated bladders which can be re-armed in the field by use of the same inflators. Existing incandescent and LED manual operated flashlights can be modified to include automatic water or ion-enhanced water activated visual and or auditory and or RF signaling capacities as warranted. The dry suit can be modified to allow the reversible mounting of an inflatable PFD to offset a flooded suit, an expected occurrence in a ballistics dry suit. A quick release yet secure lock and key zipper pull allows the force of a deployed reversibly-mounted inflatable from inadvertently detaching itself after inflation.

SUMMARY OF THE INVENTION

The manual model of the MOB requires a conscious individual to recognize that a fellow crewmember has fallen over board. Once aware of the sudden onset of a life threatening emergency the Captain reaches for the boat horn found at the helm and traditionally used to signal oncoming traffic of ones intent and course changes. This same horn now has a valve that can be locked in the closed or operating position and the horn can be heaved at the MOB. Traditional boating operation calls for one crew member to do nothing but maintain visual contact with the MOB though this rule is often broken because of a lack of crew.

In a heaving sea it can be very difficult to keep the MOB within eyesight. While it is required of commercial PFDs that they carry an USCG Approved light with USCG dated batteries, a visual signal is of little value during daylight hours. If the victim was fortunate enough to have been wearing a PFD when knocked of the vessel it is likely that there is a whistle attached but these do become separated and are easily broken. If the whistle is found it can be hard to operate and its range is severely restricted compared to the piercing volume of either and oral or compressed gas membrane air horn. The Captain makes a quick assessment as to time to come about and sea conditions and selects for either increased duration or increased volume. The air horn is converted from intermittent to continuous use by pushing the button in then making a quarter turn to lock the air horn on or turning the rear cap into the locked on position.

Ideally the gas stream maybe pulsed to further conserve compressed gas thereby extending the duration of the signal. Depending on complexity or cost an affordable ½ length tube allows the horn to be thrown without leaking its contents but requires that the cylinder not be filled beyond half full. At an increased cost with compatible with use of a canister carrying maximal contents, a plug operating under gravity occludes the entrance when the aerosol can is in a position other than upright. Dual restricted orifices lead to a chamber filled with mesh and terminated by course filter that provides a large surface area to convert any liquefied gas into gas before passing on to the horn membrane. Alternatively, a ballasted and buoyant flexible drawtube keeps the valve intake above the level of the liquefied gas and can work with the maximum amount of liquefied gas for a longer duration MOBS air horn. After throwing the air horn at the intended victim the MOBS air horn relies upon attached ballast or attached ballast and buoyancy to self-orient the MOBS Air Horn so that the horn's membrane points into the air rather bubble underwater. The Victim can then swim over to the MOBS air horn and convert it back to the manual mode of operation in order to conserve compressed gas thereby extending its life for use in signaling on going search and rescue activities. Alternatively, a combined water activated and manually activated MOBS air horn can be used with infant, infirm or active seamen who might be knocked unconscious by the sailboat's boom immediately prior to being thrown over board A water activating mechanism can be inserted between the aerosol canister and the air horn or incorporated into the construction of the air horn body. A fenestration window cover can be slide over the openings in the water activating mechanism protecting the water sensitive bobbin while the MOBS device is stowed. Garments are traditionally stowed in what is referred to as a wet locker. The ambient humidity is such that it is absorbed into the bobbin which over time leads to premature inflation while in the locker or worse at some delicate moment when the wearer is precariously perched on the foredeck of a lunging sailboat while wrestling with a stuck foresail.

The O-Ring sealed fenestration sleeve is opaque and its position is clearly signaled by the color of the body of the underlying mechanism across which it slides. In the down or gravity preferred position the upper portion of the exposed body is green indicating the water activated mechanism is operational for an unconscious wearer in an emergency. When the cover is slid up the fenestration's that allow water to enter and activate the mechanism, are sealed over. The lower part of the body is now exposed and its red color is a warning that the water-activated function is in operative. The ability to quickly convert the inflator between manual and water activated and then back again as dictated by environmental conditions improves the utility of the inflatable PFD. This reversible feature has significant utility for extending the bobbin life cycle on Life Jackets as well as MOBS air horns. Its utility is clear for those active sports where they wearer knows that they are going to be sprayed or rained upon and so wish to convert their water activated MOBS or PFD into a manual mode for prevent dangerous premature deployment but then restore the jacket instantly to automatic operation.

A small personal MOBS air horn would have the cylinder incased in a conical body supplying both orienting ballast and buoyancy. The body would convert any escaped liquefied gas into gas before reaching the air horn membrane. A convoluted body would have a large surface area with thin walled grooves that would protect the hands of the operator. A pivoting air horn would direct the sound away from the victim. An orifice with a check valve in the body would allow oral operation of the horn once the compressed gas was spent but would prevent compressed gas from escaping during initial operation. The personal MOBS attaches onto existing PFDs chest straps. When the victim is upright the air horn is submerged so bubbles instead of blares. If the victim is unconscious they are rolled over onto their back and the horn is then placed into the air where it signals a double tragedy of an unconscious Man Over Board.

The convertible hybrid PFD allows the user to exceed USCG carriage requirements by the reversible addition of an inflatable bladder to any compatible Type I Offshore, Type II Near shore or Type III or V inherently buoyant PFD of their choice. The same inflatable PFD can also be reversibly mounted on a wide range or dress and utility garments such as fishing vest, hunting vest or recreational boating jackets for use in fair or foul weather. An enhanced midline lock and key design assures that the convertible PFD when deployed free from the garment and after crossing the midline, will successfully envelop and compress the two part fabric lock, creating the mandibular support required for reliable corrective turning action.

A convertible bladder inflated solely by a 16 gm CO2 requires very specific placement if it is to optimize overall performance while assuring correction of defects in turning associated with each type of inherently buoyant PFD. In the eccentric throaco-mandibular position the 16 gm convertible bladder can even supply airway protective turning to either the ski vest or any garment such as a T-shirt. The ultra low volume convertible PFD relies upon a three point pneumatic tensioning system to be assured that its meager torque is reliably located and effectively applied about the longitudinal axis of rotation. A cylinder-sizing sleeve prevents the inadvertent attachment of a 38 gm cylinder to a 16 gm bladder.

Any inflatable PFD can be inflated solely by compressed liquid foam to improve the puncture resistance of the PFD while negotiating flotsam and jetsam. However dual inflation by compressed gas to supply rapid corrective turning displacement by compressed liquid foam to achieve the durability of an inherently buoyant PFD, re-creates the benefits of the Hybrid PFD in water, after the onset of the in water emergency. The compressed liquid foam hybrid PFD provides the comfort and compliance associated with a low profile deflated PFD while being capable of evolving during an in water emergency from a puncture susceptible purely inflatable PFD into a more rugged Hybrid PFD.

A quick release in-field transferable inflator/manifold system allows the single use liquid foam bladder to be replaced at a cost approximating an IV bag. A RF weldable, variable diameter barbed manifold directs the instillation of the compressed liquid foam so that multiple areas of the PFD receive foam simultaneously. A distributed perforated vent tube and over pressure valve allow excess pressure to be released or passed into a back up chamber re-utilizing the compressed gas to provide additional comfort from improved freeboard.

The convertible PFDs quick release inflator also harnesses the movement of inflation gas to vibrate a variety of integrated oscillators creating audible signals identifying the onset of a man over board event to those on dock or on board. Further, the compressed gas released during inflation activates a pneumatic pressure sensor initiating remote extended duration, multi-modal signaling including auditory, visual, Radio Frequency transmission, infrared and EPIRB signaling. The conscious user can manually override the audible and or visual signals if they are unlikely to assist in rescue thereby conserving battery power for the GPS-EPIRB locating device if the sun is unavailable to maintain the charged status of the common power supply. A hydrostatic sensor complements the pneumatic sensor, in the all too common event that a spent compressed gas cylinder was inadvertently re-installed. Upon accidental submersion the hydrostatic sensor acts independently to initiate the above signaling sequence for the person who has unwittingly entered the water with a defectively armed PFD. The convertible PFD quick release inflator with integrated oscillator relies upon a quarter turn locking mechanism which ejects loose cylinders rather than allow a loose cylinder to give the appearance of being properly installed. Inflator integrated sizing sleeve assures correct cylinder selection. While the piercing air horn can run for a short period off the compressed gas inflating the convertible PFD, an air horn with its own water-activated compressed gas source is a very effective extended duration locator of a man over board. The water activated air horn can either be attached to the PFD or tossed as an emergency marker.

The Coast Guard currently inspects the dates on batteries powering PFD attached lights. The disclosed simple water-activated or ion-enhanced water-activated switch will automatically turn on that PFD light in the event of man over board submersion. A photo-sensor can restrict actuation to nighttime. That same water activated switch, switch transistor, waterproof container and power source can also initiate an audible man over board alarm and RF signal alerting the vessel base station to the loss of a crew member overboard. A collar mounted version with a water-activated frequency-specific transmitter will alert a parent that a toddler who is out of view has just fallen into a tub or pool by transmitting that alarm on the same frequency commonly monitored by one or both parents. Inclusion of a transceiver in place of the transmitter allows the parent to locate the pre-verbal child who is lost at home, at the mall or in a park. The battery test circuitry also functions as an emergency call feature for the older child seeking to attract the immediate attention of their parent or nearby adult.

Water safety and survival in many oceans of the world requires hypothermic protection within an hour or less. After use of as the hydrostatic pump collector to inflate the personal life raft, the collector converts into a self-inflating survival bag. Alternatively, a low profile, quarter-turn locking, reversible large bore combined check and deflation valve built into a differentially cut raft floor allows air pressurized by after capture by the inner floor of the raft, to flow down a pressure gradient into the raft itself. An external adapter mounts on the valve allowing a fabric tube from a high torque screw pump to finish inflating the raft to operational pressure. The screw pump collector can be used to bail the raft, manage emesis, collect and store rain and assist in raft steerage in a following sea. The planar raft can be constructed with compressed-gas inflated vertical struts rising off of a perimeter ring creating a compressed gas inflated three-dimensional raft from the smallest cylinder possible. The balance of the inflation is provided by the use of the raft itself as a collector or by use of a hydrostatic pump, both of which require the victim to be in the water. Alternatively, the screw pump can be operated while floating inside the raft. Welding the rafts air chamber in two dimensions before creating the three dimensional perpendicular welds allows the creation of novel juxtapositions of rapid changes in tube diameter previously unachievable from triple-layer continuous-tube rafts welded from supported fabric.

Of the current life raft designs triangular, rectangular, oval a cube shaped raft has the maximum internal volume per square unit of surface area, that is a cubic structure has the greatest amount of displacement per unit of fabric. Restated, the greatest lift per unit of stored bulk is maximized as raft design approaches a perfect cube.

It is an object of the invention to maximize the total displacement provide per cubic unit of store raft.

It is an object of the invention to create a transient reduction in the size of the internal layer of the hydrostatic pump collector relative to the external layer.

It is an object of the invention to create a pressure gradient across the inside floor in order for air to quickly move air from inside the raft as collector into the inside of the air retentive chamber(s) of the raft It is an object of the invention to supply a variable displacement raft to optimize performance for variation in passenger size and number.

It is an object of the invention to supply a variable water ballast raft to allow adjustments of the net positive buoyancy as dictated by the number of passengers.

It is an object of the invention to supply a variable ratio between the contained volume of water ballast and combined volume of displacement created by submerged air contained within the raft's chamber and within the rafts hull below the water line.

It is an object of this invention to allow frequent adjustments in the ratio of contained chamber buoyancy plus internal displacement or net buoyancy to the contained water ballast and supported passenger ballast or net ballast. The ratio of buoyancy to ballast to be adjusted to optimize the raft's ability to adhere to the water's surface in an agitated sea state (low ratio) versus make optimal headway (high ratio).

It is an object of this invention to provide a manual means for generating pneumatic and or hydraulic pressure for the purpose of adjusting the contained ratio of buoyancy to ballast. For the purpose of offsetting gradual pneumatic losses due to deteriorating fabric coating.

It is an object of this invention to provide an air tight, locking, non-separating, variable sized egress low profile valve for adjusting the amount of contained sea ballast It is an object of this invention to provide a sight tube for monitoring the level of water ballast in the hull as correlates with freeboard, stability versus motility.

It is an object of this invention to provide a compressed liquid foam source for creating thermal protection and improved hull tracking performance while providing resilience to puncture and UV fabric failure.

It is also the primary objective of this invention to improve water safety and survival by increasing comfort and performance of the inflatable life jacket by allowing the situation specific transfer of that bladder between an inherently buoyant PFD or range of garments as conditions warrant.

It is also an object of this invention to allow the same bladder to be continuous worn as an invisible garment integrated PFD so that in the event of an unexpected water entry the unconscious victim can be assured of wearing a PFD capable of providing corrective turning action.

It is also an object of this invention to identify the location of a 16 gm CO2 convertible PFD bladder capable of airway protective turning.

It is also an object of this invention to have one or more chambers of their inflatable PFD be inflated in part or solely by compressed liquid foam.

It is also an object of this invention to supply a user transferable inflator so that the inflators used to inflate the single use liquid foam bladder with compressed liquid foam and compressed gas can be transferred to a new bladder.

It is also an object of this invention to have a sizing-sleeve mounted to the transferable inflator to assure that the cylinder attached to a particular bladder is neither to large nor to small .

It is also an object of this invention to have the transferable inflator incorporate a quarter turn self-ejecting cylinder mounting means so that a loose cylinder can not appear to be correctly installed It is also an object of this invention to have a transferable inflator with a barbed manifold for remote mounting of the convertible PFD's compressed gas means It is also an object of this invention to apply the release of pressurized gas through the user transferable inflator during inflation of the convertible PFD to concurrently initiate vibration of a variety of oscillators thereby alerting crew remaining aboard to the onset of a man over board emergency.

It is also the object this invention to allow the victim of unexpected water entry to have their extended duration man over board signaling system be concurrently activated by hydrostatic pressure as well as pneumatic pressure in the event the compressed gas cylinder is defective and unable to actuate the pneumatic switch.

It is also an object of this invention to have an extended duration man over board alarm automatically initiated by a water conduction switch or ion enhanced water conduction switch.

It is object of this invention to build upon the existing manual flashlight batteries, lights and containers by inclusion of a water or ion-enhanced water-activated switch to create audible, visual, IR, and RF transmitted signals marking the presence of a man over board.

It also an object of this invention to create a water immersion alarm for the child while aboard ship or around the pool or tub at home. A child's water activated alarm alerting parents of unanticipated immersion in water would transmit on frequencies already being monitored by parents on existing monitoring equipment. A built in locator function extends the utility of the equipment assist in locating the misplaced preverbal child. Integrated emergency alarm for by the older child's seeking assistance.

It is also the object of this invention to extricate the victim immediately after they have survived their unexpected water entry by providing a skeletal compress gas inflated raft with vertical struts and perimeter tube creating a dual displacement raft.

It is also an object of this invention to provide a self inflating raft with quarter turn locking flapper valve built into a differentially cut dual layer floor to create the pressure gradient needed to allow air trapped under the floor to flow into the raft.

It is also an object of this invention to provide a high torque screw pump to increase the internal pressure of the self-inflated raft while floating inside the raft.

It is also an object of this invention to provide a self-inflating thermally protective exposure bag that serves initially as the hydrostatic pump collector It is an object of the invention to provide an inflatable life jacket that can repair itself in the event of puncture either by the conversion of air filled to foam filled or by the presence of compressed gas and sealant.

It is an object of the invention to maximize the total displacement provide per cubic unit of store raft.

It is an object of the invention to create a transient reduction in the size of the internal layer of the hydrostatic pump collector relative to the external layer.

It is an object of the invention to create a pressure gradient across the inside floor in order for air to quickly move air from inside the raft as collector into the inside of the air retentive chamber Is of the raft It is an object of the invention to supply a variable displacement raft to optimize performance for variation in passenger size and number.

It is an object of the invention to supply a variable water ballast raft to allow adjustments of the net positive buoyancy as dictated by the number of passengers.

It is an object of the invention to supply a variable ratio between the contained volume of water ballast and combined volume of displacement created by submerged air contained within the raft's chamber and within the rafts hull below the water line.

It is an object of this invention to allow frequent adjustments in the ratio of contained chamber buoyancy plus internal displacement or net buoyancy to the contained water ballast and supported passenger ballast or net ballast. The ratio of buoyancy to ballast to be adjusted to optimize the raft's ability to adhere to the water's surface in an agitated sea state (low ratio) versus make optimal headway (high ratio).

It is an object of this invention to provide a manual means for generating pneumatic and or hydraulic pressure for the purpose of adjusting the contained ratio of buoyancy to ballast. For the purpose of offsetting gradual pneumatic losses due to deteriorating fabric coating.

It is an object of this invention to provide an air tight, locking, non-separating, variable sized egress low profile valve for adjusting the amount of contained sea ballast It is an object of this invention to provide a sight tube for monitoring the level of water ballast in the hull as correlates with freeboard, stability versus motility.

It is an object of this invention to provide a compressed liquid foam source for creating thermal protection and improved hull tracking performance while providing resilience to puncture and UV fabric failure. In accordance with these and other objects which will become apparent hereinafter, the instant invention will now be described with particular reference to the accompanying drawings.

BRIEF DESCRIPTIONS OF THE DRAWINGS

FIG. 1 is a frontal view illustrating the convertible hybrid personal flotation device or CHPFD. The upper image is of an orally inflatable bladder that can be upgraded at a latter date to operate off of compressed gas. The bladder's CO2 manifold provides an integrated man over board signal ("MOBS") device alerting parents or crew of the onset of a water emergency. The combination of the puncture resistance of the inherently buoyant PFD and the powerful corrective turning action of the inflatable cross covers each other's performance shortcomings. The convertible bladder can be transferred across a range of recreational garments distributing the cost and conferring the comfort and compliance of a purely inflatable PFD. The convertible hybrid PFD can be moved from fishing jacket, dress jacket foul weather garment and ultimately as dictated by weather and sea transferred to the inherently buoyant PFD.

FIG. 2 is a lateral view illustrating three different embodiments of the man over board signaling device. One is integrated into the CO2 stem so that regardless of the type of inflator attached an alarm is signaled upon inadvertent water entry. Second a pressure sensor built into the nut that mounts the inflator to the CO2 manifold can be used with existing inflatable PFDs to confer extended auditory, visual and RF mediated alarm signals. The third MOBS is built into the inflator body. In combination the auditory alarms arising as air moves from the CO2 and initiate an extended electrical oscillator, create a cacophony of sounds alerting help on dock, boat or shore as to the unexpected onset of a life threatening emergency.

FIG. 3 is a frontal view illustrating a high volume convertible bladder capable of corrective turning action from a midline position. In the recreational garment it mounts behind the central pocket until needed. It is a self-tensioning inflatable that is worn loose but upon activation cinches the chest strap into the operative degree of tension to assure airway protective positioning. The mandibular shelf and brackets and large size produce aggressive turning at the cost of the larger CO2 cylinder. The garment based PFD is suitable for most situations unless one is anticipating puncture such as in breaking seas with concerns of broach and secondary structural damage to the vessel where an inherently buoyant PFD is invaluable.

FIG. 4 is a frontal view illustrating the dual Safety Of Life At Sea Class PFDs. Either the SOLAS inherently buoyant PFD and SOLAS inflatable PFD provide high levels of displacement. The SOLAS class Convertible HPFD assures face up flotation and provides serious backup protection for the conscious wearer in the event of laceration or puncture of the air retentive bladders. The fair weather garment PFD in the lower drawing incorporates a sophisticated MOBS that has combined hydrostatic and pneumatic sensory activation leading to a variety of signaling modalities that can be regulated to conserve battery life if cloud cover prevents solar charging of the combined mid-line battery and ballast pack.

FIG. 5 is a lateral view illustrating a hydrostatic pressure switch with means for adjusting sensor sensitivity and incorporating delay in activating their extended duration MOBS system, allowing the active water enthusiast to incidence of false alarms.

FIG. 6 is a lateral view illustrating a redundant combined hydrostatic and or pneumatically activated man over board signaling device. Assuring that if the compressed gas cylinder was not properly serviced and therefore no pressure available to drive audible alarms that the hydrostatic sensor will initiate an electronic alarm notifying crew remaining aboard to the sudden onset of a very serious water emergency, man over board without a life jacket.

FIG. 7 is a lateral view illustrating an adapter for remote mounting of the compressed gas inflator. The traditional threaded nut connects the inflator to a barbed fitting allowing the compressed gas to be relocated to a remote bladder. The adapter has a sizing restrictive coupling system to assure that a bladder sized for a 16 gram CO2 does not accidentally mount a 25 or 38 gram CO2, which have identically threaded necks. Also incorporated in the adapter is an inline oscillatory element providing notification that someone has just fallen overboard.

Figure 10:
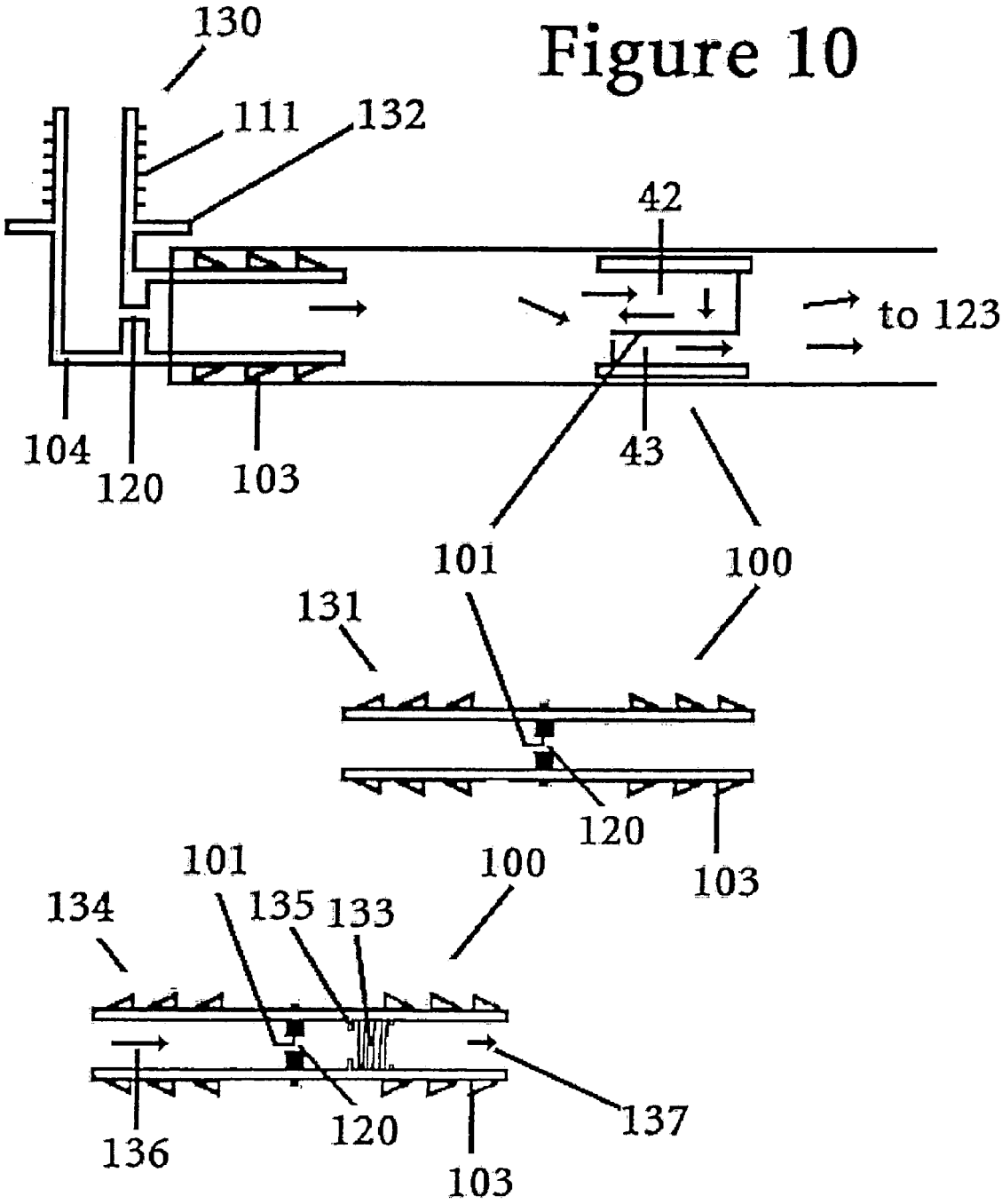

FIG. 10 is a lateral view illustrating a thread to barb inflator adapter with integrated restricter valve as might be employed in the sequentially inflated bladder system. Down stream is a separate inline oscillator. The middle left drawing illustrates a barb-barb coupler with delay restricter valve and oscillator. The middle right drawing illustrates an over pressure relief valve with inline oscillator. The lower drawing illustrates a weldable connector that provides a right angle barbed connector with integrated restricter, reed and diaphragm oscillators and a down stream check valve protecting the bladder from loss of pressure through the diaphragm oscillator.

Figure 11:
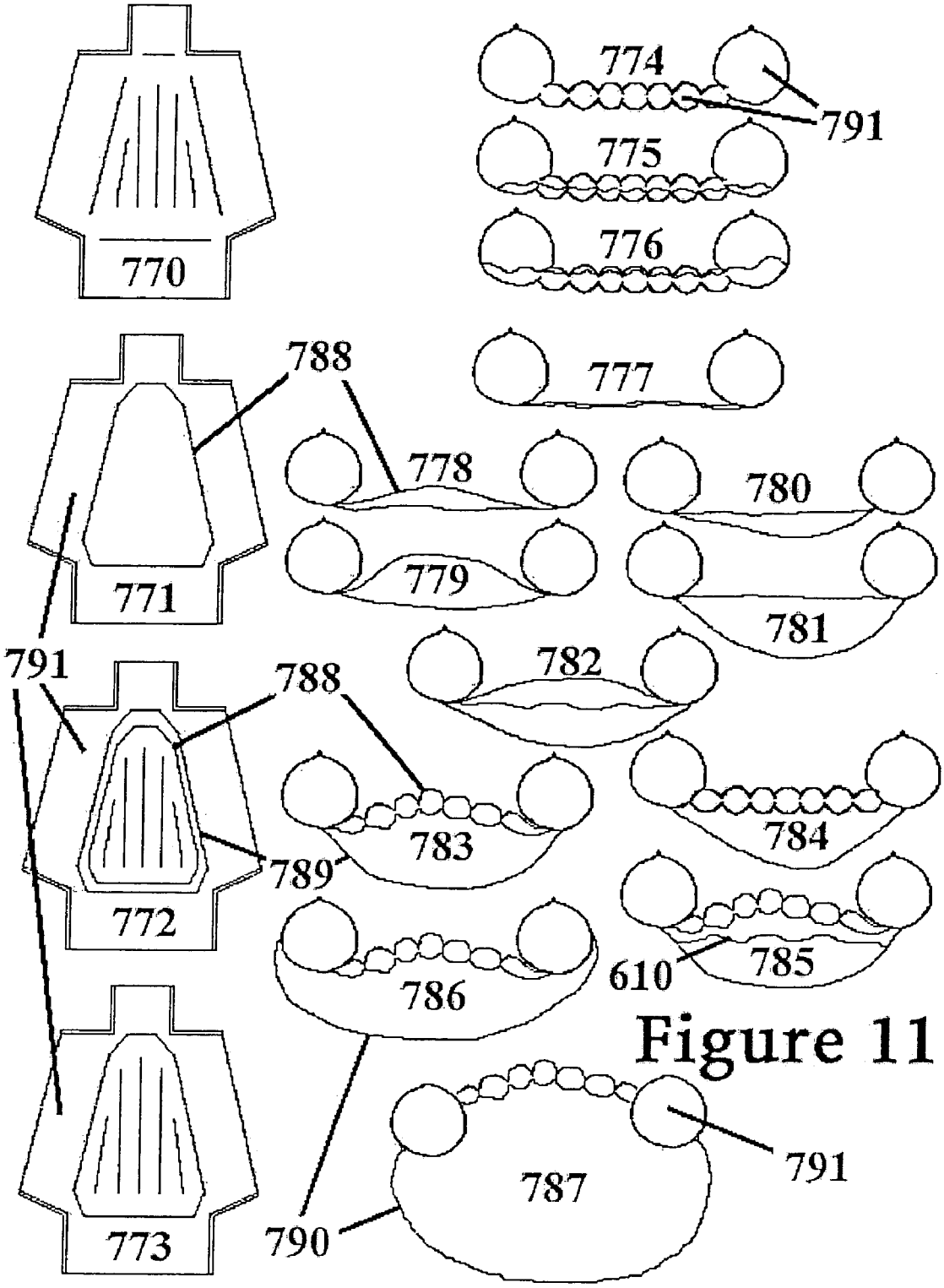

FIG. 11 compares superior plan views with cross sectional inflated views to illustrate the difference between fixed-displacement hulled rafts and variable-displacement hulled rafts. Older fixed volume rafts require reducing the amount of air displacement in order to add ballast. Variable volume rafts have dedicated chambers that allow the addition or removal of variable amounts of air or water or a sliding ratio of air to water, as indicated by changes in occupant load or weather conditions.

Figure 12:
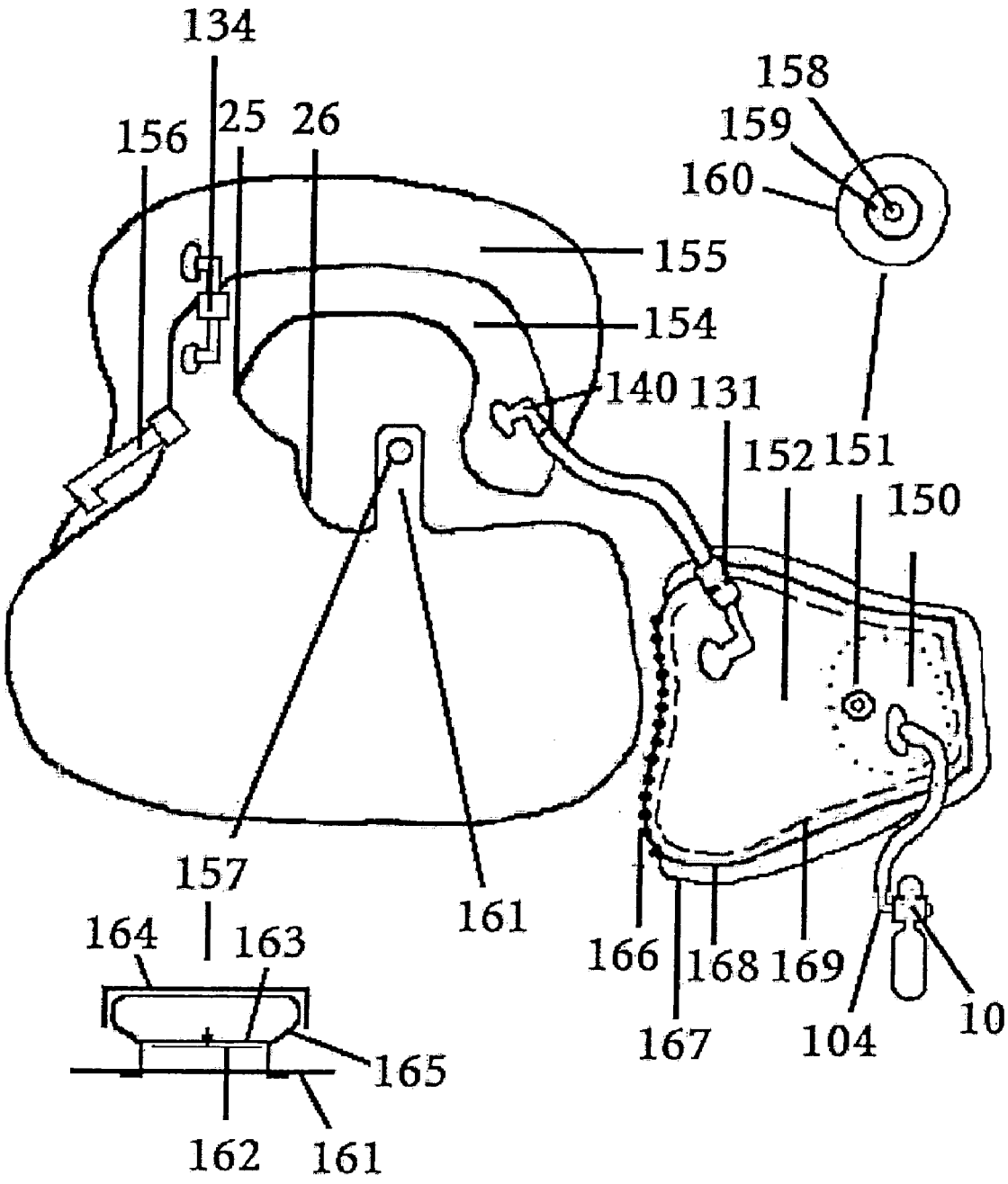

FIG. 12 is a frontal view illustrating a sequentially inflated PFD. A lateral bladder receives the initial discharge. The progression of the compressed gas is slowed by an in-wall restricter valve and latter by an inline combined restricter/oscillator creating the delay needed to initiate the side high position so that the midline crossing bladder drifts across in front of the victim's neck as it inflates rather than alongside the neck. A fabric oral inflation tube reduces bulk and cost. A separate posterior freeboard chamber can be inflated orally or by excess compressed gas passed through an inter-bladder over pressure relief valve.

Figure 13:
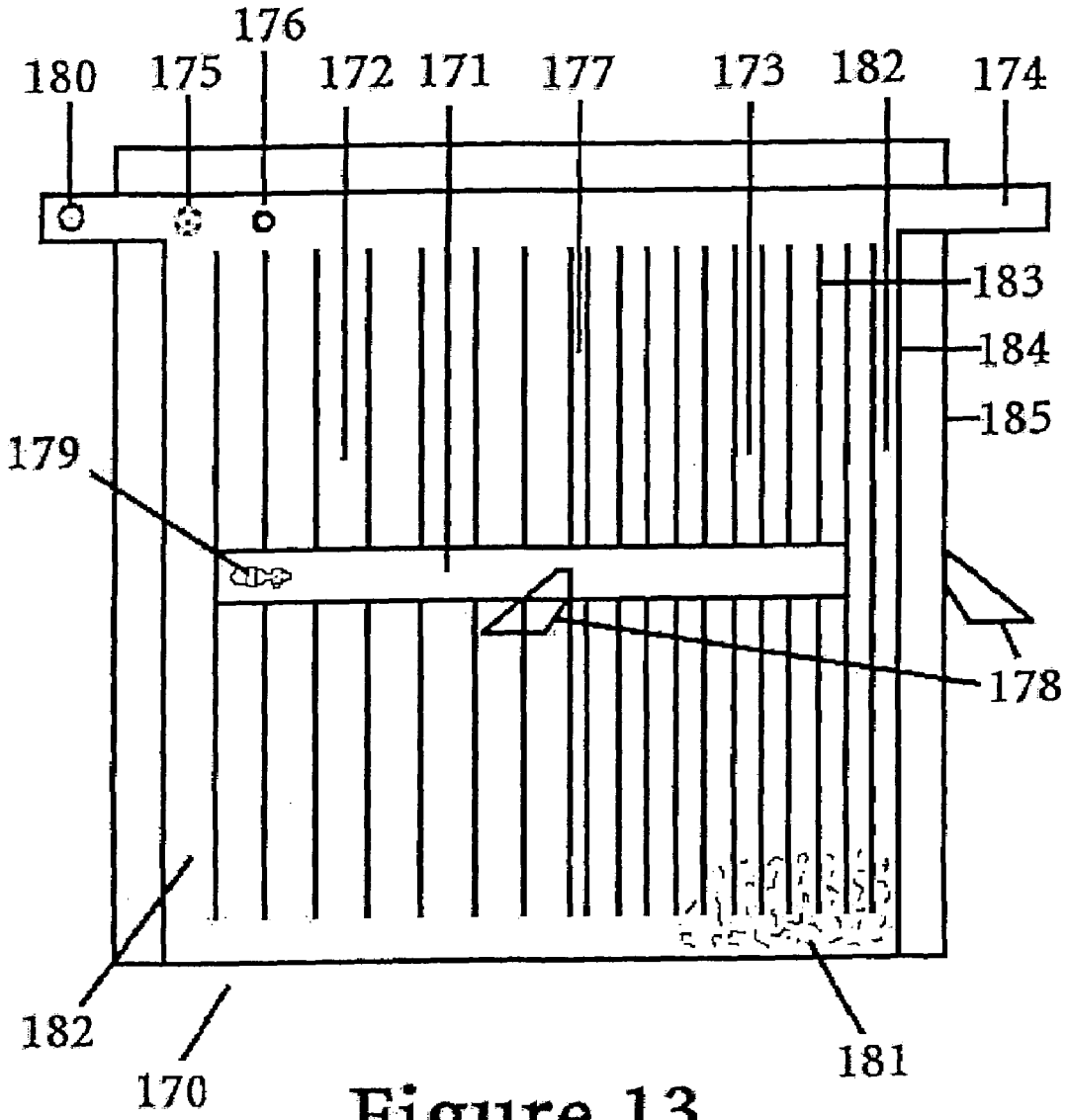

FIG. 13 Superior view illustrating a self-inflating thermally protective survival bag. The loculated air chambers keep the victim off the hypothermic sea. Use of metalized plastic reflects heat back at the victim while reducing convective losses. For in water use the bag can also serve as a collector for inflating the life raft. Out of the water there is a differential cut between the smaller inner bag and larger outer bag. The smaller inner bag collects and through compression passes the air though a check valve into the space between the inner and outer layers.

Figure 14:
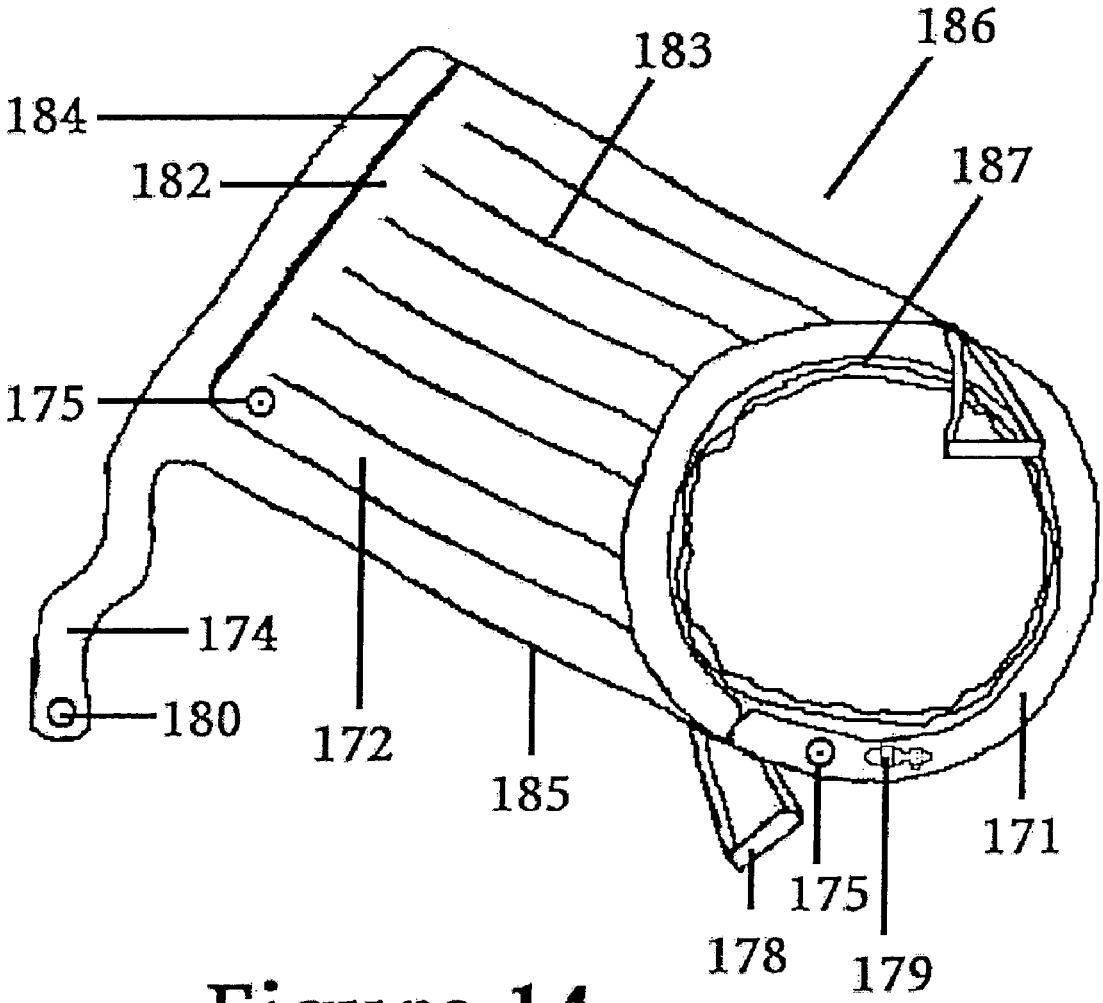

FIG. 14 is a three-quarter superior view illustrating the thermally protective survival bag, as it would be set up to function as the collector and hydrostatic pump for inflating the life raft.

Figure 15:
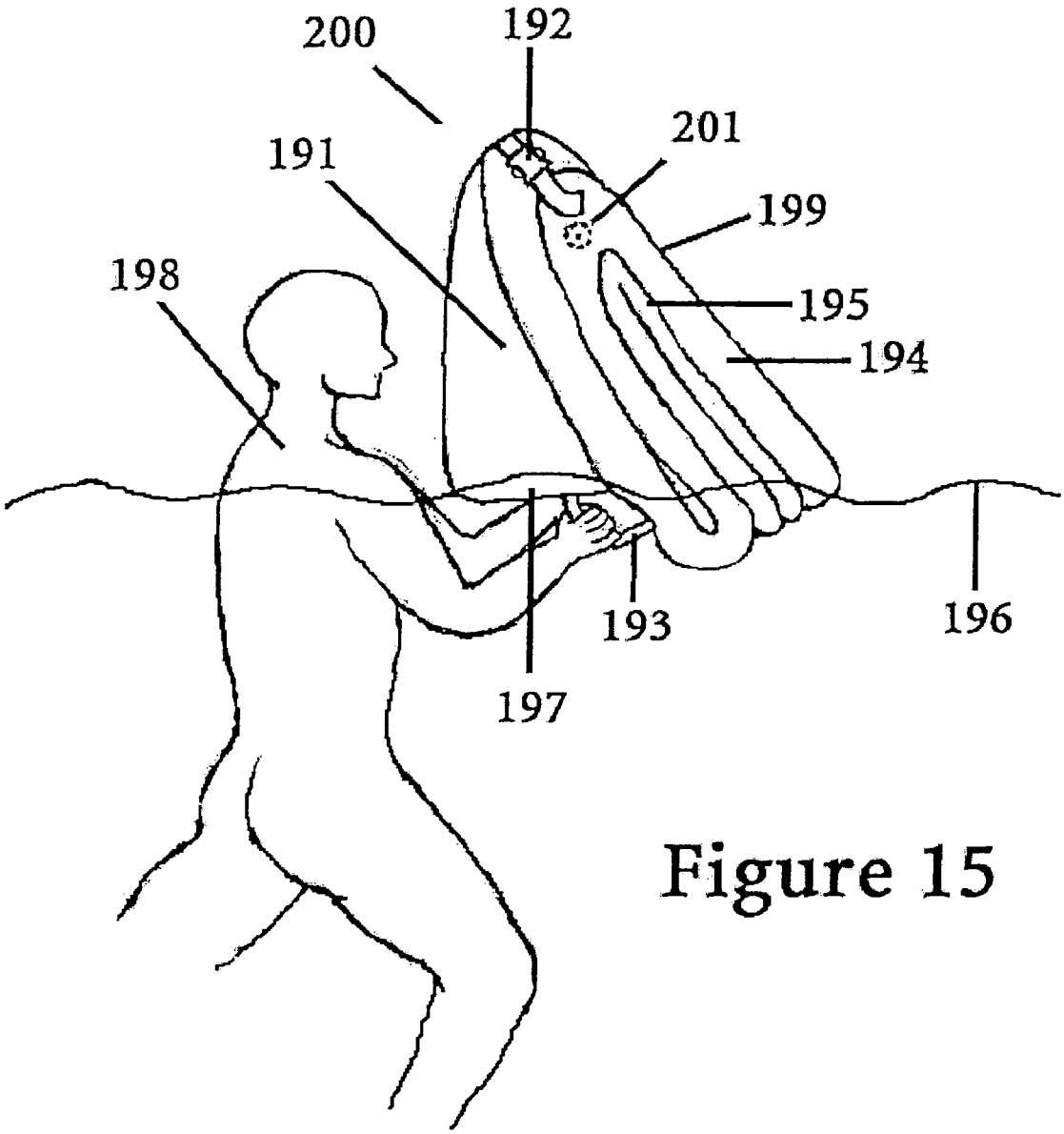

FIG. 15 is an in water lateral view illustrating a victim using a self-inflating raft. The welded spray skirt and body of the raft trap copious quantities of air which pass through wide bore 0 psi valve because of the differentially cut raft floors. The outer layer is larger than the inner layer so that the pressure against the inner wall is not transmitted directly to the outer-wall. This difference allows the air chamber to be at a lower pressure than the inside of the collector, establishing a pressure gradient for moving air into the raft. With a single layer floor an external conduit moves the trapped air from inside collector to inside the raft's sealed chamber(s).

Figure 16:
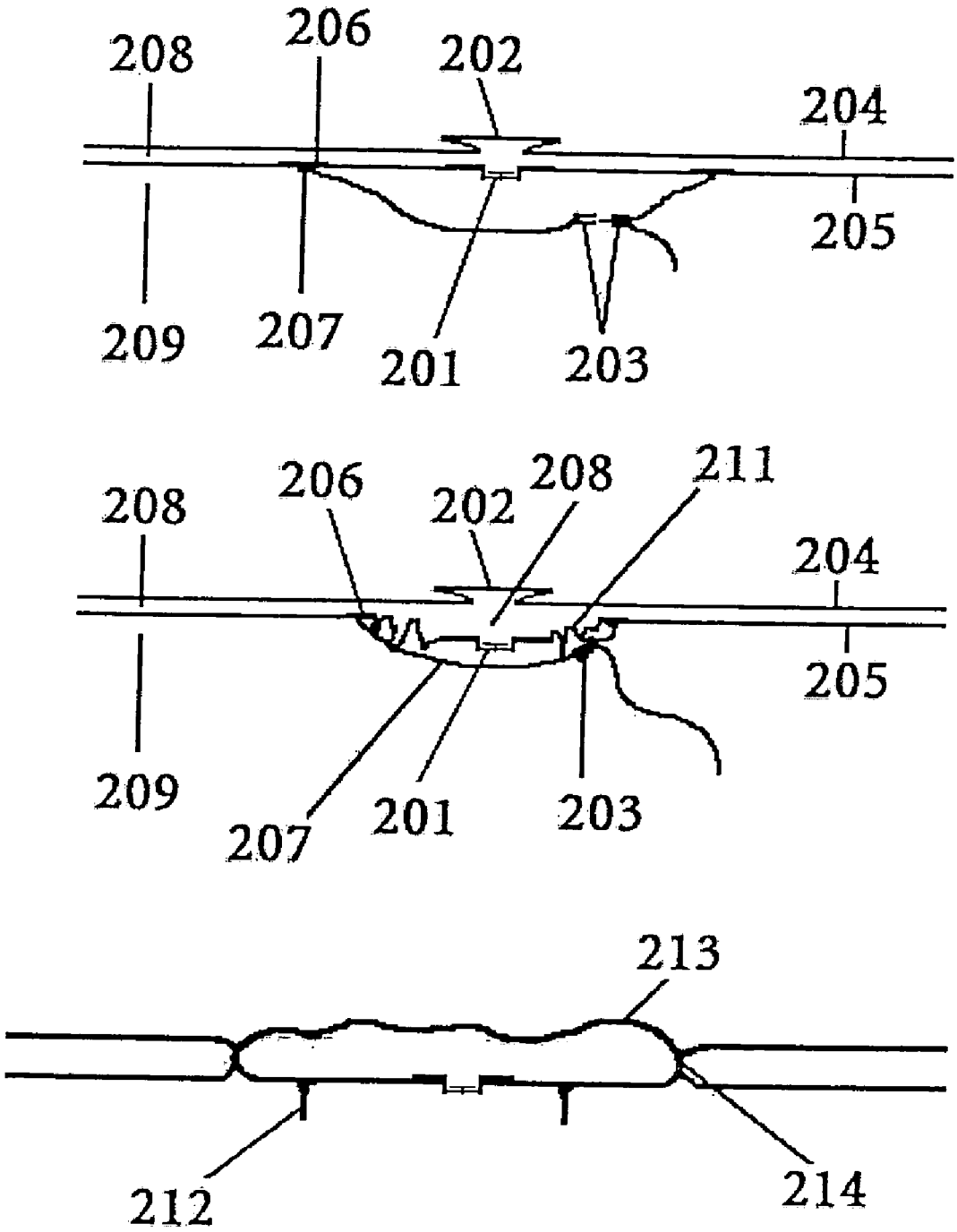

FIG. 16 is a cross sectional view illustrating a two layer floor modified to create a zero psig air space between the high pressure trapped air beneath the inner floor and the outer floor. A double Z baffle places additional fabric in the outer layer, which inflates into a keel structure. In addition or alternatively a tensioning system draws the inner floor together making it a smaller chamber, consequently the inner layer bears the entire pressure generated by the collector under the force of the pumper against the seal at the water surface. This creates the pressure gradient that allows the air to flow from the collector through the large bore check valve into the raft's chambers.

Figure 17:
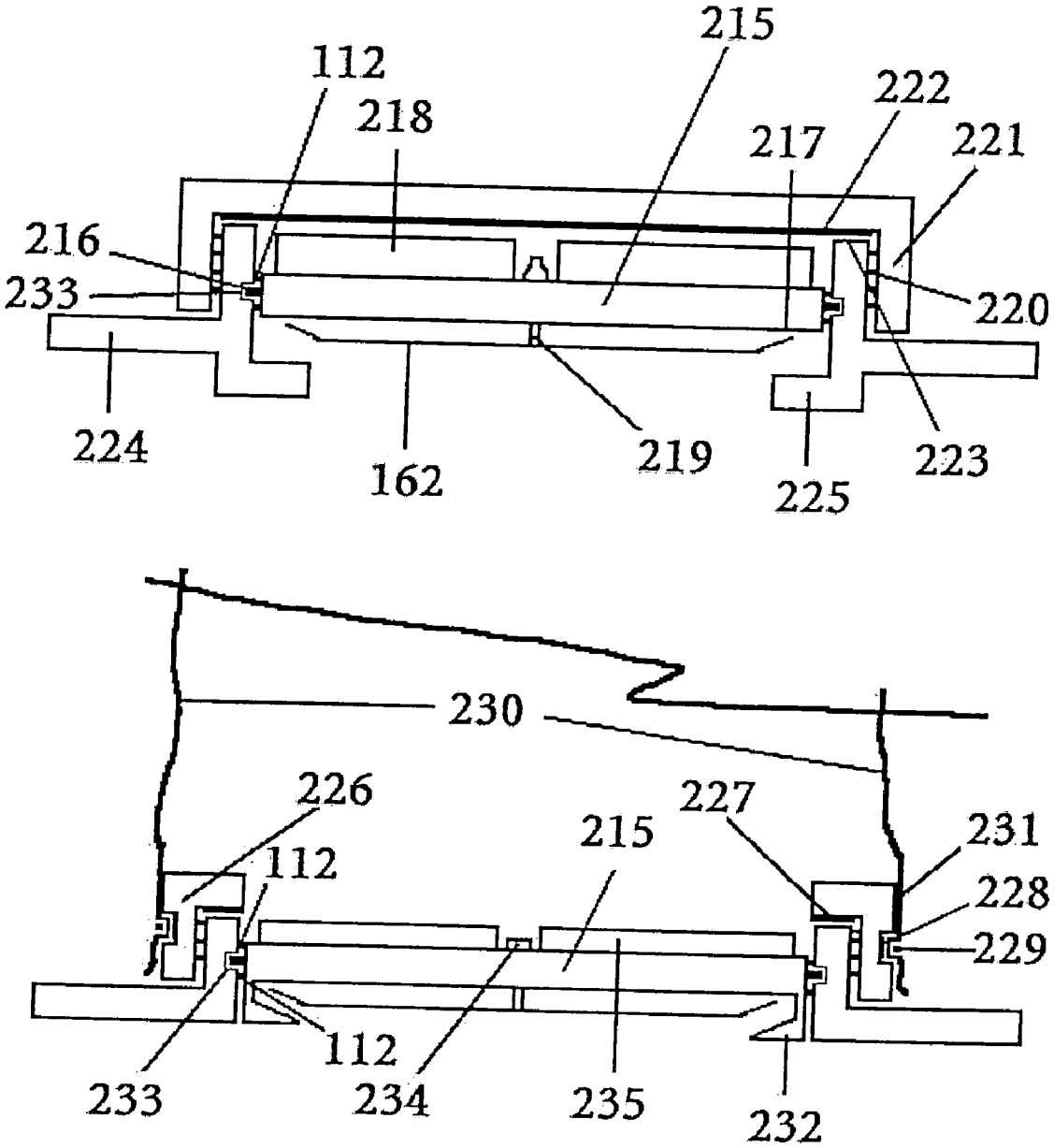

FIG. 17 is a lateral view illustrating a very low profile high flow weldable inflation, deflation and lockable valve. The large flapper valve is O-ring sealed and secure by a quarter turn lock. The valve core is removed for rapid deflation. An overlying cap secures the valve against gradual leakage due to a contaminant disrupting the mushroom seal. The lower drawing illustrates a coupler that allows a fabric tube to be welded or for non-weldable films to be mechanically secured.

Figure 18:
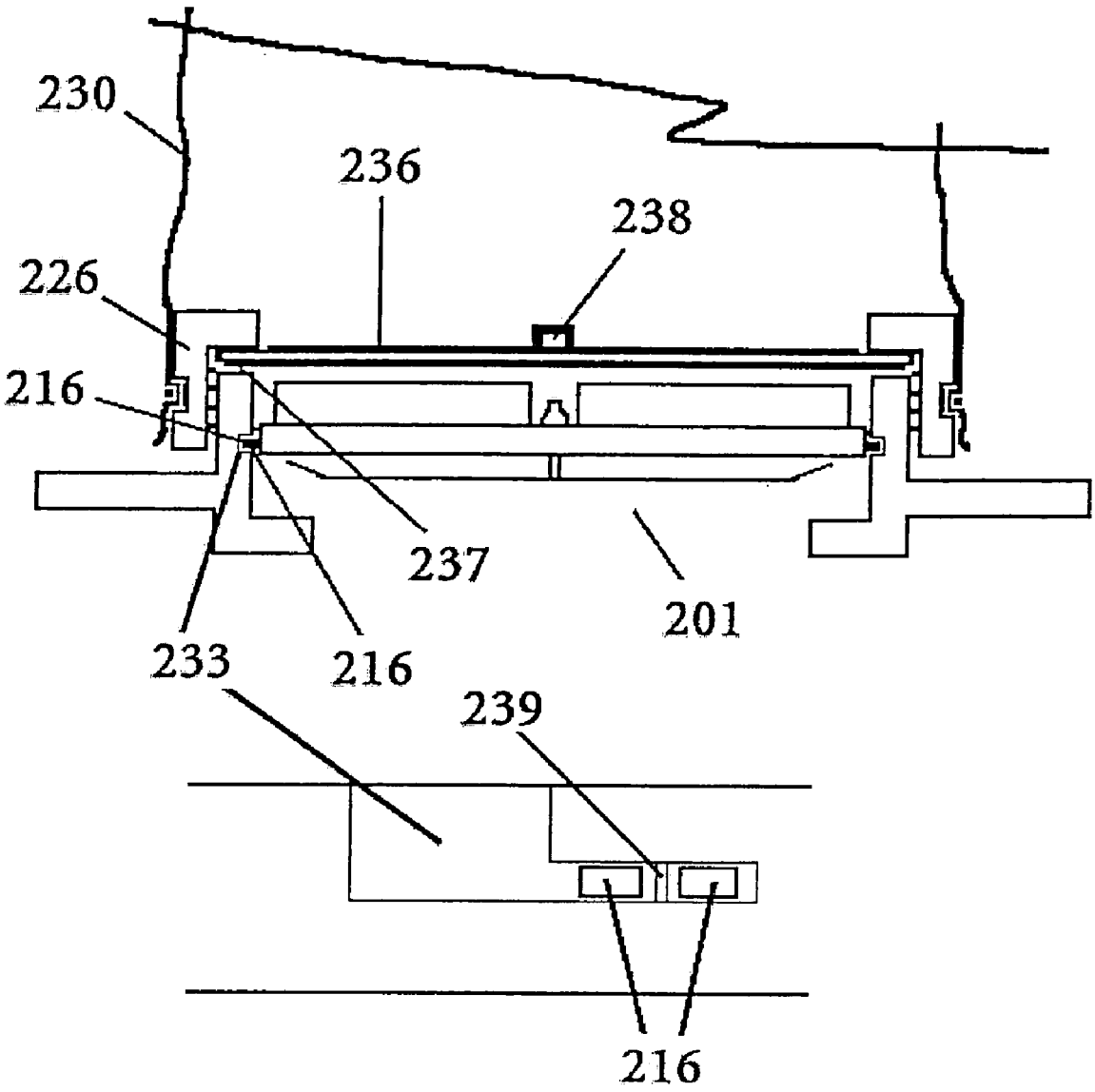
Figure 19:
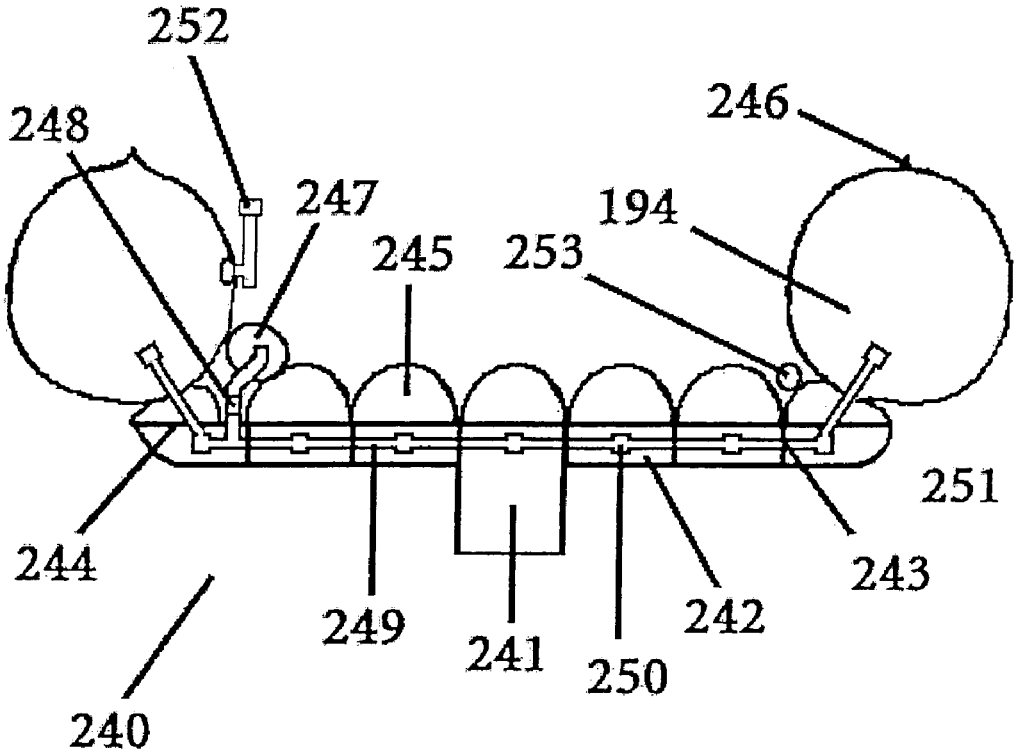

FIG. 18 is a lateral view illustrating a two-part sealing lid that relies upon the threaded connection of the coupler to compress a sealing gasket against the face of the welded connector. The lower detail is of the quarter turn dual pin locking means as used to secure the valve core to the inside of the valve body or for securing the valve cap or coupler to the outside of the fabric weldable valve body FIG. 19 is a posterior view of a raft illustrating the foam filled survival raft providing unparalleled protection from hypothermia and puncture. The liquid pressurized foam can be instilled into just the keel for significantly improved steerage or just into the gluteal region for warmth. As dictated by weight and space considerations regarding the size of liquid foam canister, the entire floor or entire raft can be converted to a foam structure. The raft can instantly deploy a 38 gm CO2 floor. Given the skill and training or lack thereof of the life rafts target population, the entire raft may first inflate with air then have the air displaced by foam if immediate exit is critical to manage the psychological aspects of the in water disaster. An overpressure relief valve allows the displaced air to escape during conversion from inflatable raft to foam raft.

Figure 20:
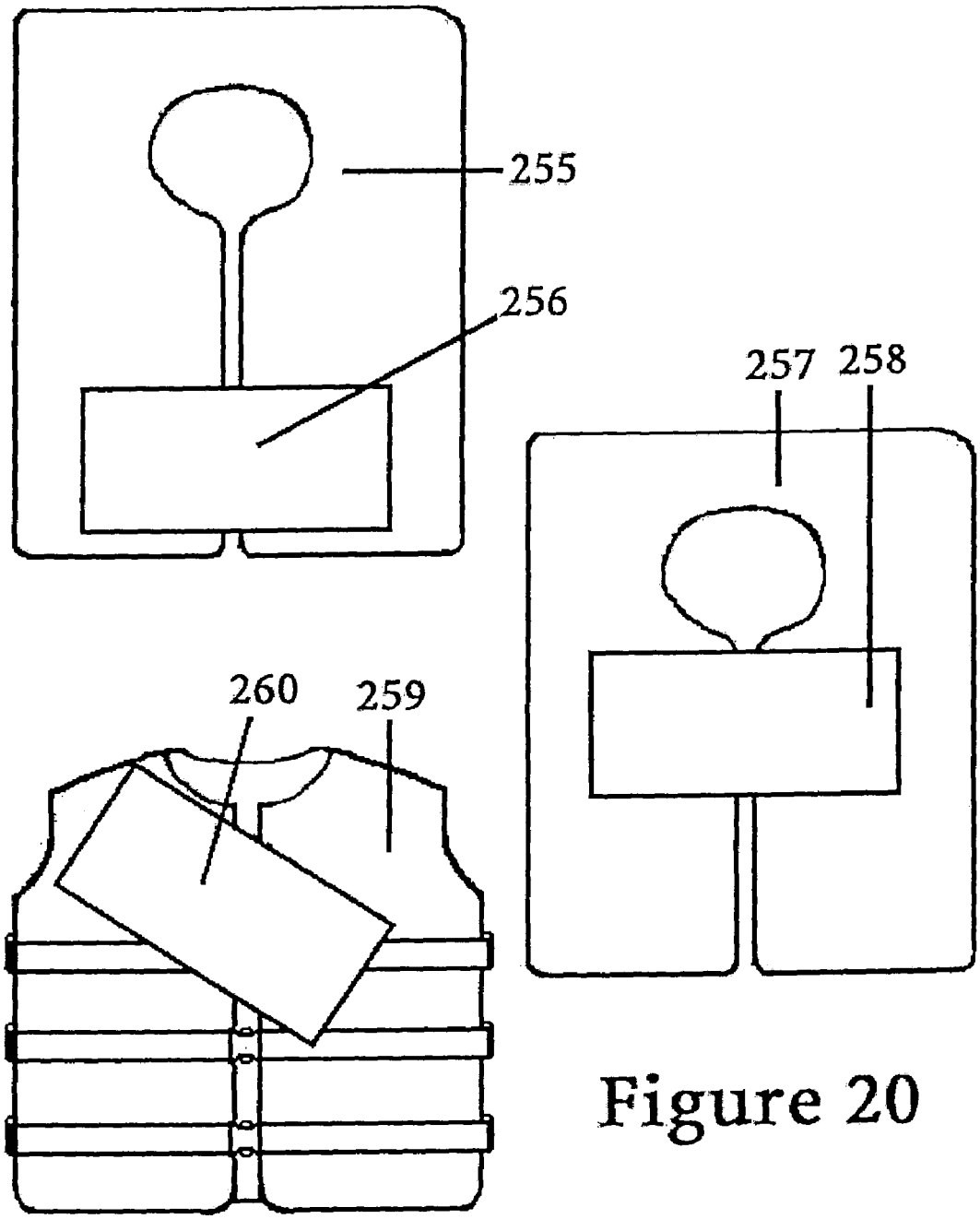

FIG. 20 is a frontal view illustrating the location of the 16 gm bladder in designing an airway protective convertible hybrid PFD. The location chosen for reversibly or permanently mounting the bladder onto the inherently buoyant foam PFD is a function of the design and displacement. The Type I OffShore PFD often has 35 lb. of buoyancy in a well configured design yet all fail to turn the author. The 16 gm bladder can be placed down low where it is entirely submerged when in the vertical position providing improved comfort and positioning. The Type II 15 to 24 lbs. require that the bladder be placed immediately beneath the chin or even the combination will fail to provide corrective turning. The Ski Vest with part of its buoyancy placed behind the victim, the requires the maximum amount of torque that can be generated by a 16 gm bladder, it must be located high on the chest beneath the chin with an eccentric secure placement of the buoyant moment across the midline.

Figure 21:
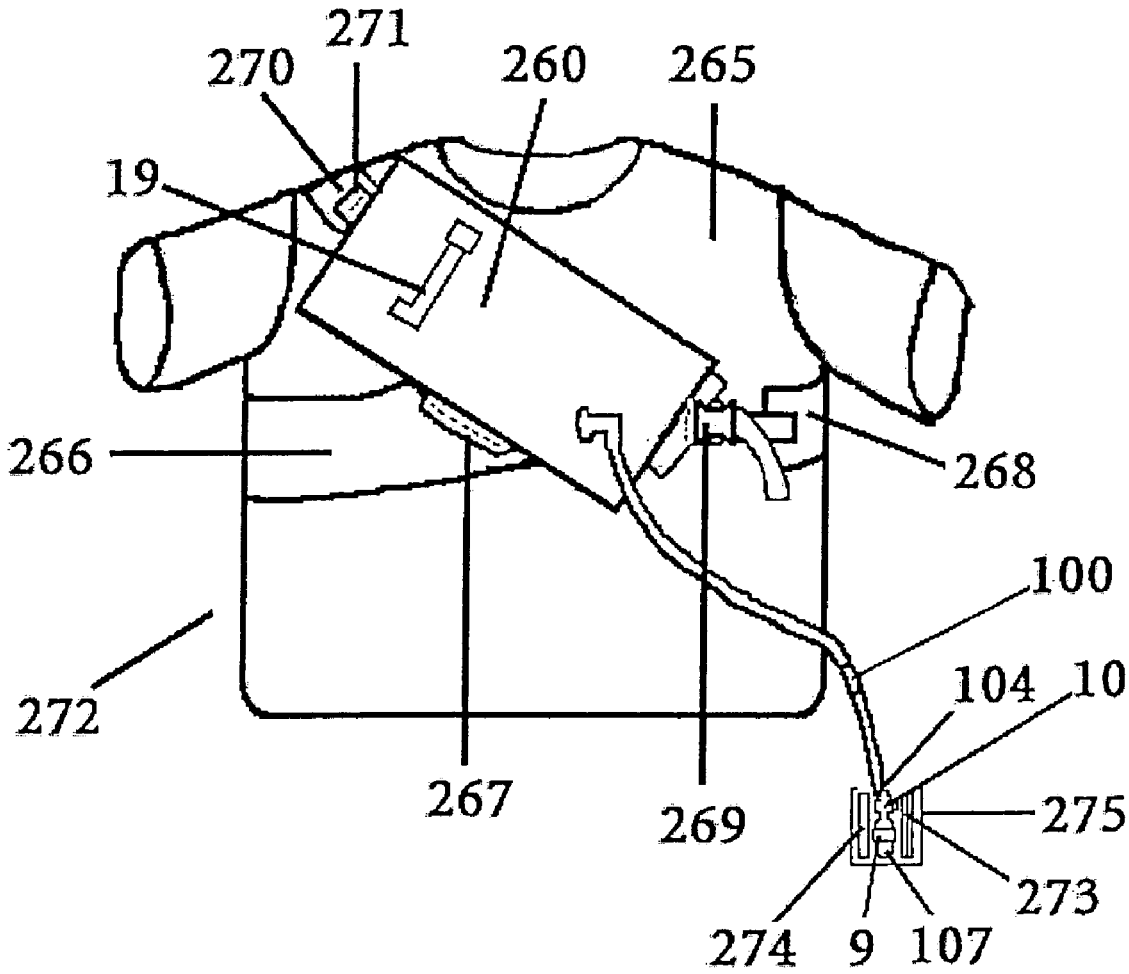

FIG. 21 is a frontal view illustrating a lightweight gannent mounted life jacket. The T-shirt achieves corrective turning by firmly positioning the 16 gm bladder in an eccentric midline crossing position. The webbing normally used for chest straps has been replaced by lightweight fabric that passes both over and under the shoulder. The buckle supplies the ability to adjust the bladder so that it is comfortable. The bladder is secured along the edges so that upon inflation as it contracts it generates tension in the harness so that it minimal buoyancy is held accurately in position as required for reliable corrective turning.

Figure 22:
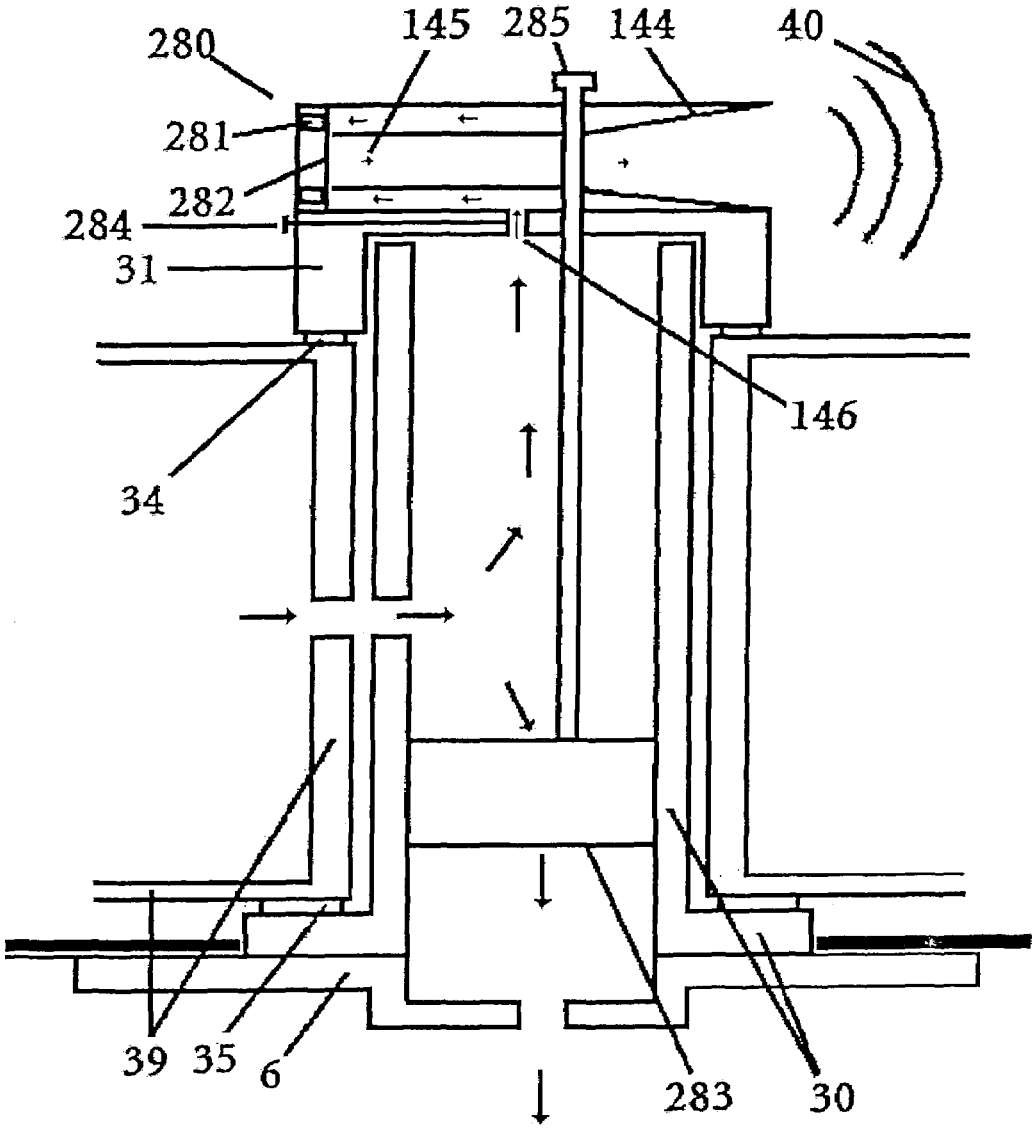

FIG. 22 is a lateral view illustrating an oscillating diaphragm air horn built into an inflator. A valve allows the volume to be adjusted to zero if indicated. A button allows the air horn to be powered from the compressed gas in the bladder in an extreme emergency. Normally a check valve prevents compressed gas stored in the bladder from leaking out through the air horn.

Figure 23:
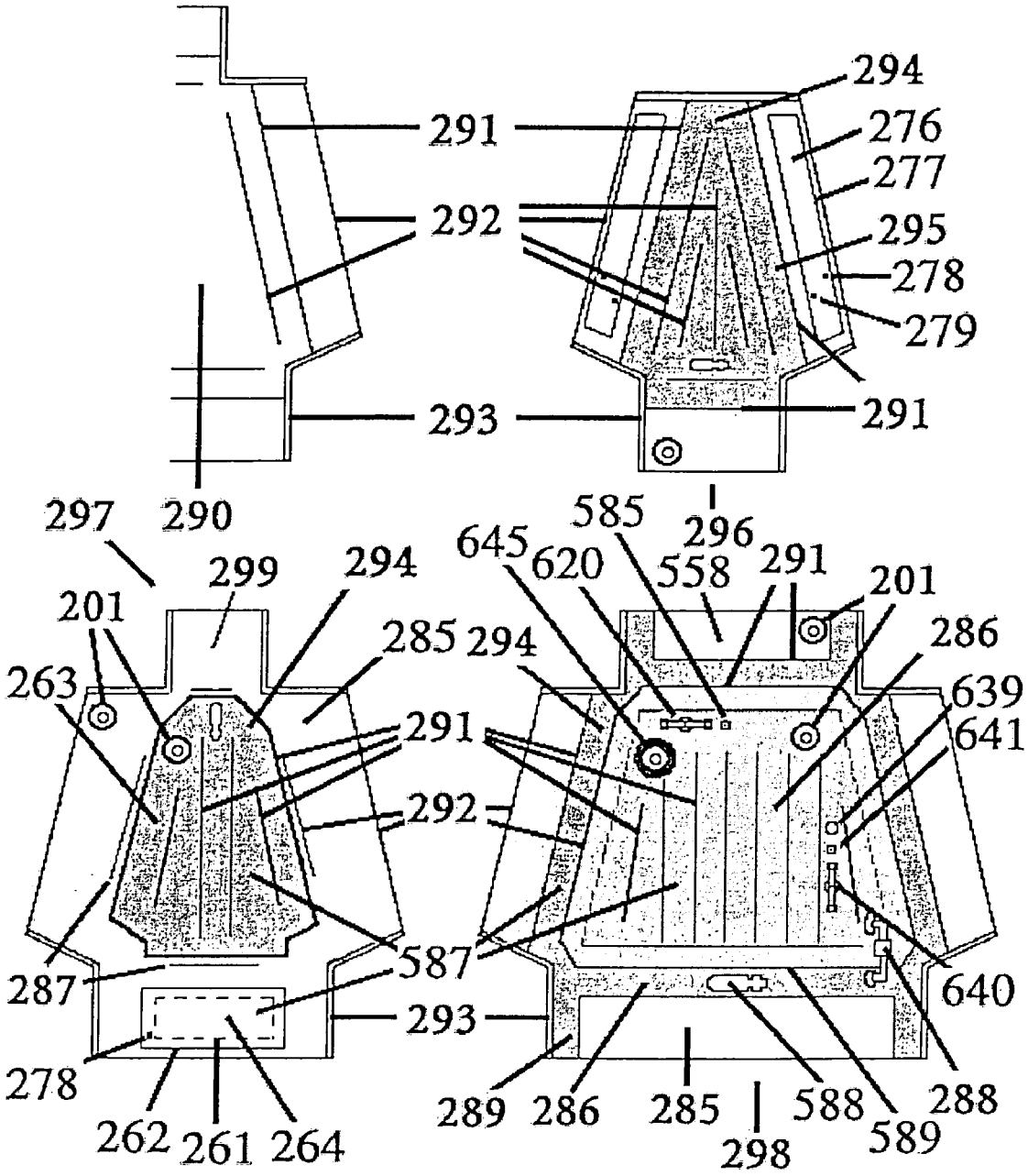

FIG. 23 is a planar view illustrating the plasticity of the raft which is welded sequentially in perpendicular planes. Use of three layers allows the construction to two structurally identical rafts or the incorporation of a range of extended survival chambers within a raft. A low volume floor chamber can be quickly inflated with minimal compressed gas to provide rapid buoyant assistance. The larger displacement chamber can then be more comfortably inflated manually. One or more chambers located above the water line contain water as a thermal mass for solar heating by day and radiant heating by night. A camping raft with a separate floor functions as an air mattress with a distinct inflated pillow. The inflatable pillow can also be used during the day to heat water for washing. The inclusion of any third chamber provides residual buoyancy in the advent of puncture and protection of the primary chamber from the occupant and attached sharp edged buckles and shoes. A four chambered raft indicates the power of design.

Figure 24:
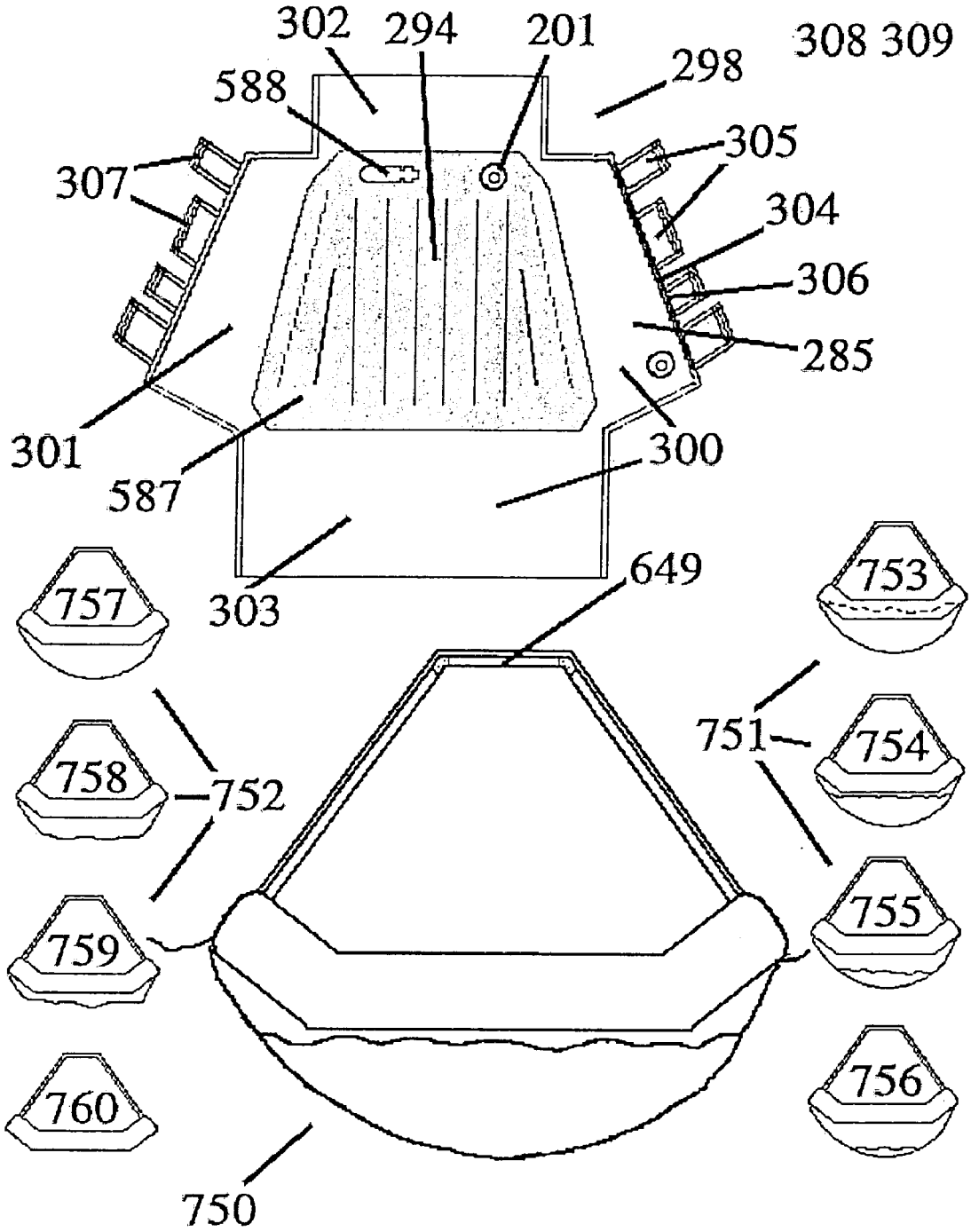

FIG. 24 is a side view illustrating the wide range in the ratio of contained ballast to buoyancy that can be achieved by use of a manual hydraulic and pneumatic pump with the supporting raft integrated valves. The continued ability to pressurized gas throughout a 1 to 100 day survival at sea, allows not only support and maintenance of structural raft pressure as the raft deteriorates in the sun but now allows deflated repairs at sea. The combined manual hydraulic and/or pneumatic pump allows the amount of buoyancy to be adjusted and re-adjusted to meet a wide range of under-loaded to over-loaded occupant scenarios. and to be adjusted to decrease amount of sea ballast in fair weather conditions or increased in foul weather conditions. Either ballast or buoyancy can be added or removed independently or they can be proportionally co-varied match changes in occupant load, sea conditions, availability of fresh rain water for storage. While the full floor chamber is used to depict the principle the upper floor likewise can be filled with air, drinking water or sea water or both air and water as can other loculated chambers found throughout the variable-displacement variable-ballast VDVB life raft.

Figure 25:
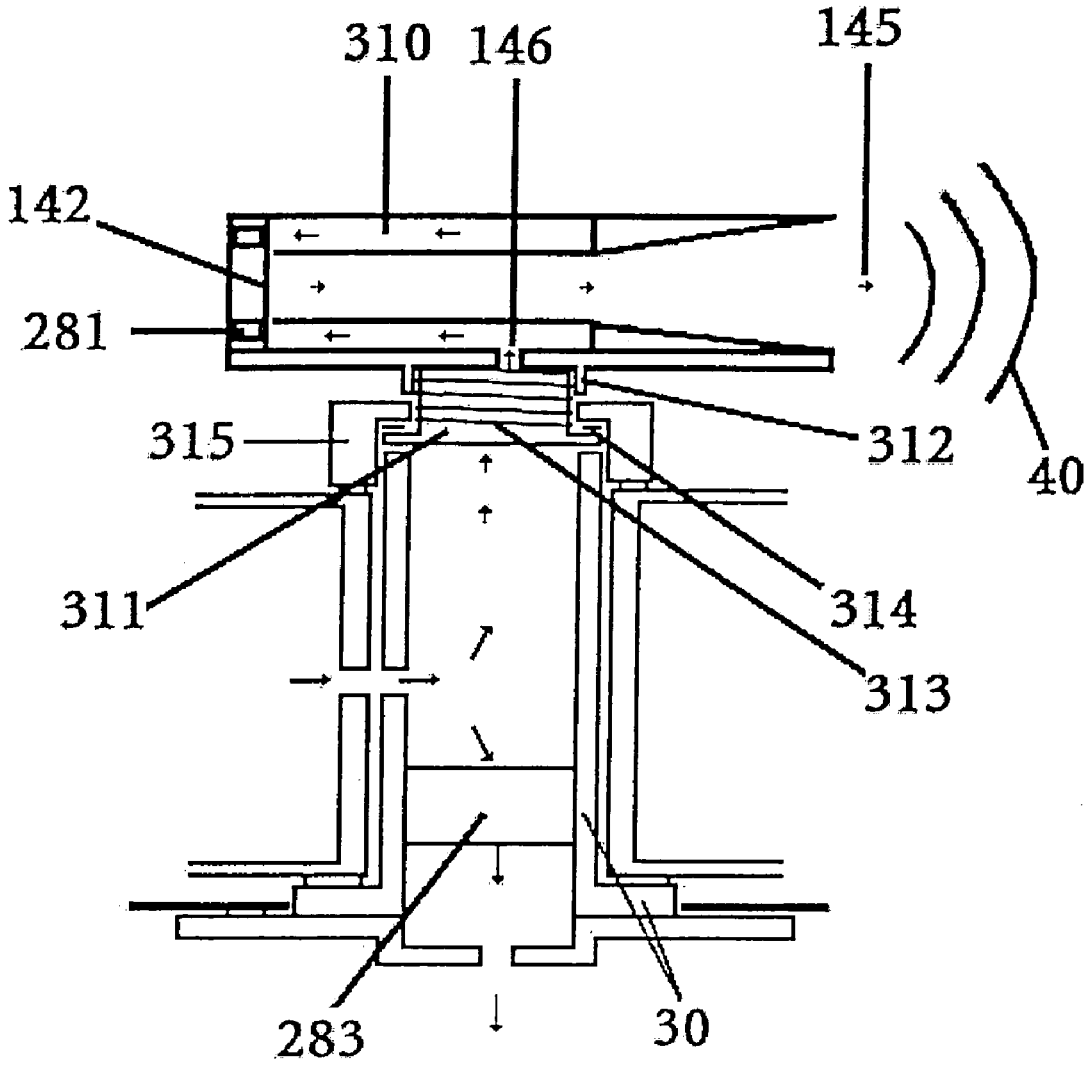

FIG. 25 is a lateral view illustrating an inflator mounted adapter for connecting an off the shelf air horn to the bladders source of compressed gas. The adapter relies upon a modified manifold nut through which passes the gasket sealed adapter that can pointed in any direction before being tightened. This allows the piercing sound to be directed away from the wearer regardless of where the CO2 manifold is attached to the bladder.

Figure 26:
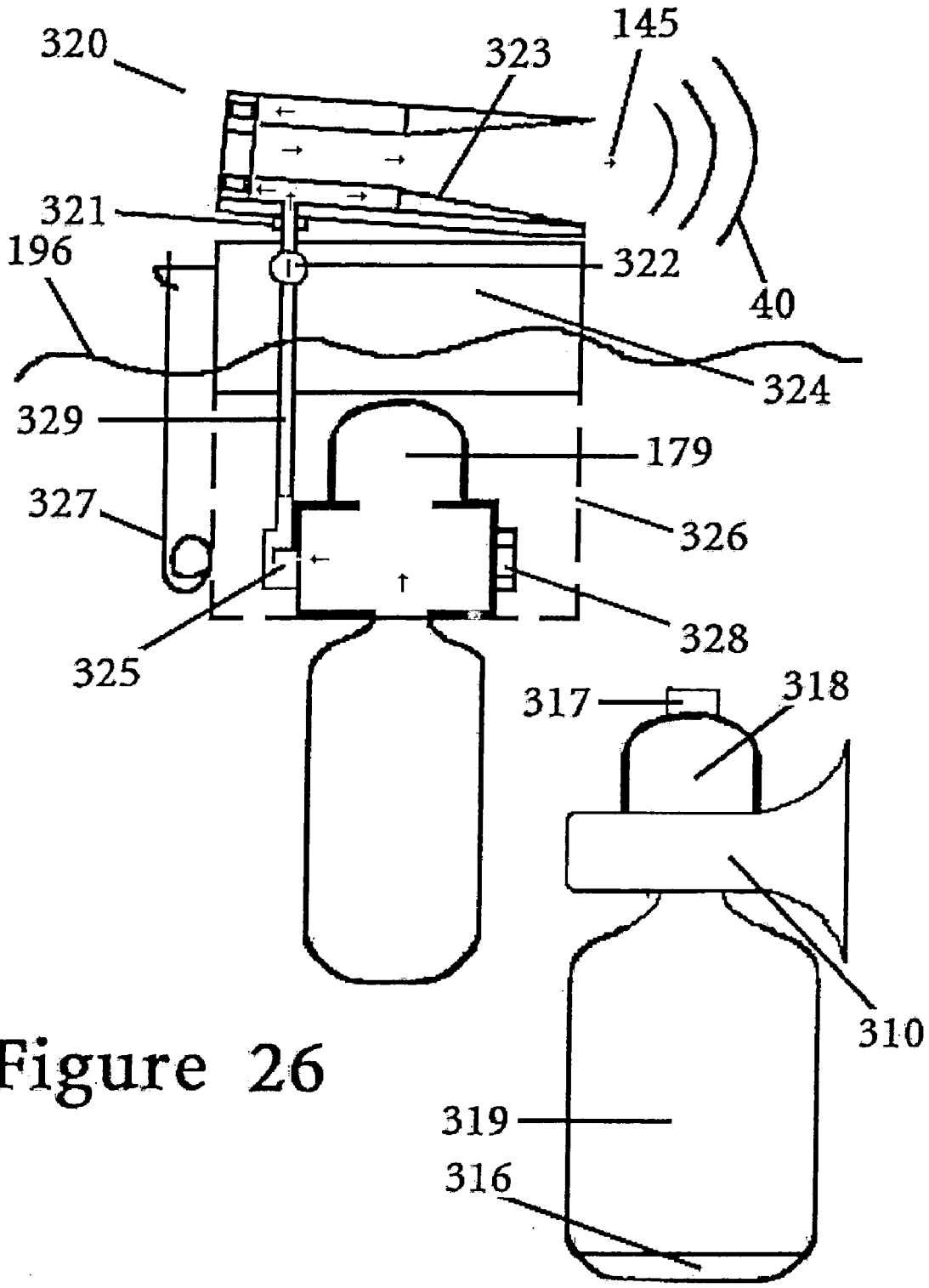

FIG. 26 is a lateral view illustrating a water activated, extended duration, man over board air horn. The cylinders ballast acts as a keel for a buoyant chamber that orients the air horn out of the water. The air horn is inclined to be self-draining. The Man Over Board Signal can be attached to any garment or PFD or thrown to mark the site of a Man Over Board.

Figure 27:
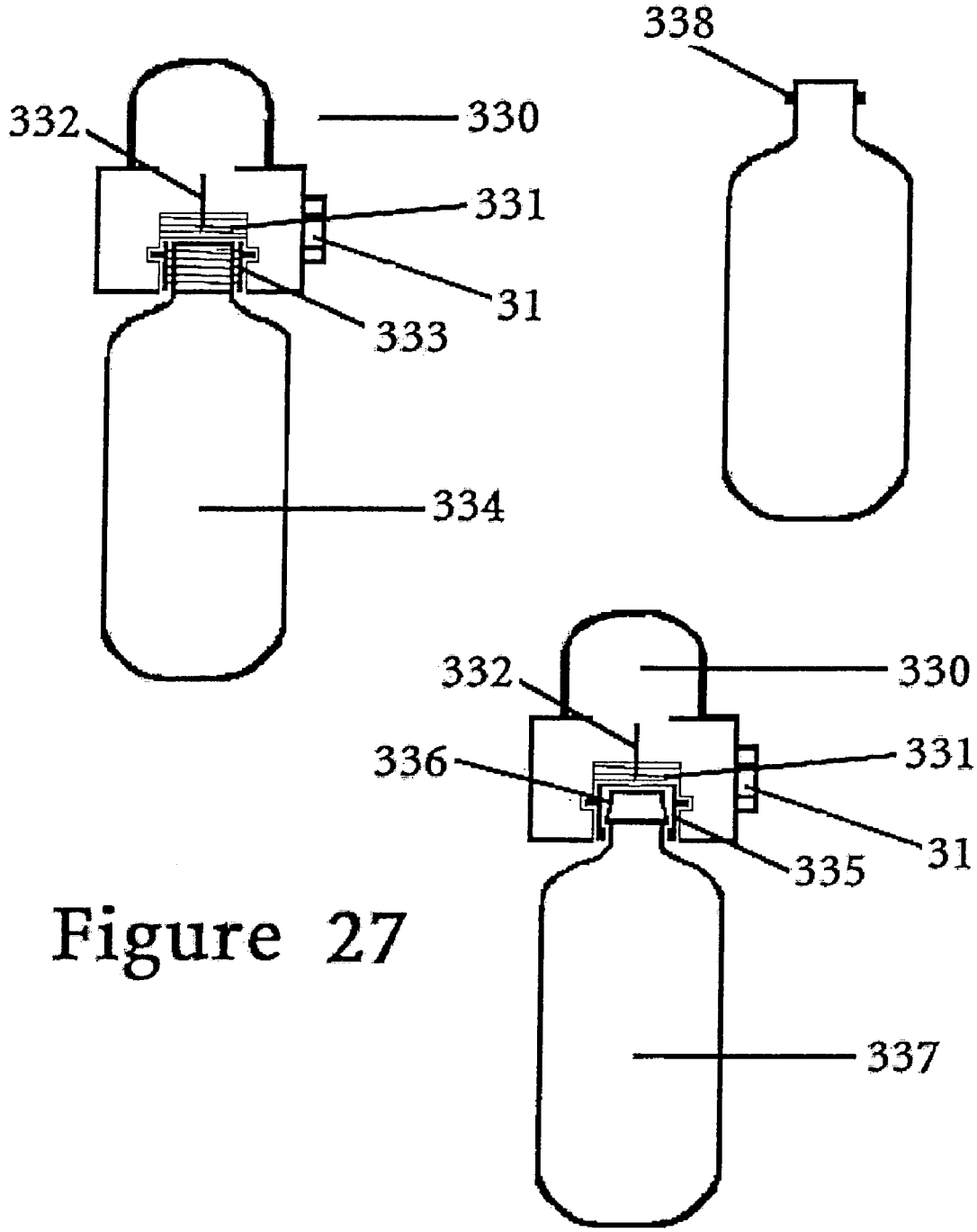

FIG. 27 is a lateral view illustrating an inflator that relies upon a quarter turn mount to prevent partially installed cylinders. An ejection spring forces the cylinder away from the inflator if it is not securely mounted. An adapter for threaded cylinders bites into the threads then adapts relies upon exterior pins to connect to the quarter turn inflator. A two-part adapter allows the crimp-sealed cylinder to be secured with the quarter turn pin adapter. Ideally the compressed gas cylinder integrates a pin system into the cylinder neck or seal to assure reliable connection between cylinder and inflator.

Figure 28:
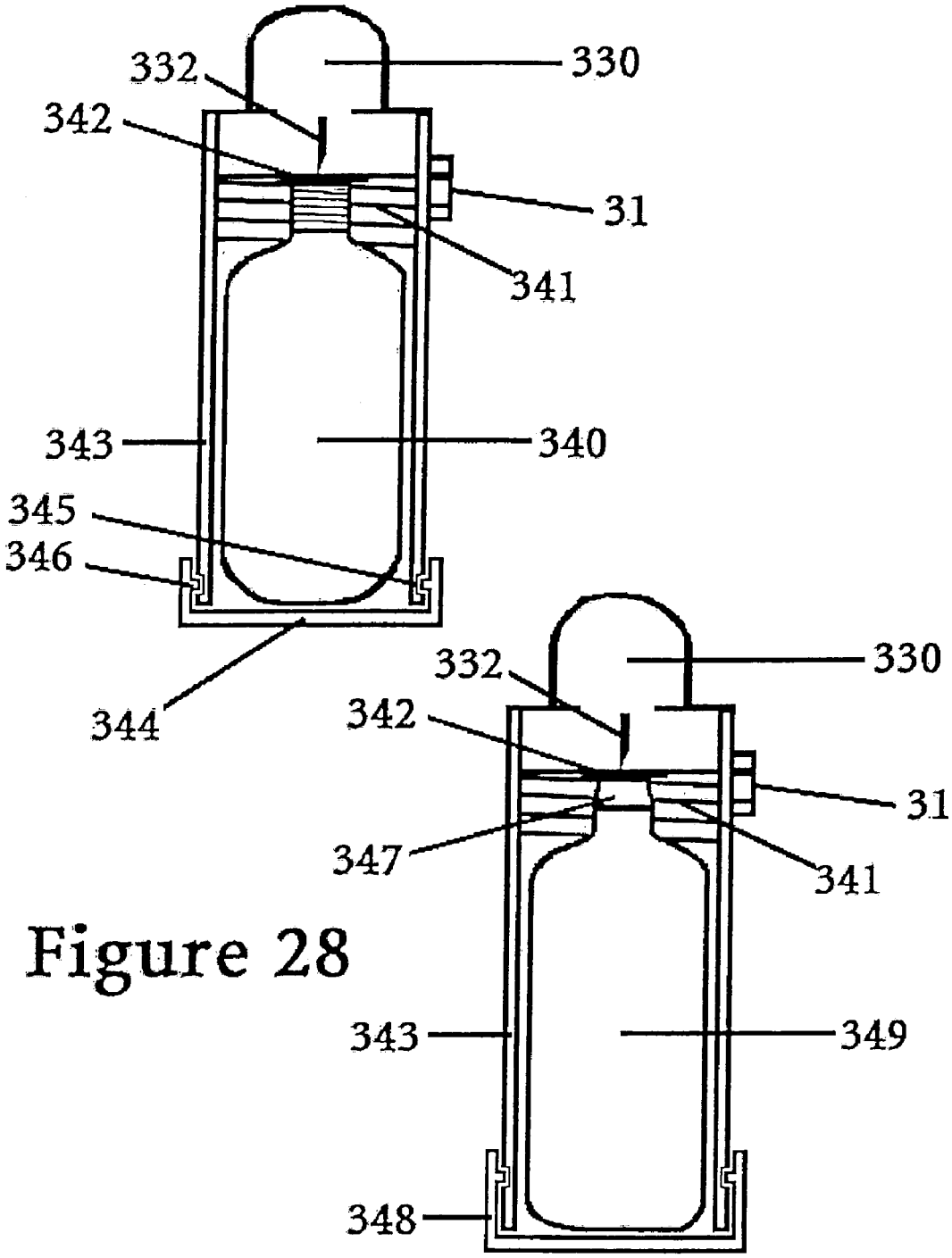

FIG. 28 is a lateral view illustrating a secure mounting system that relies upon a housing is integrated into the inflator. The quarter turn cap compresses the seal a constant distance from the piercing pin. An ejection spring pushes the cylinder and cap away if not secured by the quarter turn pin and recess mounting system. Caps of various lengths can be used to accommodate cylinders of different lengths.

Figure 29:
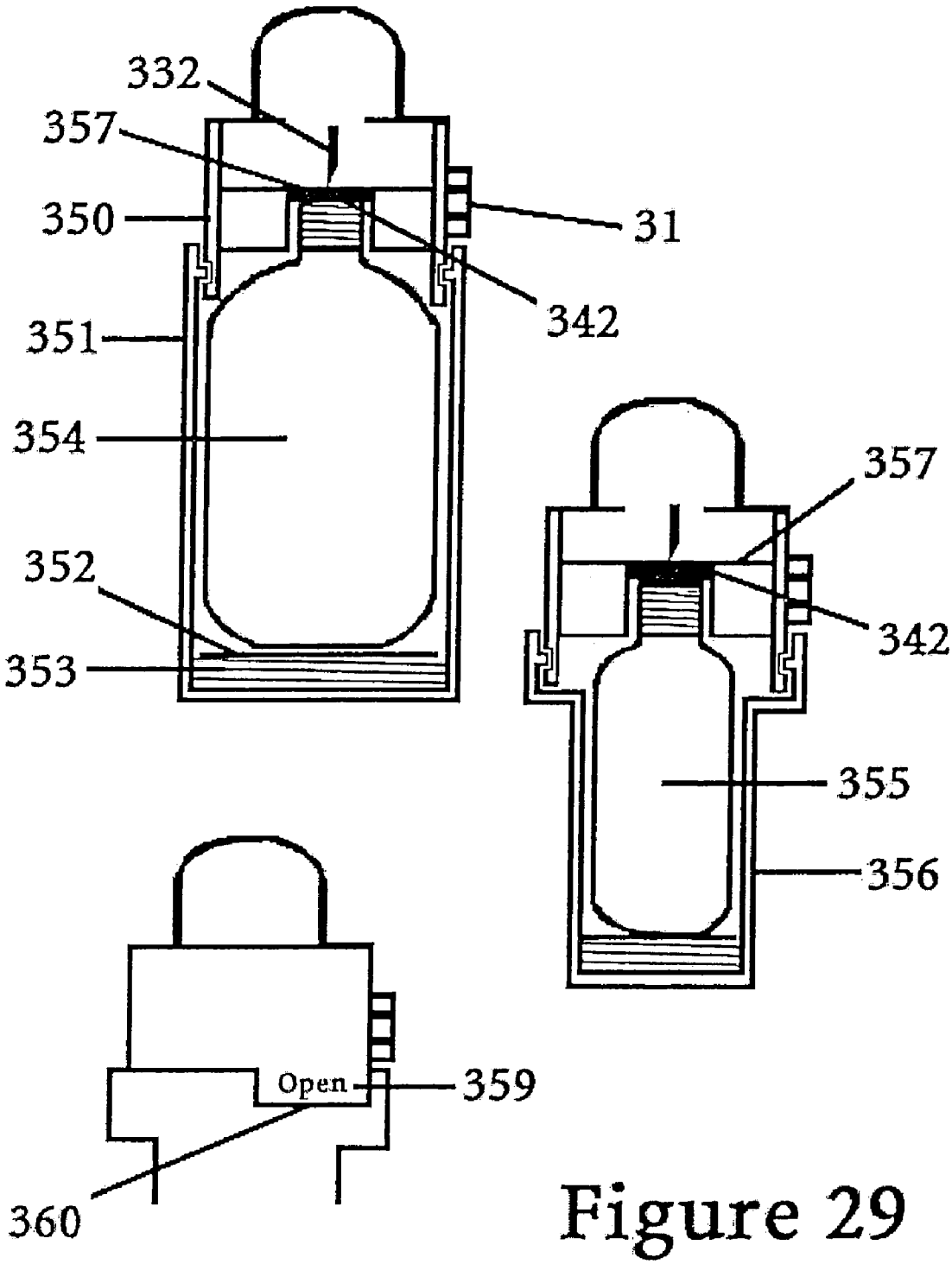

FIG. 29 is a lateral view illustrating a universal inflator bas quarter turn connector system. Cylinders that long or short, fat or thin can be securely attached with the quarter turn mount. An indicator window informs the user if the housing is completely engaged or not. An ejection spring forces the cylinder away if it is not held at the appropriate distance from the piercing pin eliminating failures due to cylinders that were installed or giggled loose due to vibration of the boat.

Figure 30:
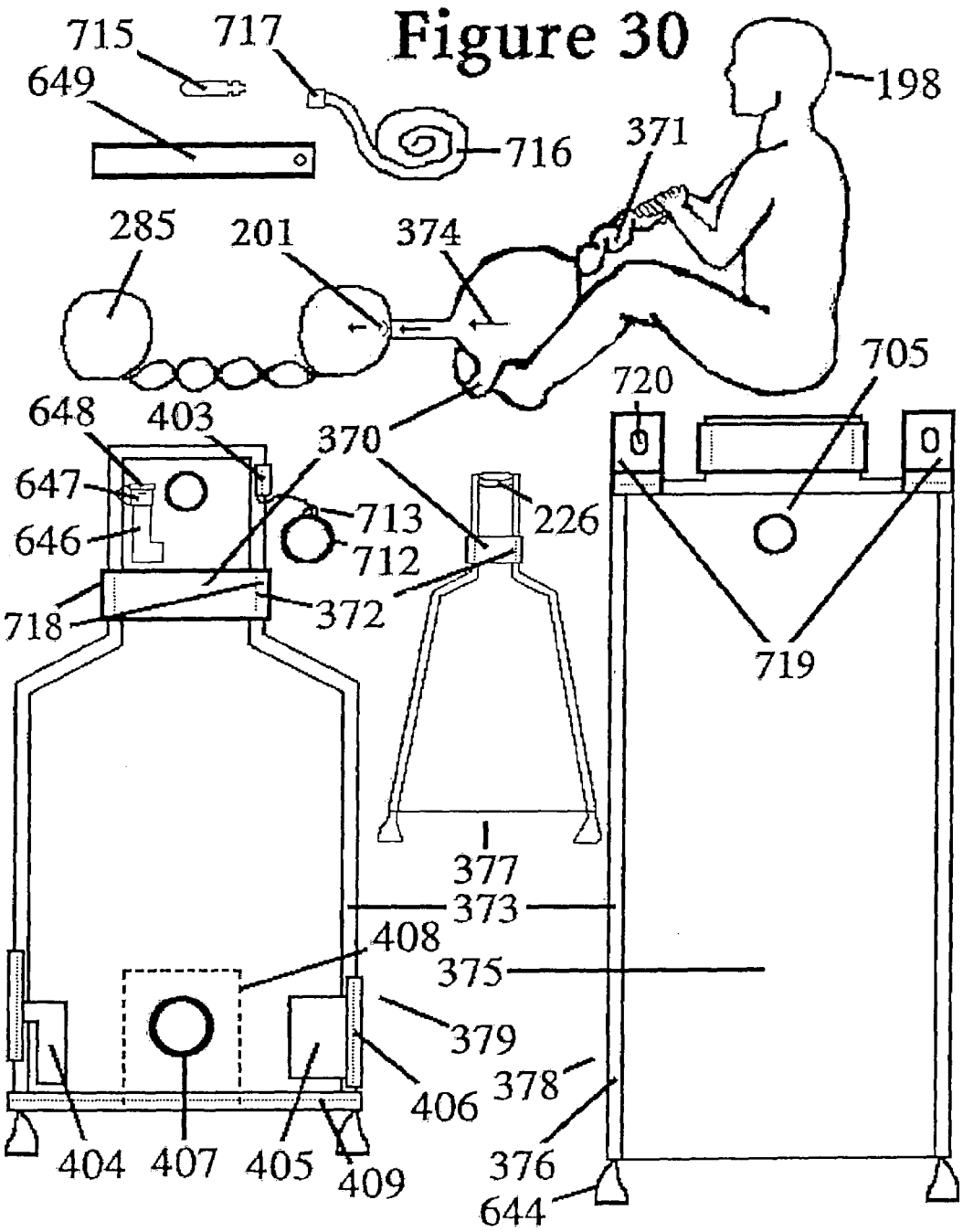

FIG. 30 is a lateral view illustrating a manual torque compression pump in use. The operator holds the bottom of the bag with their feet while twisting the top. The pressurized air flows through a fabric tube attached by an airtight coupler to the inflatable's valve. Due to the elevated pressures the operator is capable of generating the lever arm power torque pump the collector is welded and attachments are reinforced outside the collector's perimeter weld line. A drogue torque pump has an inline fabric coupler to improve its funneling operation as a sea drogue. The simple stuff sack torque pump has a long neck to facilitate collection. A lever arm amplified torque pump also includes single of nested sleeves for hydrostatic pumping without having to enter the water.

Figure 31:
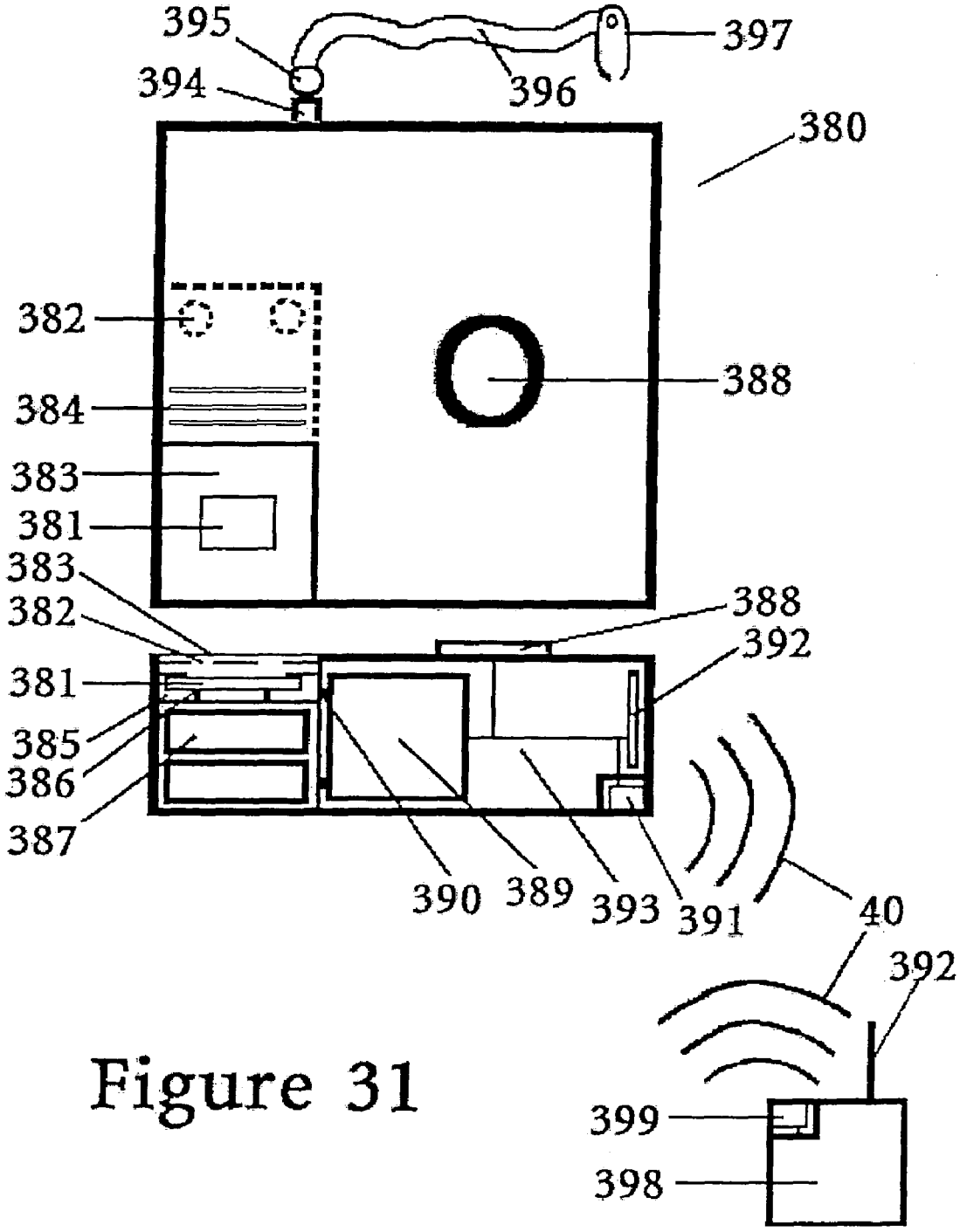

FIG. 31 is a surface planar view illustrating an ionic-switched oscillator and transmitter. This simple water activated alarm marks the site of entry and transmits a signal back to a base station identifying the onset of a water emergency. The device can be designed to transmit on the same frequency monitored by existing child monitors. A switch allows the user or parent to check the status of the transmitter battery. A low battery circuit beeps through the both remote and base unit oscillators. The immersion chamber is protected from inadvertent activation by splash or rain yet placement of battery ballast and sheltered venting assure rapid actuation upon immersion. The relationship between ballast and buoyant means built into the man overboard alarm is designed to float the device with the oscillator and antenna out of the water.

Figure 32:
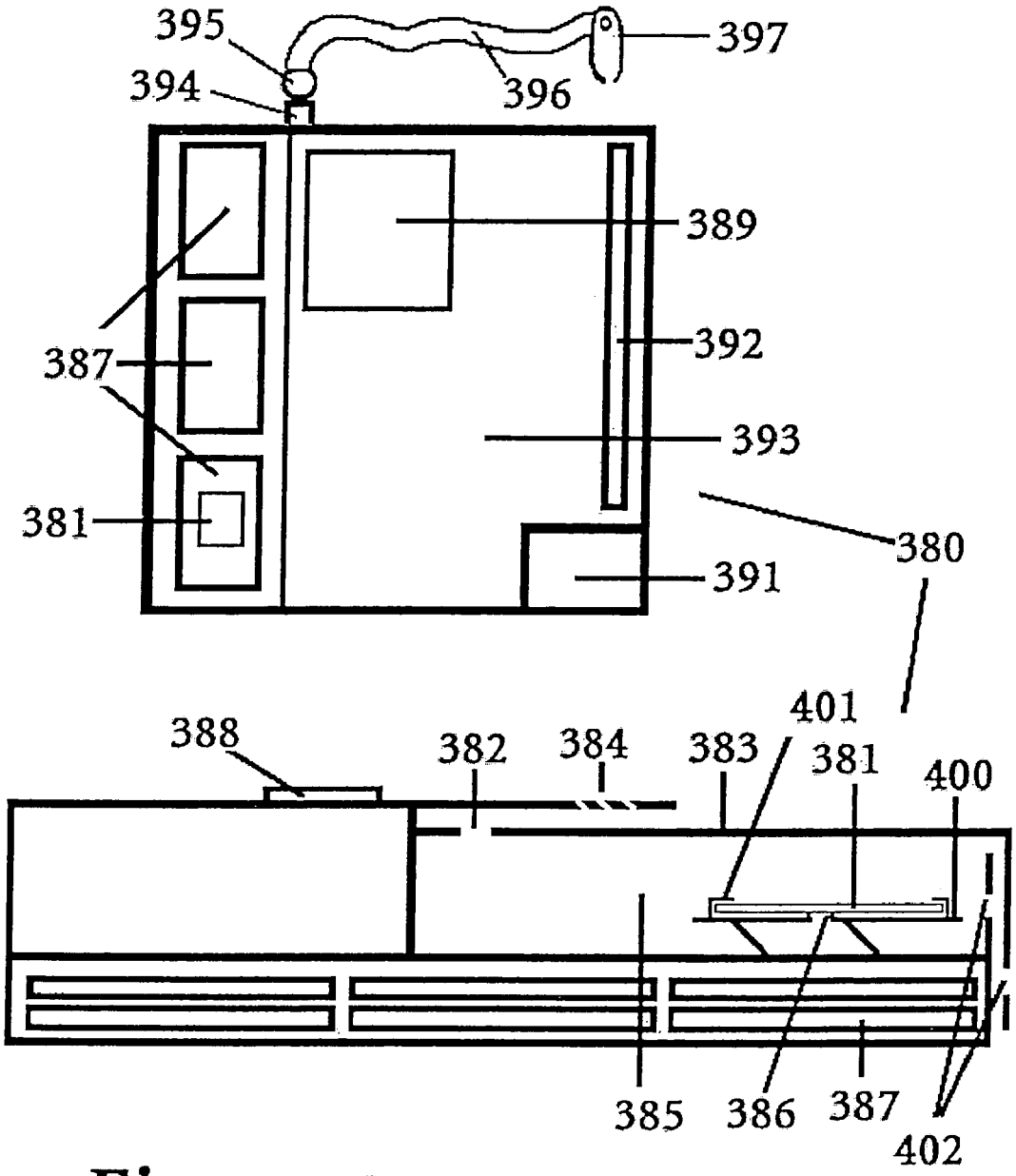

FIG. 32 is a planar schematic and lateral cross section illustrating the relationship between the ballast and buoyant forces. The battery ballast and immersion chamber are located on one side and the buoyant cell with antenna and oscillator at the opposite side where the device self rights to submerge the switch and float the oscillator and antenna out of the water. A lanyard and swivel give the device some room to accomplish this task.

FIG. 33 is a side view illustrating an ionic switch activated compressed gas inflator. Use of a remote switch allows the inflator to be placed behind the neck where it may float out of the water despite the unconscious victim floating face down. The use of a hardwired ionic switch eliminates the need for a transmitter and receiver. The hardwires ionic switch can be remote or mounted on the inflator body. A mechanically amplified solenoid releases a spring powered piercing pin. One special use device used by helicopter rescue personnel is a water activated inflator that can have a delay period incorporated so that when they hit the water's surface if the do not loose consciousness then they can deactivate the inflator. However if after 5 or 10 seconds they fail to deactivate the inflator then the inflatable will roll them over into an airway protected position.

Figure 34:
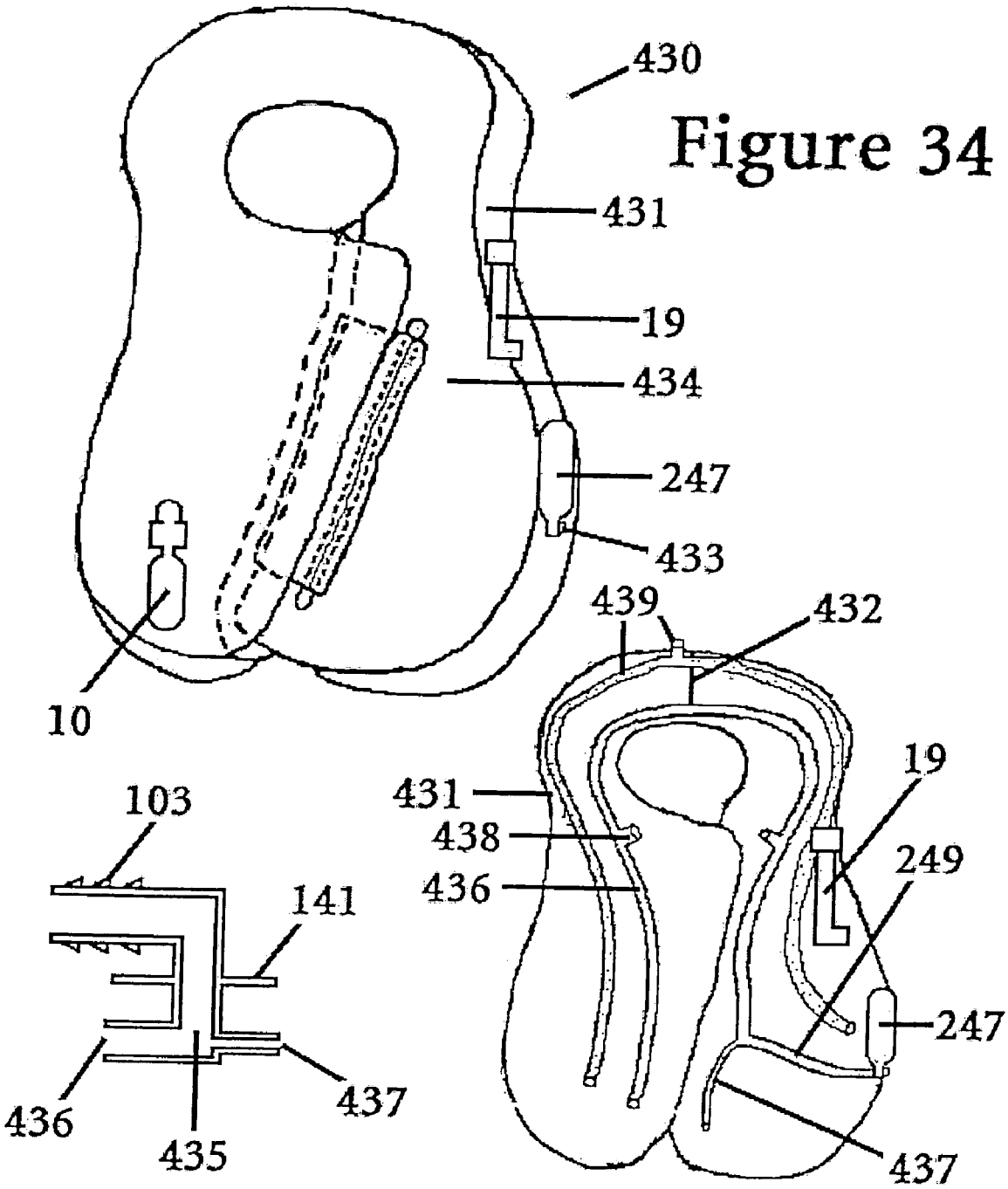

FIG. 34 is a frontal view illustrating a dual chambered PFD in which the front chamber is quickly inflated by water activated compressed gas while the rear chamber can be orally inflated in a relatively controlled emergency or if conditions warrant the rear chamber can be filled with open-cell or closed-cell compressed liquid foam. The rear chamber can be replaced when filled with foam. The lower right hand drawing illustrates how the liquid foam is distributed with the chamber. The lower left had drawing is a cross section of the weldable barbed coupler-manifold. The variation in diameter of the manifold connections and delivery tubes allows the distant chamber to fill at the same rate as the near chamber.

FIG. 35 is a frontal view illustrating the various embodiments of the compressed liquid foam inflated PFD. The upper left hand drawing is a PFD, which is orally inflated and inflated by manual actuation of the compressed liquid foam canister. The upper right PFD can be inflated by compressed gas, compressed liquid foam or orally. The lower left PFD is a dual chamber PFD with one chamber being water activated compressed gas the other being water activated compressed liquid foam. The lower right dual chambered PFD utilizes a common water activation means to inflate with gas and foam.

Figure 36:
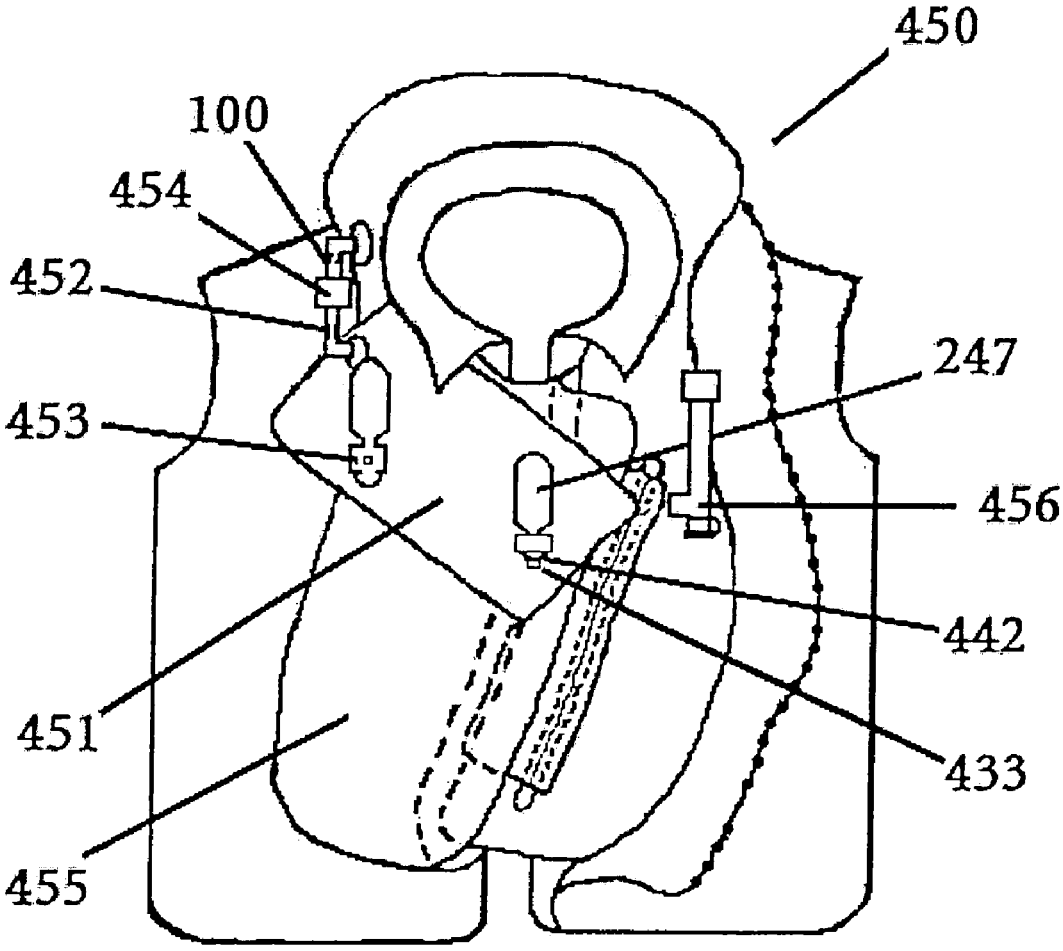

FIG. 36 is a frontal view illustrating a sequential convertible garment based PFD. The small 16 gm corrective turning bladder quickly inflates upon contact with the water. As that water activated liquid foam begins to move into the same chamber the air is displaced through an over pressure relief valve into the larger rear free board chamber. The rear chamber is partially inflated or fully inflated with compressed gas depending on the size/expense of the compressed gas cylinder selected. Quick release inflator and manifolds allow the user to remove the inflators from a foam filled chamber and re-attach and re-arm them on a new deflated 16 gm chamber.

Figure 37:
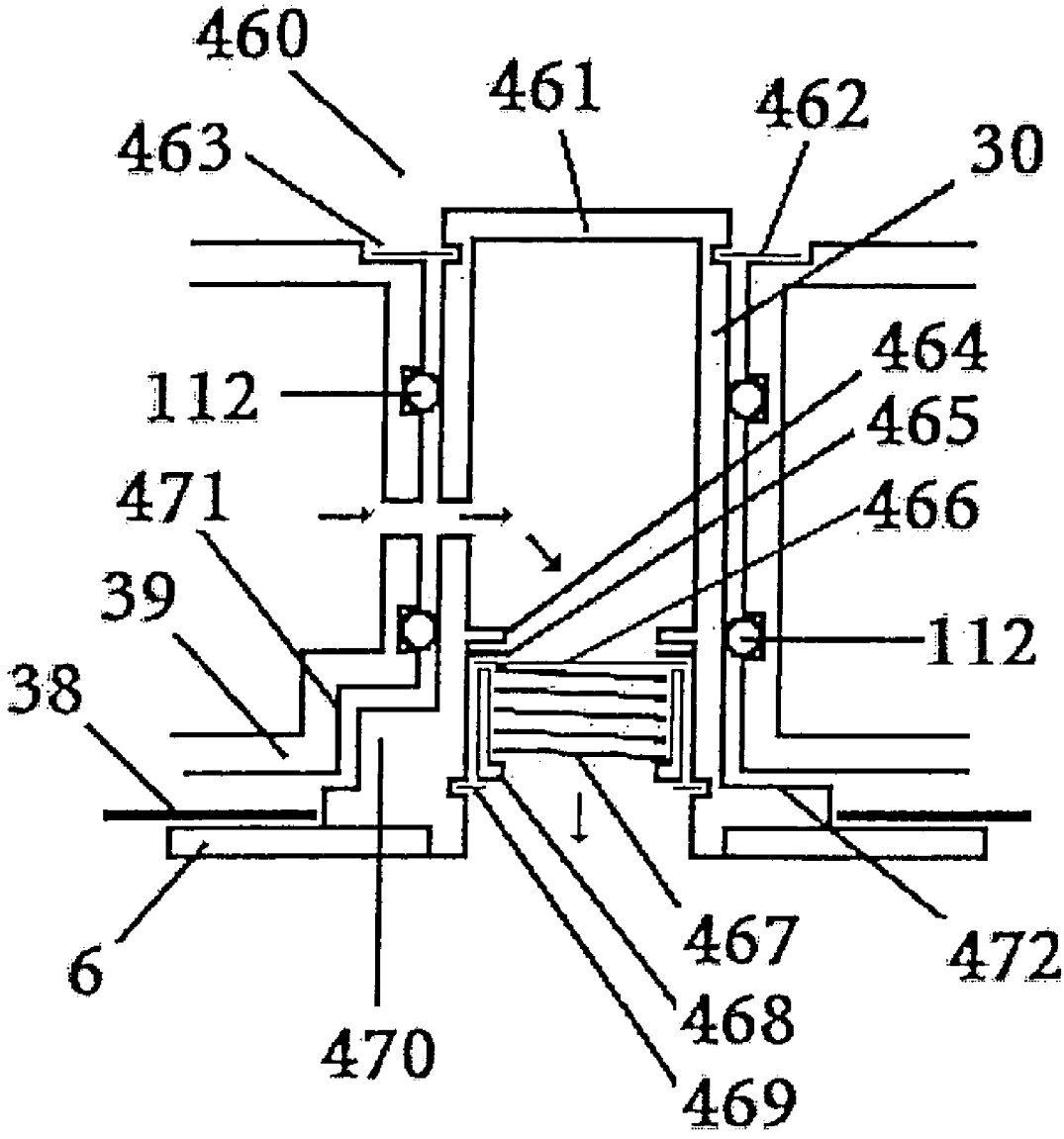

FIG. 37 is a lateral view illustrating a quick release mounting means for the compressed gas inflator. The inflator manifold welds into the bladder and contains the one way check valve. The inflator slides over the closed manifold post sealed by a pair of O-rings. A manifold key aligns with the inflator keyway to orient the inflator and prevent turning about the manifold post. A recessed spring clip locks the inflator on the manifold post and locks the check within the manifold post.

Figure 38:
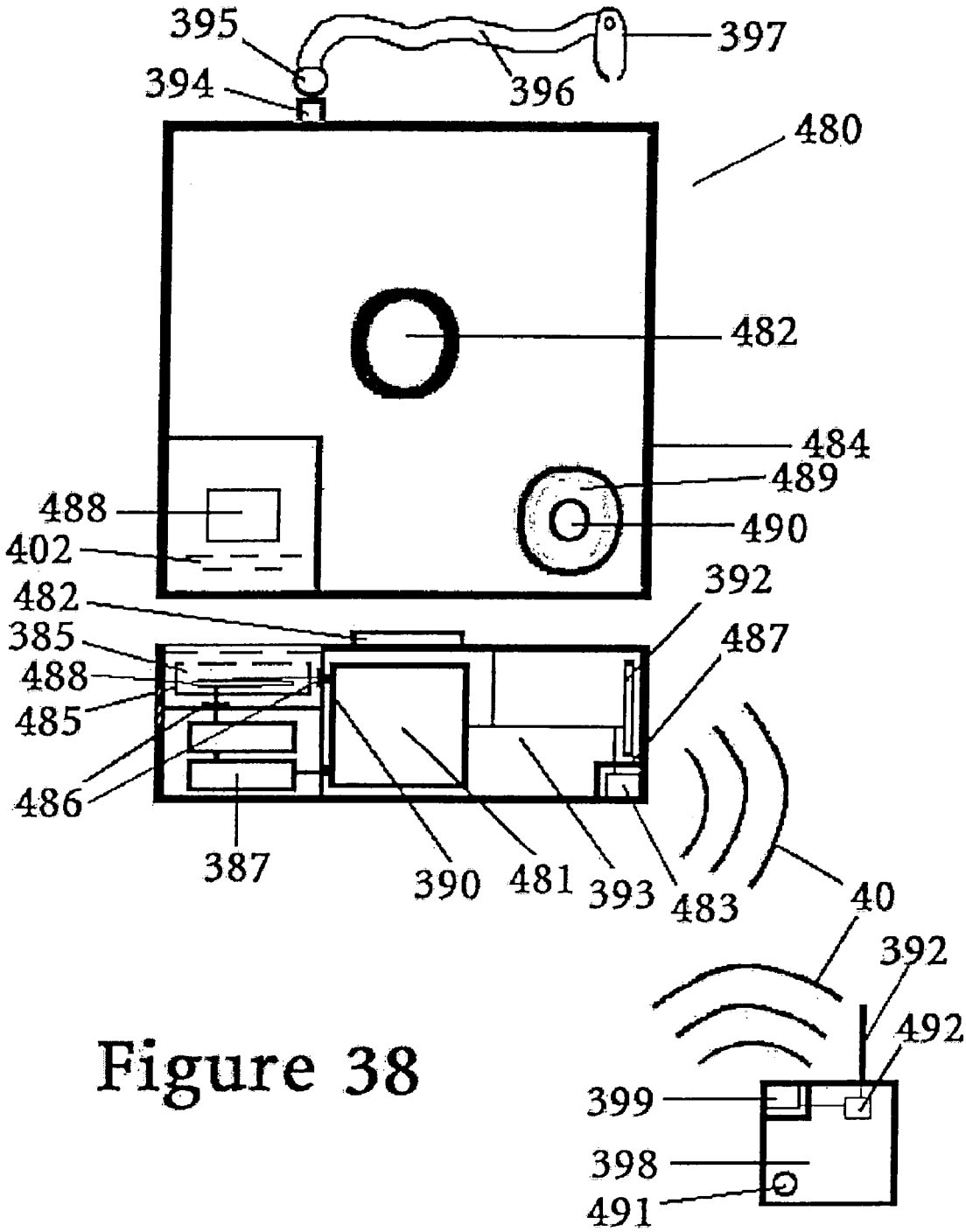
Figure 39:
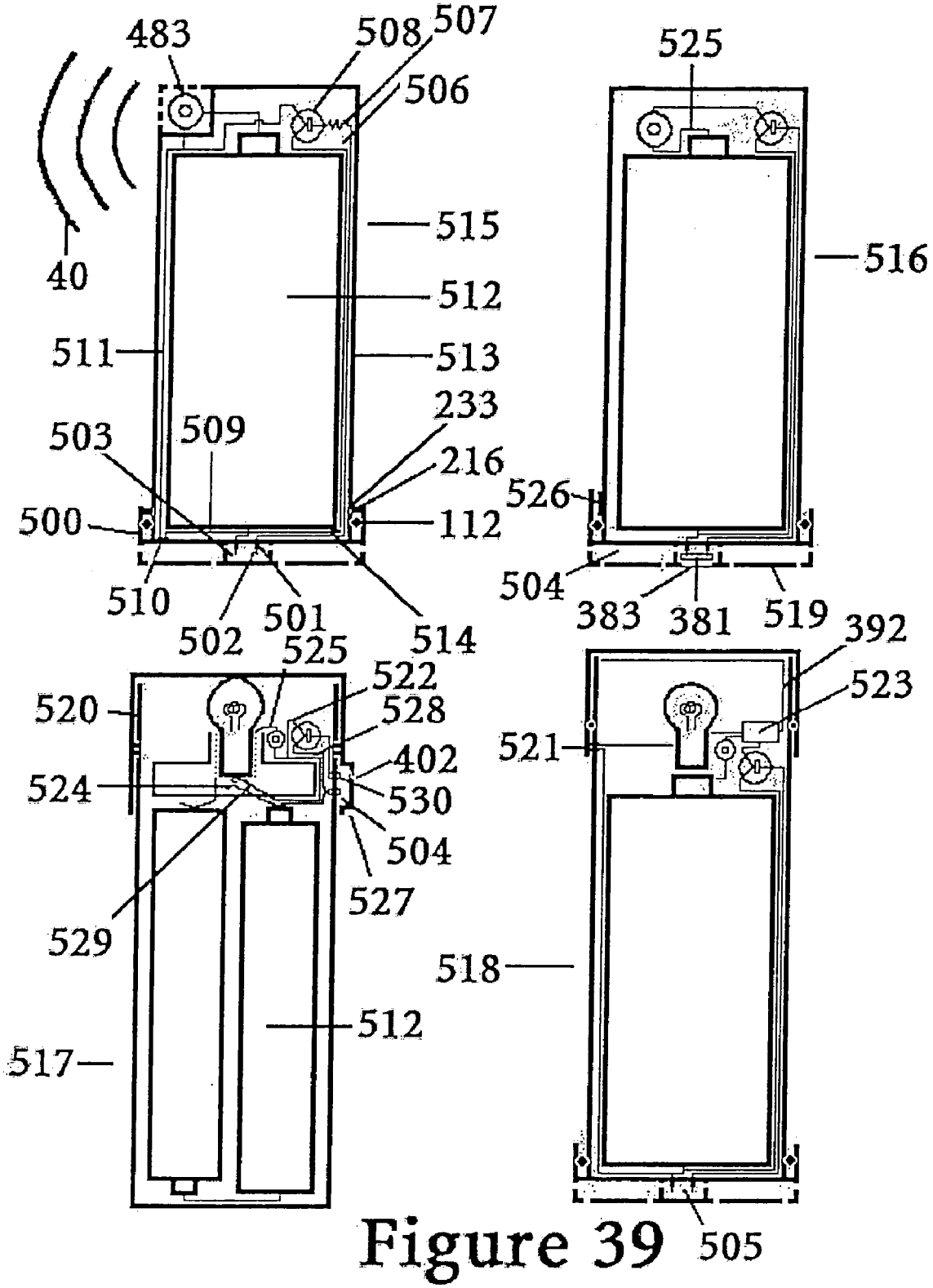

FIG. 38 is a superior and cross-sectional view illustrating a water or ion enhanced water closed switch that provides a local audible alarm and transmits a signal to a room monitor base station alerting monitoring personnel that the wearer has unexpectedly entered the water such as a tub, pool or pond. A salt pad can enhance water conduction of current, which operates a switch transistor to supply power to an oscillator and transmitter. The battery test button can also be used as an emergency alarm by a child to their wearer. If the worn unit has sufficient battery reserve, a transceiver allows the base station to utilize a locator button to find a pre-verbal child or a child lost in a store or crowd. A recessed reset button allows the guardian to turn off alarm after child is located. In the event of submersion in water the ionic pad in an ion enhanced alarm must be removed to deactivate the alarm and is then replaced FIG. 39 is a lateral view of four water activated alarms illustrating an increasing complexity in the type of signals generated upon submersion of the water or ion-enhanced water conduction switch. The simplest is a water-activated audible alarm such as could be attached to a PFD, alerting the crew remaining aboard of the onset of a man over board emergency. If require the water switch conduction can be enhanced by inclusion of salt impregnated pad increasing the conductivity of the water between the switch electrodes. The third drawing includes a water activated audible alarm within a waterproof flashlight with electrodes of a material, surface area, coating and distance to reduce the voltage applied to the gate of the switch transistor to a safe level avoiding the need to incorporate a resistor. The fourth device that adds voltage amplification and RF signaling means to the flashlight.

Figure 40:
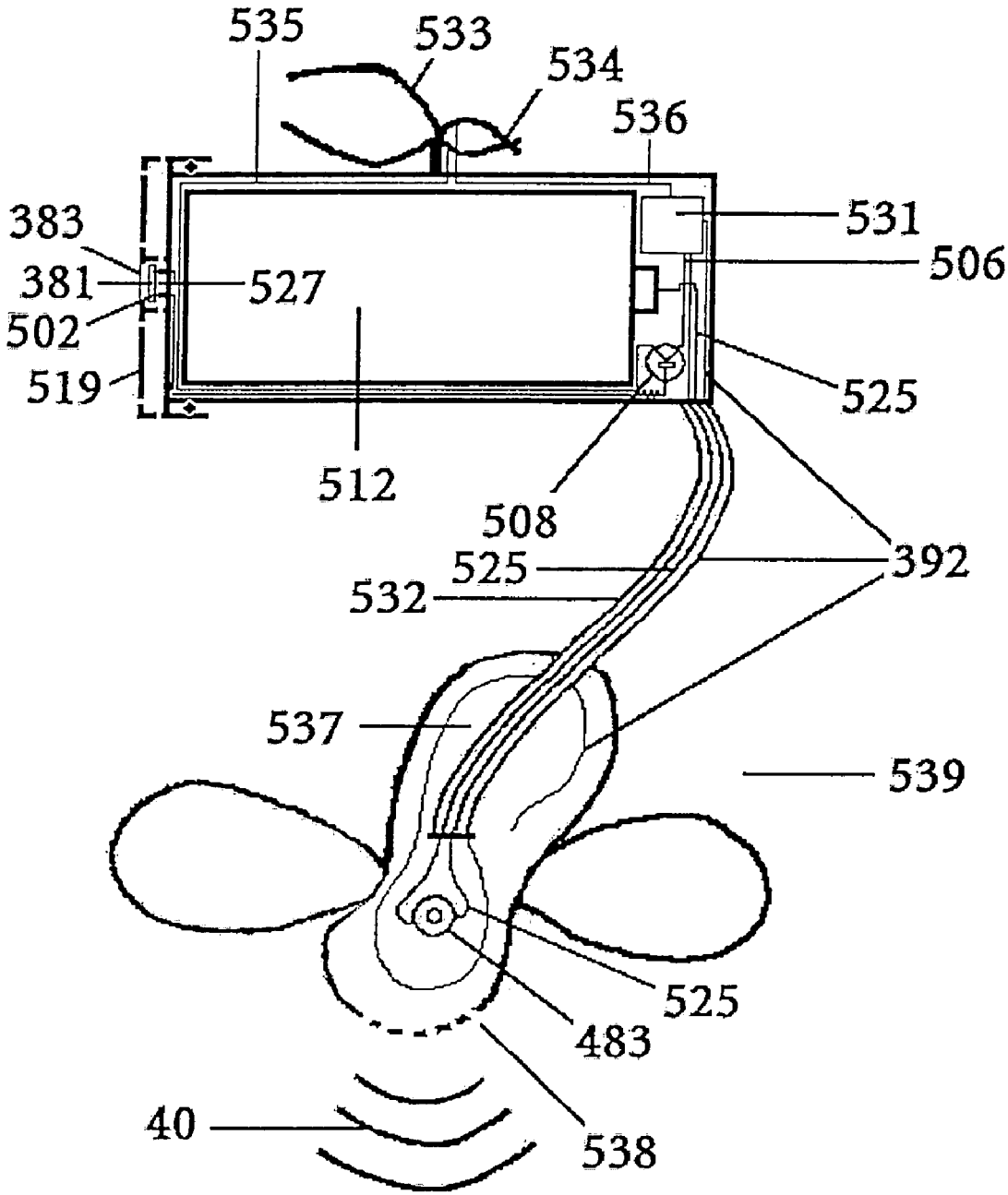

FIG. 40 is a lateral view illustrating a toddler water entry alarm. The water conduction switch, battery and circuitry is clipped in the vicinity of the toddler's airway. A reusable water conduction switch supplies the power to operate the gate of the switch transistor, thereby providing full power to the oscillator located at the end of a lanyard within a child friendly buoyant bumblebee. The buoyant lanyard also serves as the antenna for a transmitter that transmits the alarm on the same frequency as pre-existing baby monitors. A test switch built into the garment clip confirms all systems are operational daily or more often as the device is moved to a clean garment. If the garment mounted portion contains sufficient batteries a transceiver allows reception of locator signal from the parents mobile or mounted base station. The bulky two-part combination will facilitate the oscillator and antenna floating even if the head is submerged and reduces risk of ingestion.

Figure 41:
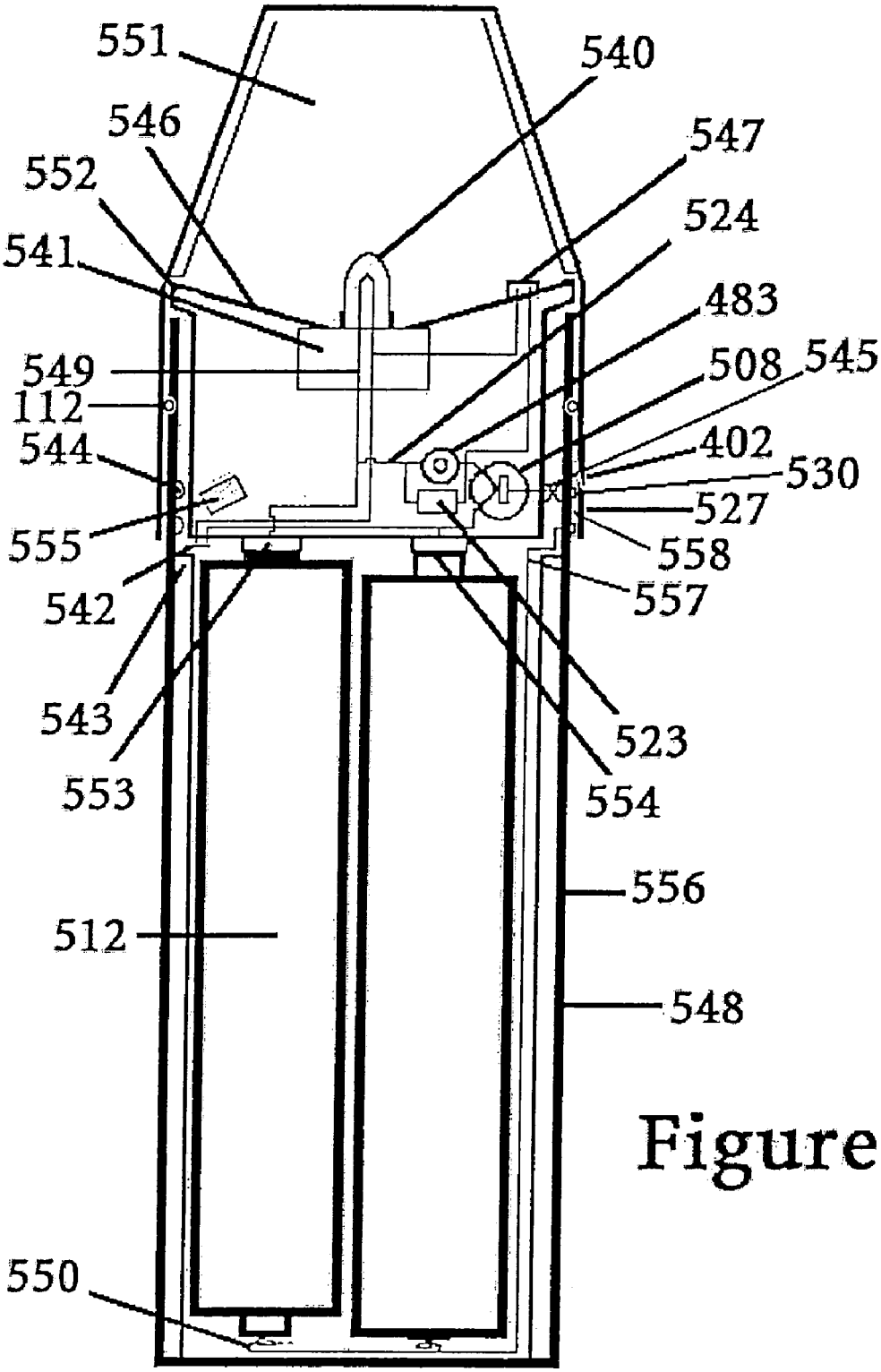

FIG. 41 is a lateral view of a Light Emitting Diode flashlight with integrated Man Over Board Signaling system. Compression of normally open manual switch supplies current to the LED when the cap is screwed in. A continuous compression connection is in a circuit with a water or ion-enhanced switch, which detects submersion and provides visual, audible and RF notification or the onset of the water emergency.

Figure 42:
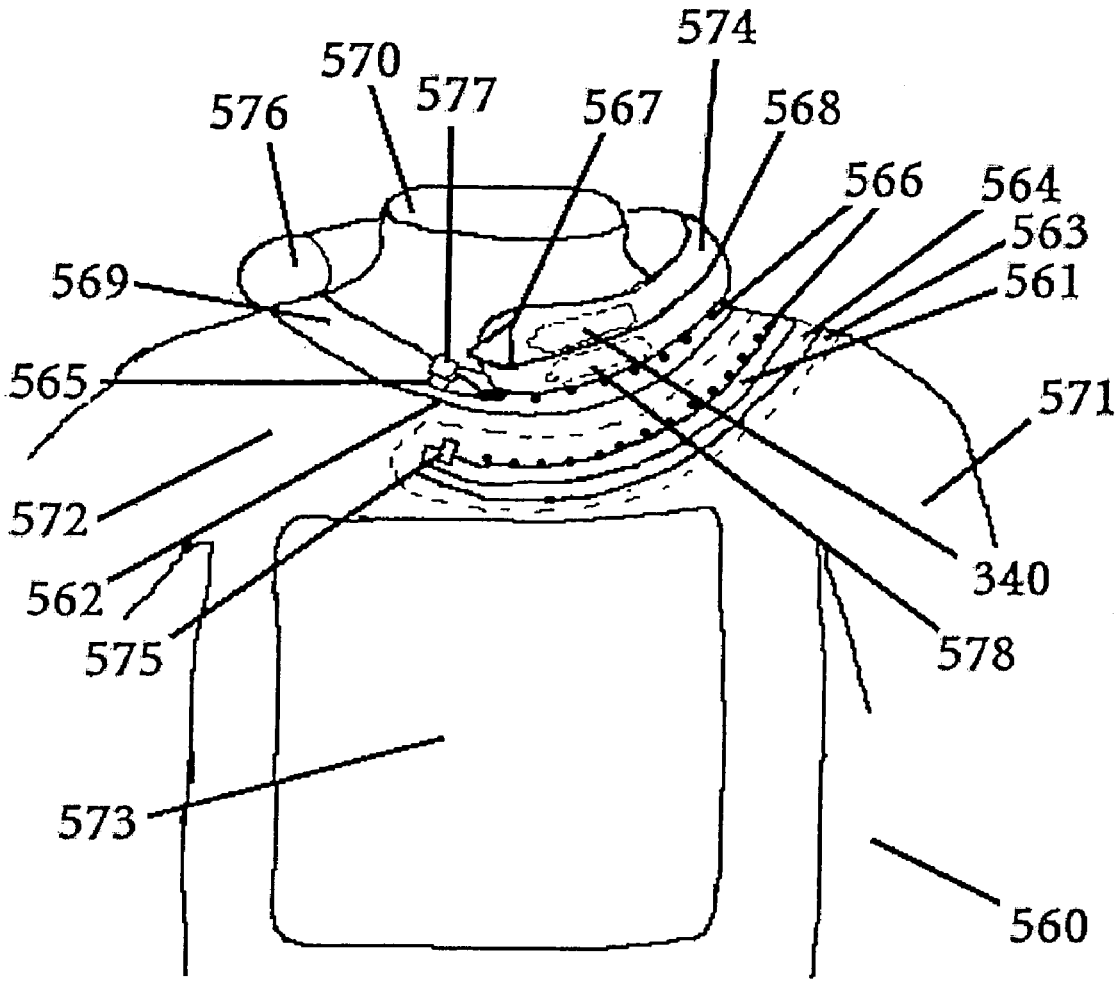

FIG. 42 is a frontal view illustrating a series of modifications for reversibly mounting an inflatable PFD to a dry suit. The flange is created out of the fabric or from fabric welded, glued or through sewn then back patched. To the flange is sewn the reversible attachment means. The eye of the zipper's pull-tab is modified to complement a twist lock post. Lock and key combination secures the reversible mounting zipper from loosening before or after inflation yet allows quick release in the event the inflated PFD must be quickly ditched. The manual lanyard is attached to a transferable inflator to which is attached a cylinder containing compressed gas. An alternative cylinder contains compressed gas and puncture sealant in the event of a ballistic impact positive buoyancy can be re-established.

Figure 43:
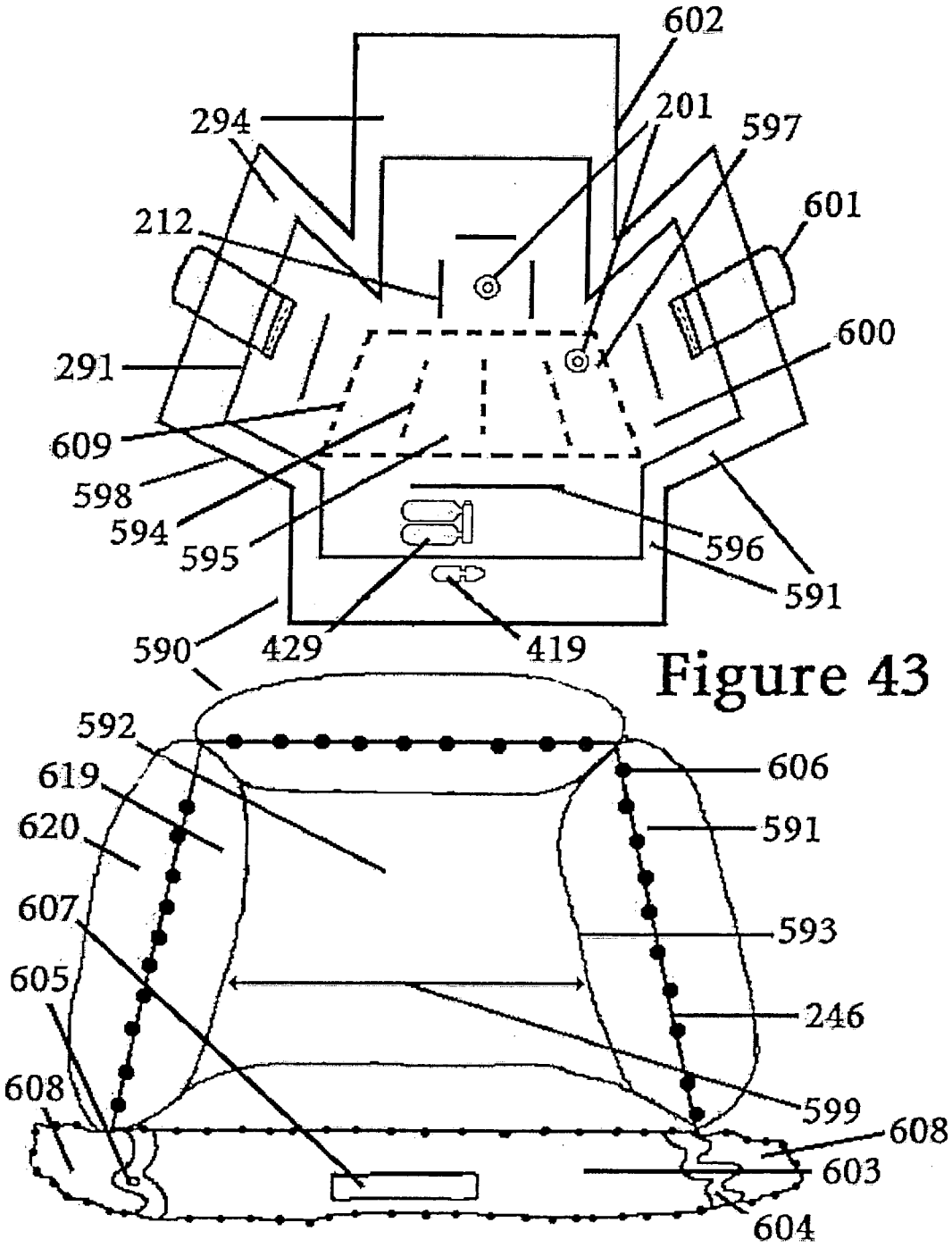

FIG. 43 is a superior view illustrating the water extrication bladder before being welded and after inflation. This hypothermia mitigation system creates the greatest displacement from the least amount of fabric by selecting a cube shape. The compressed gas upper perimeter and eight vertical struts creates the ideal high volume collector suspending the floor form deep walls the internal displacement equals the displacement of the manually inflated lower wall tube and floor so that the raft can inflate itself with a single pump. Minimal floor and wall baffles allows an unusual degree of expansion creating a unique amount of displacement for the size of the raft. The torque pump can be used to instill compressed air or water ballast to offset the excessive buoyancy if the victim is not very large.

Figure 44:
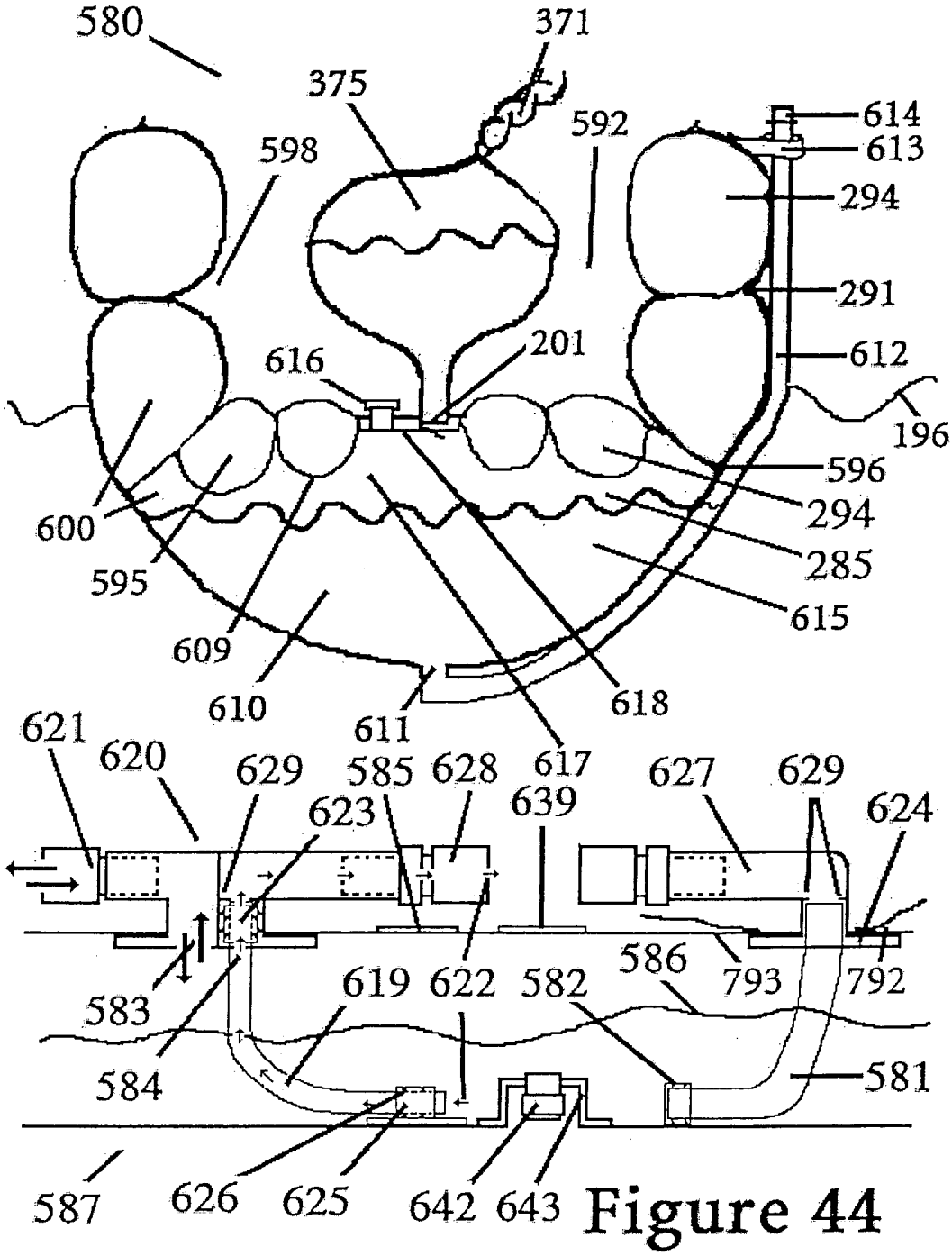

FIG. 44 is a lateral view illustrating a variable displacement variable sea ballast system allowing victim/s to offset excessive buoyancy in a mounting sea state or changes in numbers of occupants. Lower drawing depicts single connector securing a mobile ballast tipped draw tube for accessing drinking water or evacuating sea ballast. A dual lumen draw tube integrates an over pressure valve and vent with a draw tube fixed to the hull bottom.

Figure 45:
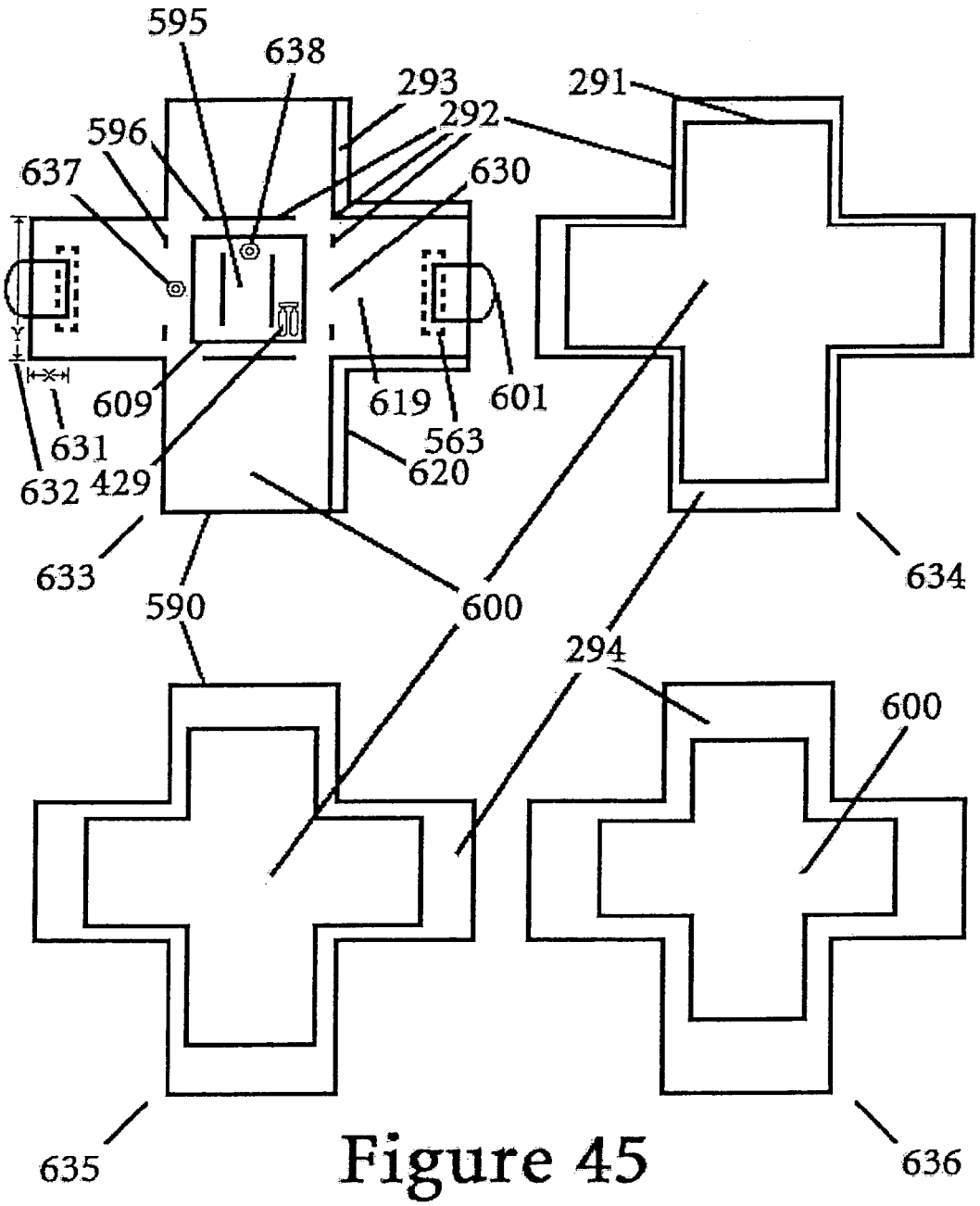

FIG. 45 is a superior planar view illustrating the construction of self-inflating Heat Escape Lessening Position raft. The internal hydrostatic collection chamber is reduced during pumping while increasing the size of the external layer establishing a pressure differential from the collector into the raft.

Figure 46:
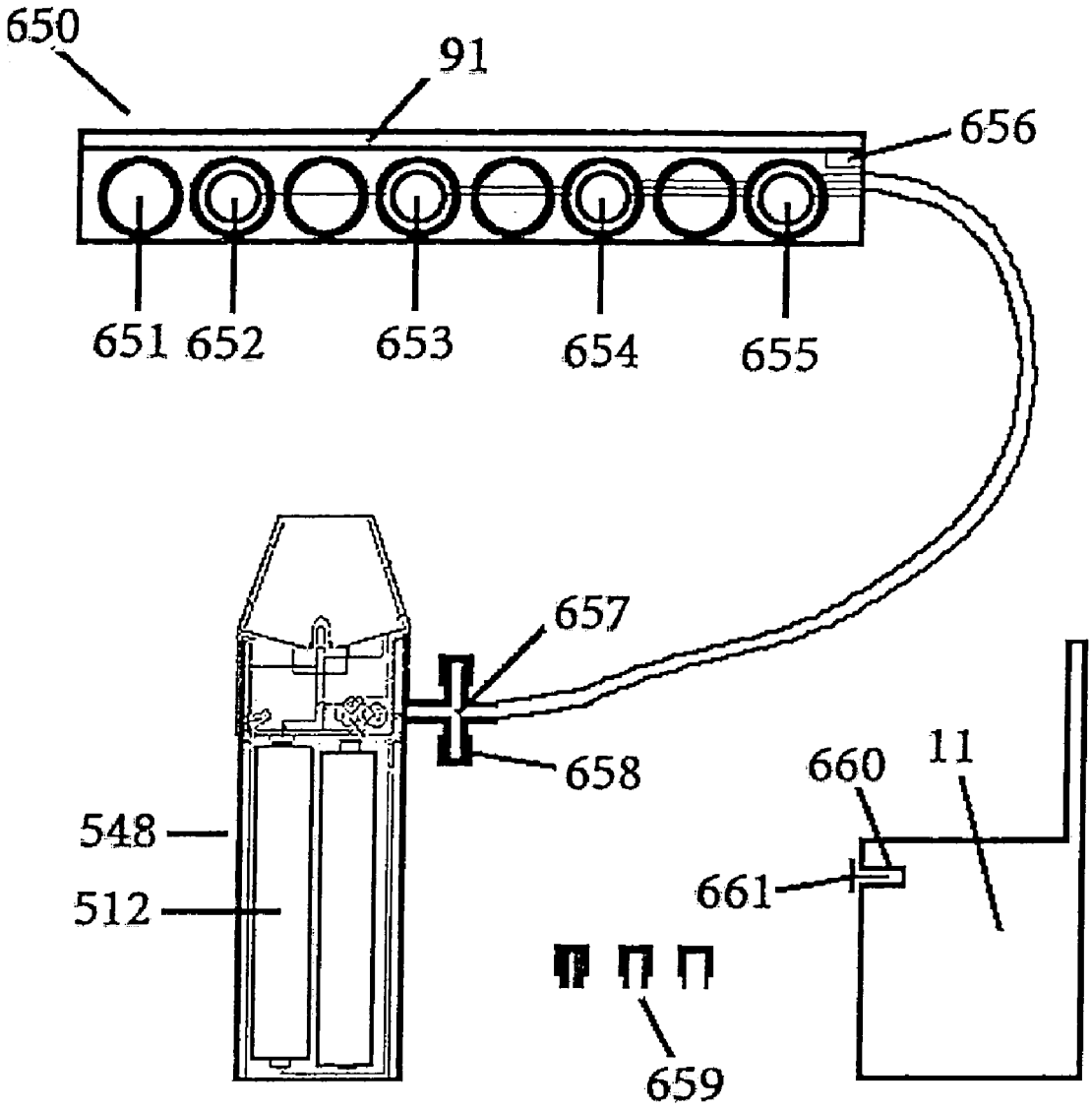
Figure 47:
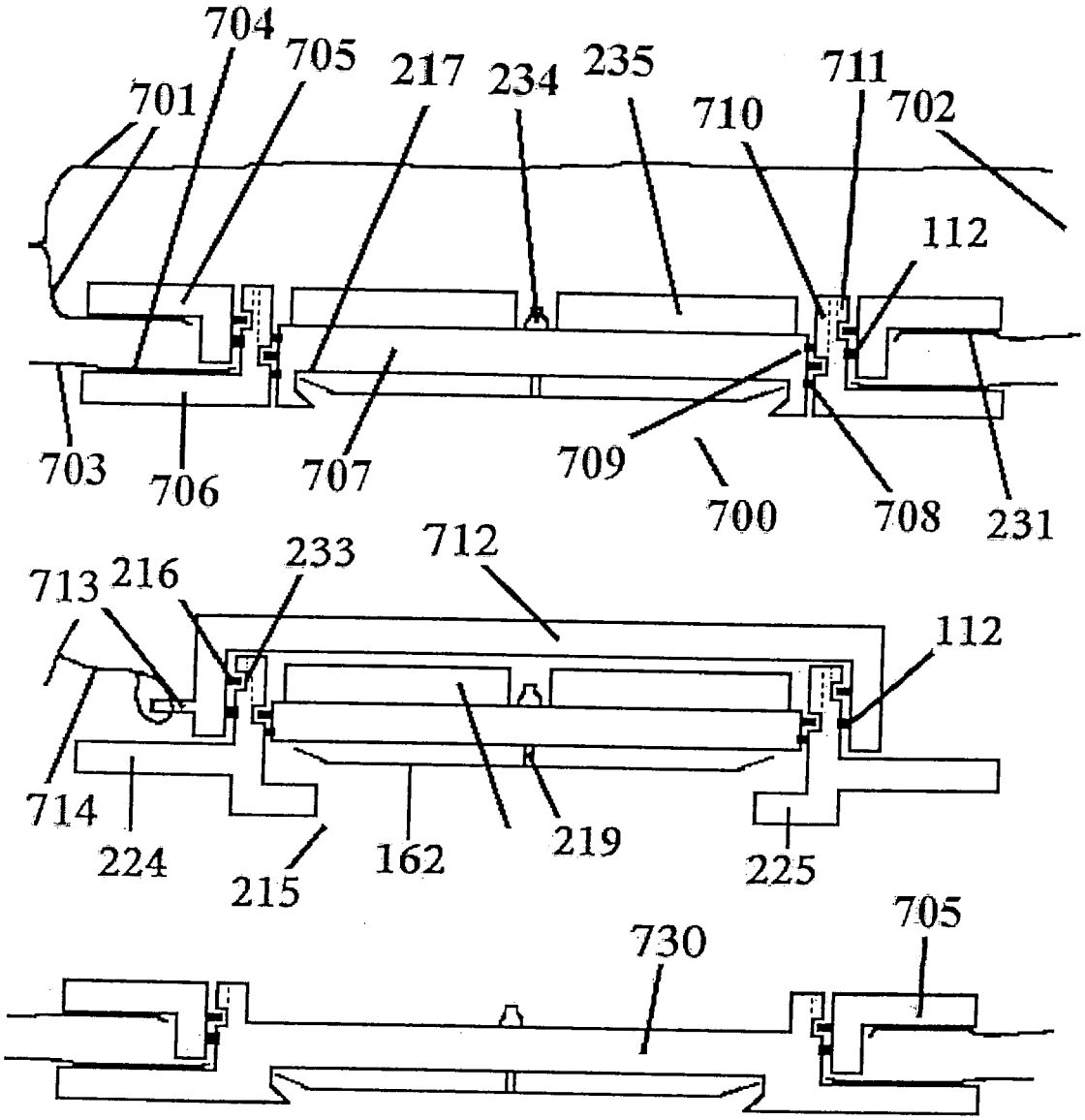

FIG. 46 is a superior view illustrating a solar collector with integrated reducing transformer and selectable range of permanent jacks for recharging a common power supply as well as lights, VHF radio, EPIRB and RF signaling means FIG. 47 is a lateral view illustrating a low profile quarter turn locking fabric-coupled check valve. A removable quarter turn locking valve core integrates a large bore check valve. An airtight cap covers the check valve when not involved in inflation or deflation. An ultra low profile, one piece weldable valve body with integrated check valve does not allow rapid deflation.

Figure 48:
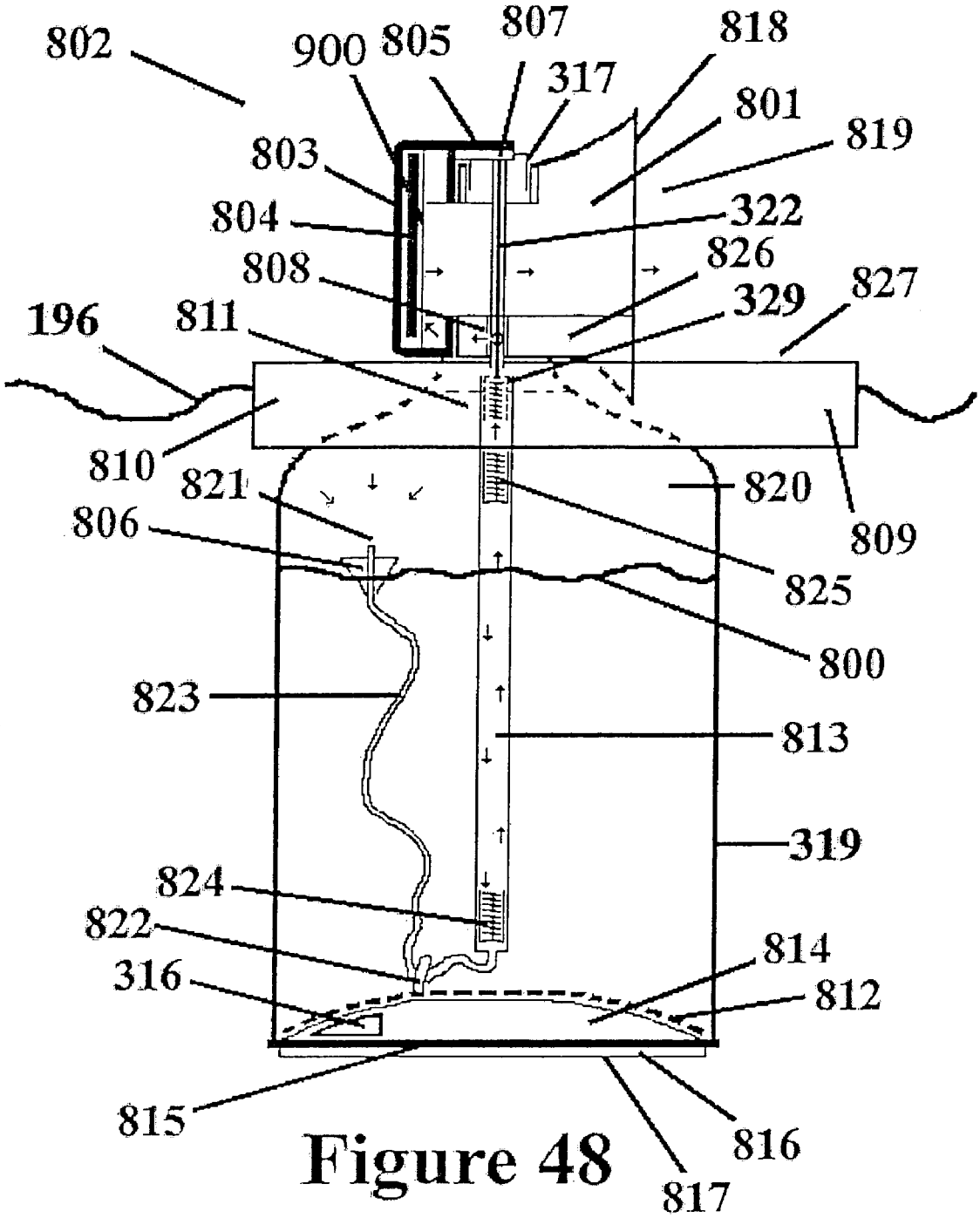

FIG. 48 is a lateral view illustrating a manually activated Man Over Board signaling device. It illustrates a composite of ballast orienting means sufficient for the aerosol can that is buoyant when full. FIG. 1 also illustrates a composite of complementary buoyant means that provide both net positive buoyancy as well as assist in orienting the air horn into an out of the water position. A replacement rear cap provides posterior ballast in addition to holding the manual valve in the on position. A self-orienting float places the draw vent in the gaseous phase within the aerosol can so it can be thrown without spewing freezing liquefied gas.

Figure 49:
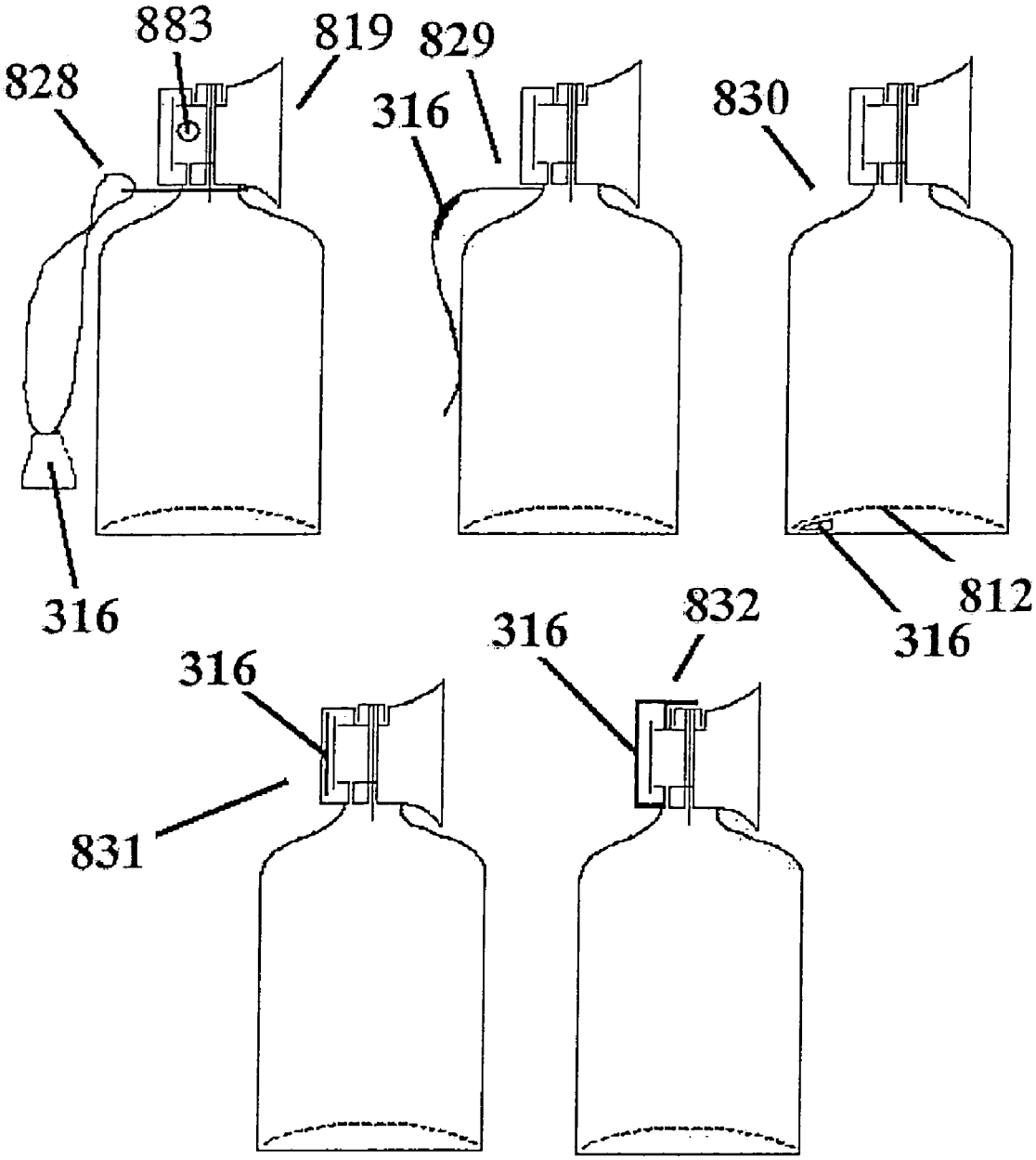

FIG. 49 is a lateral view that illustrates a range of ballasting means that orients the buoyant cylinder and attached air horn into the required out of the water position. A very small amount of ballast on a swing arm is sufficient to provide reliable out of water positioning. A small mount of ballast is leveraged when attached to the air horn belt clip. Posterior ballast is ideal for creating a vertical position when the cylinder is full while inclusion of a small amount of ballast within the air horn rear cap or within the rear cap provides a very clean profile for a self orienting MOB Signaling device.

Figure 50:
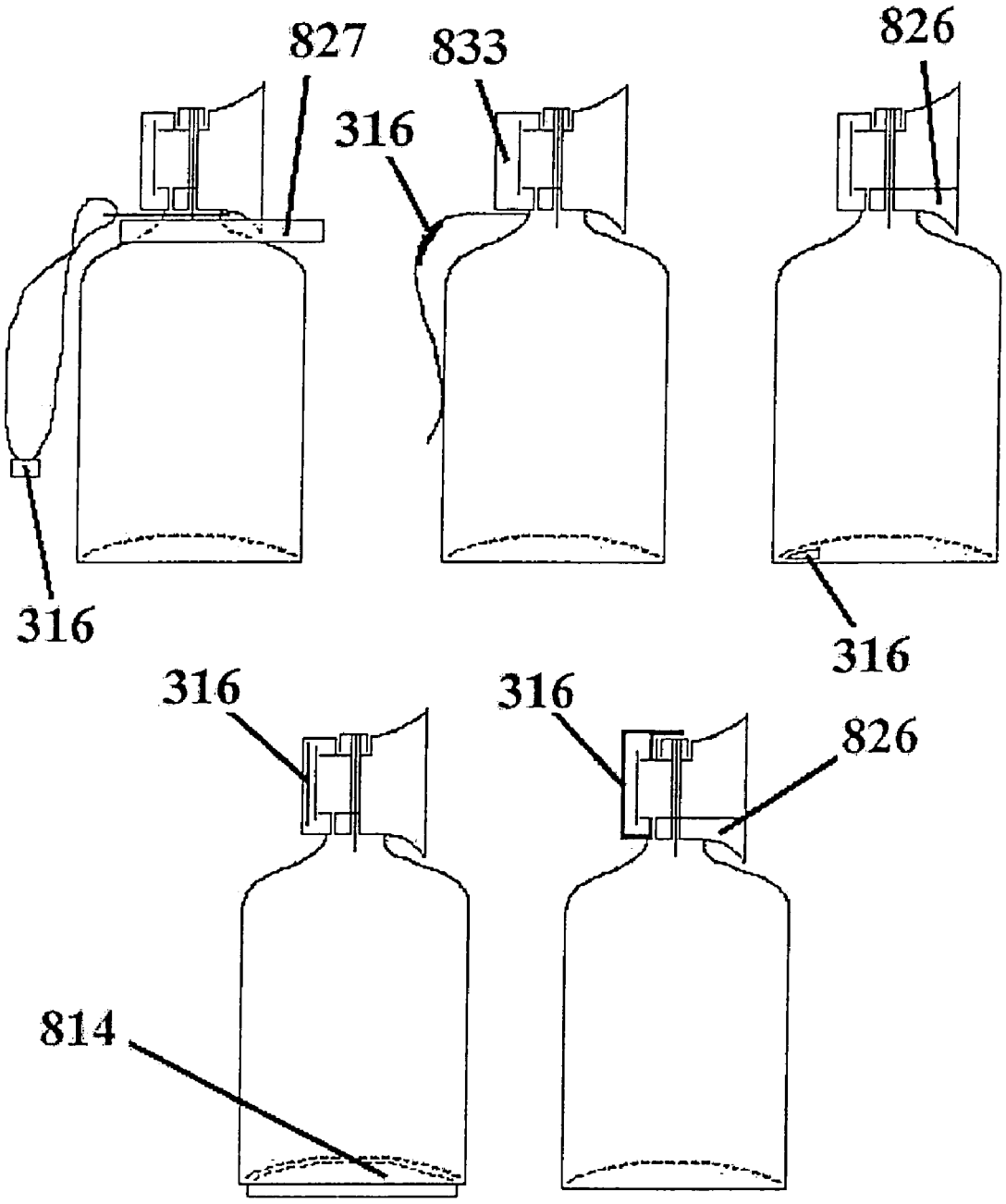

FIG. 50 is a lateral view illustrating the concurrent use of buoyancy to provide net positive buoyancy to those cylinders that are negative when full as well as enhance a split ballast and buoyant moment to assure the air horn faces out of the water. External foam collar is a simple fix while an injection mold can increase the displacement of the rear cap or the anterior horn. A closed cell foam base also provides a sure grip surface that will not rust stain a fiberglass boat. Ideally the rear cap can provide the ballast and the means to hold the valve in the on position while a loculated anterior chamber complements the ballast's force in orienting the horn while assuring the full horn does not sink.

Figure 51:
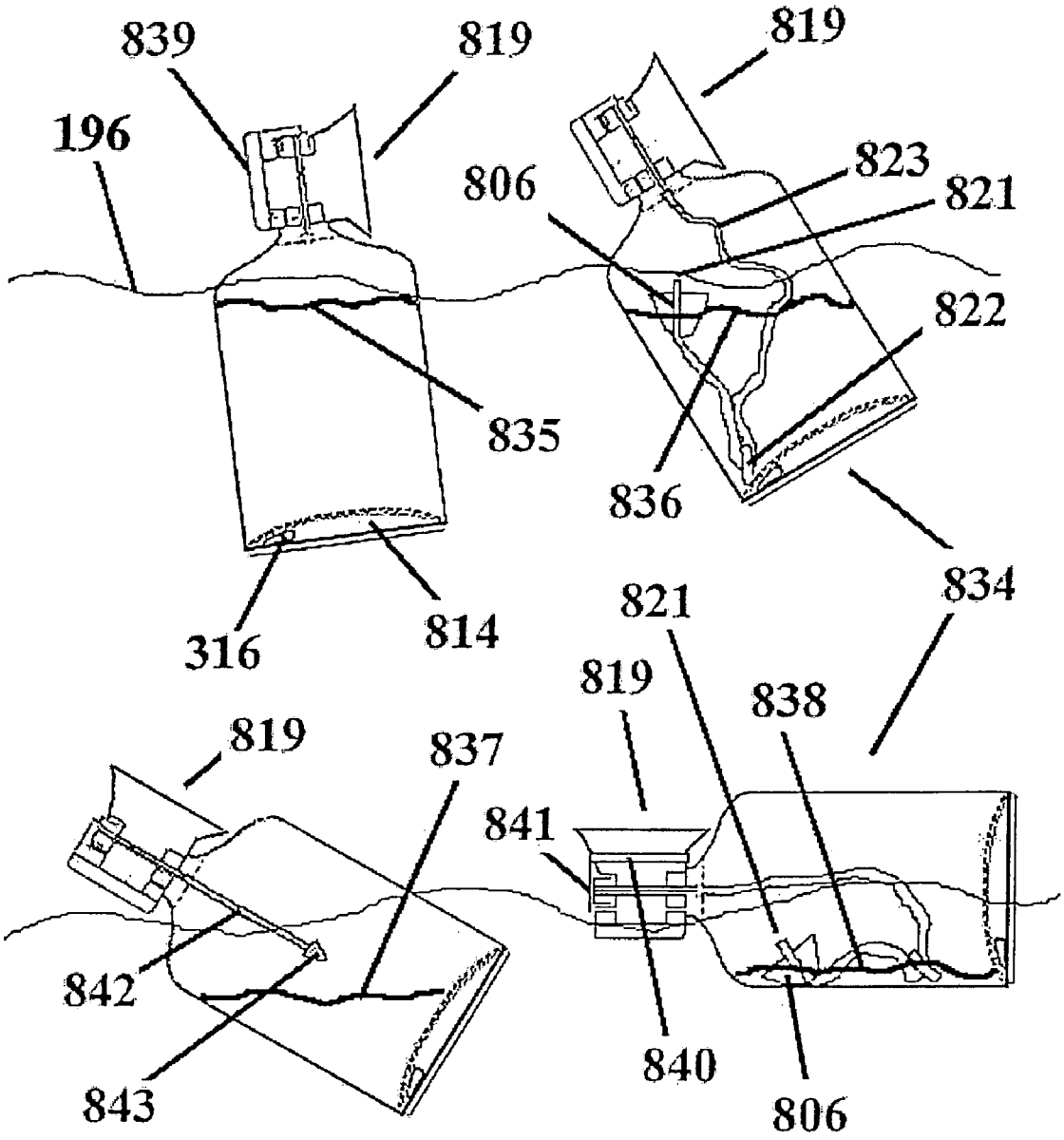

FIG. 51 is a lateral view illustrating the impact of the loss of ballast that occurs as the aerosol cans' liquefied gas is convert to gas then passed through the horn. As the ballast is lost the cylinder becomes increasingly buoyant and rises from a vertical position into a horizontal position. As the surface of the liquefied gas changes position the floating drawtube changes to assure that only gas is passed by the horn regardless of cylinders position.

Figure 52:
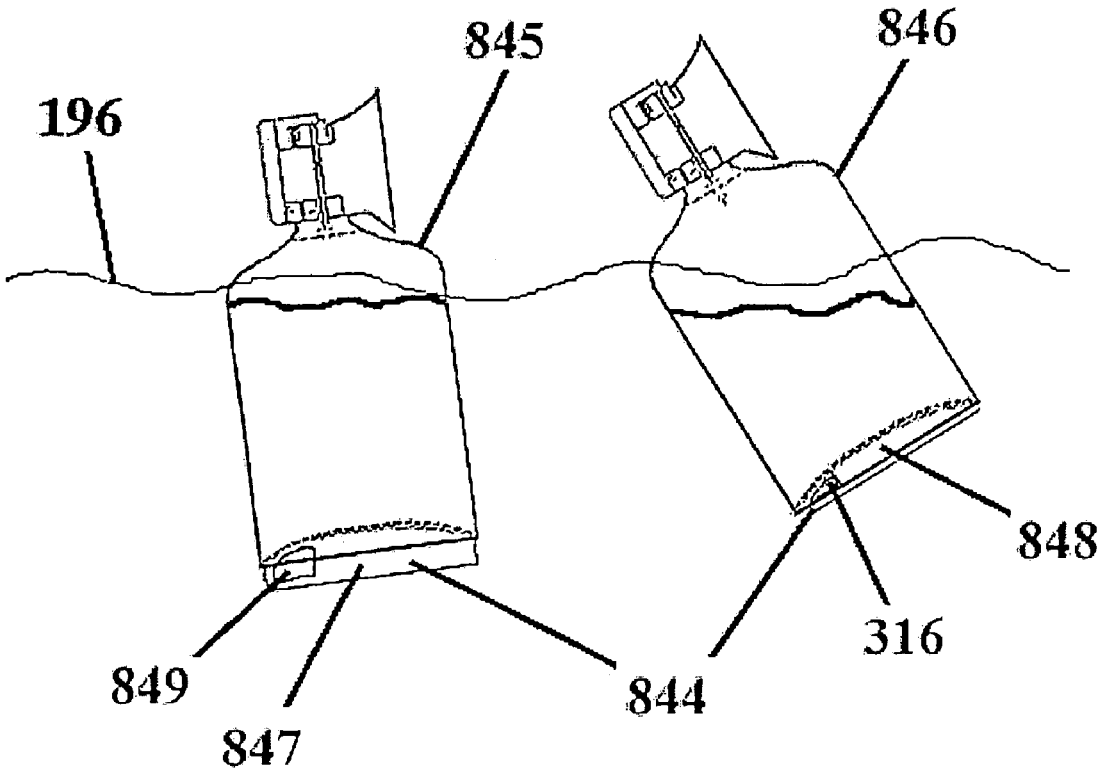

FIG. 52 is a lateral view illustrating a side by side comparison of the cylinder that is negative when full versus the air horn that is buoyant when full. The buoyant moment is sized to assure net positive buoyancy and sufficient ballast is embedded to assure the exit orifice of the air horn faces out of the water.

Figure 53:
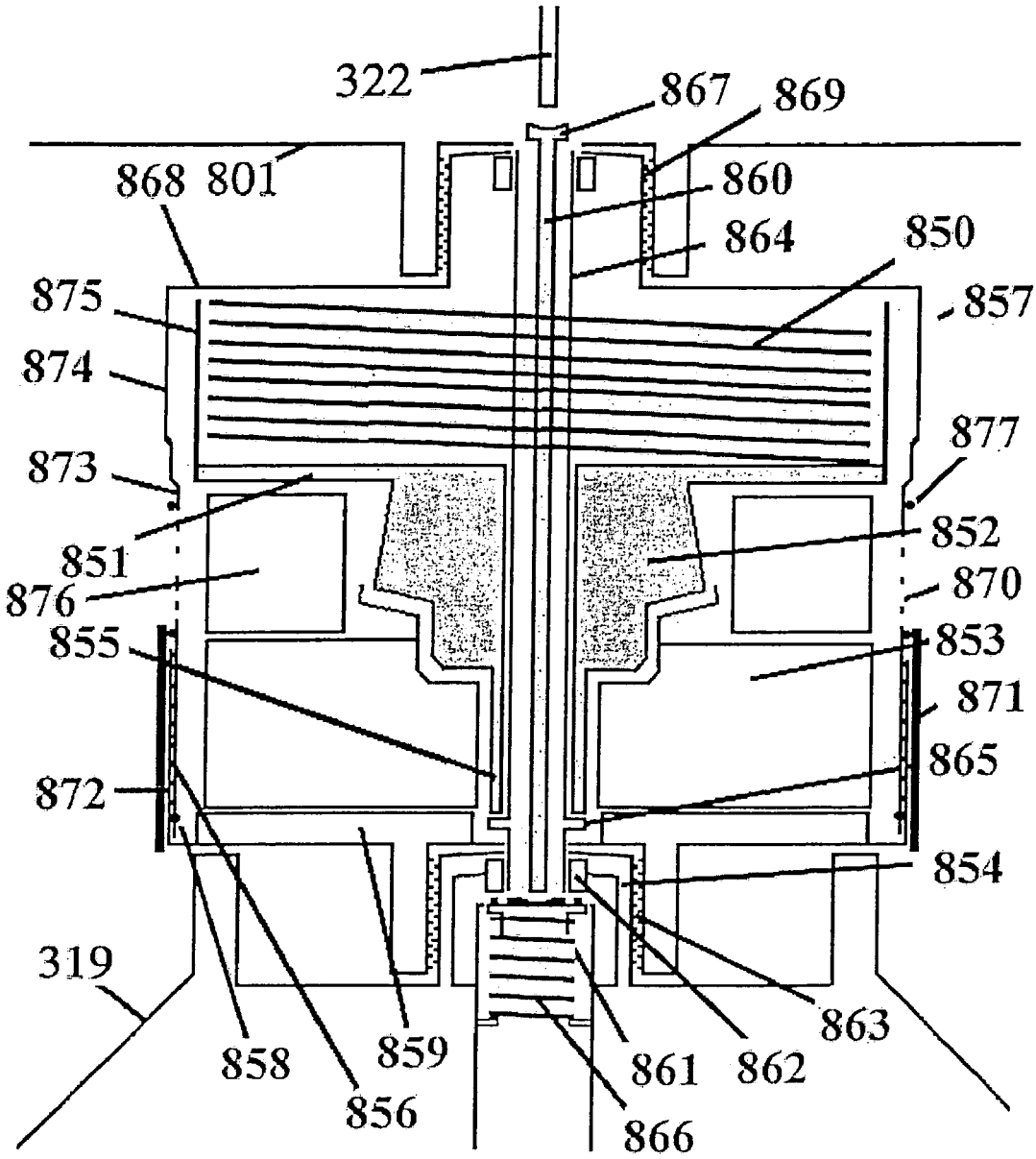

FIG. 53 is a lateral view of an insertable water activating device that allows concurrent manual use of the air horn or if attached to the PFD of a sailor before the are struck unconscious by the boom will automatically activate the air horn to alert crew to the sudden onset of a life endangering emergency and continue to mark the spot of the MOB as the vessel makes ready to come about. It can be added to existing air horns. A slide covers the fenestrations when the jacket is not in use extending the working life of the water activated bobbin by prevent humidity from the hanging locker from prematurely deteriorating the bobbin.

Figure 54:
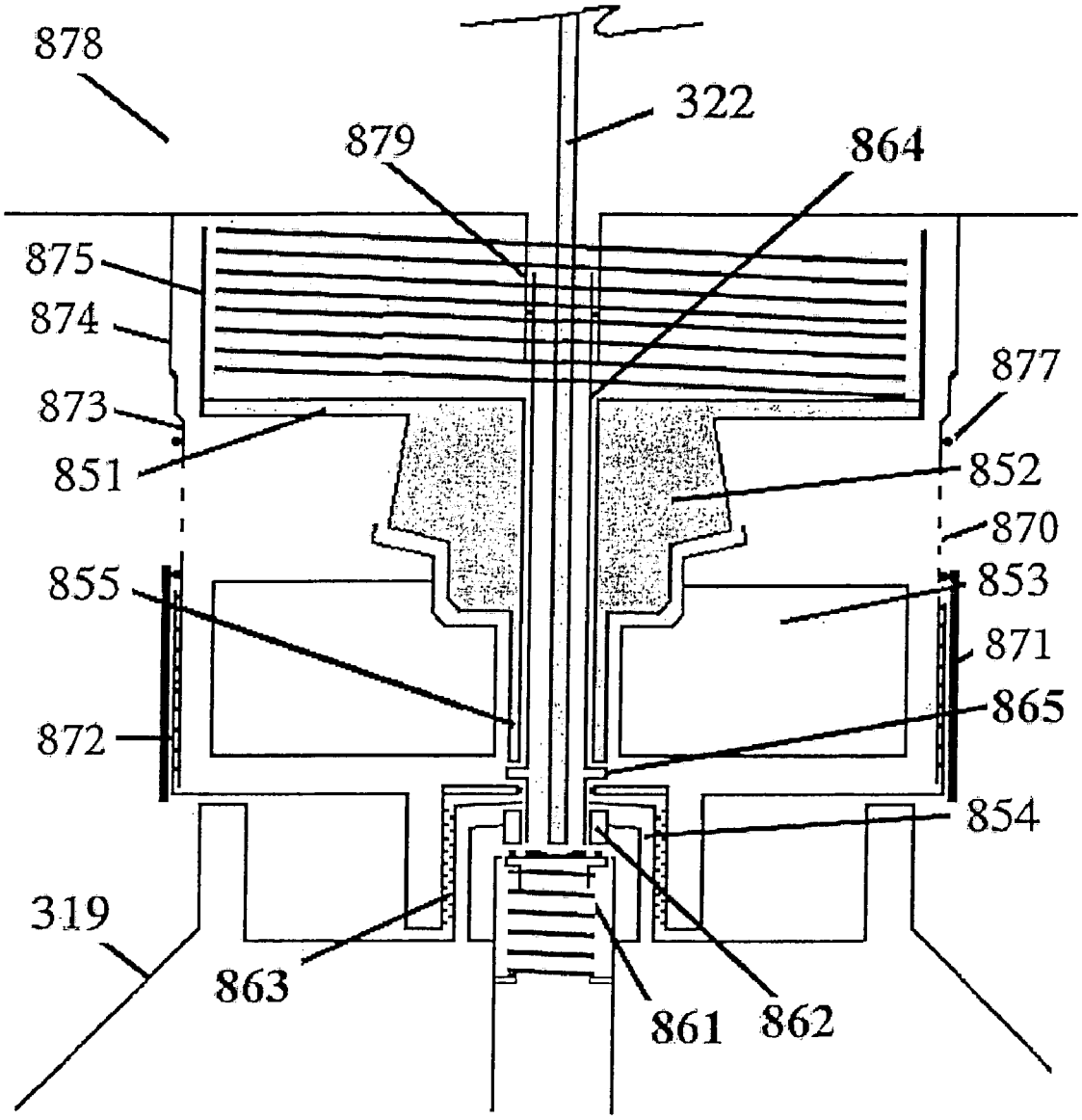

FIG. 54 is a lateral view of a water activating component built into the body of the air horn reducing the size and cost of the MOB Signaling device.

Figure 55:
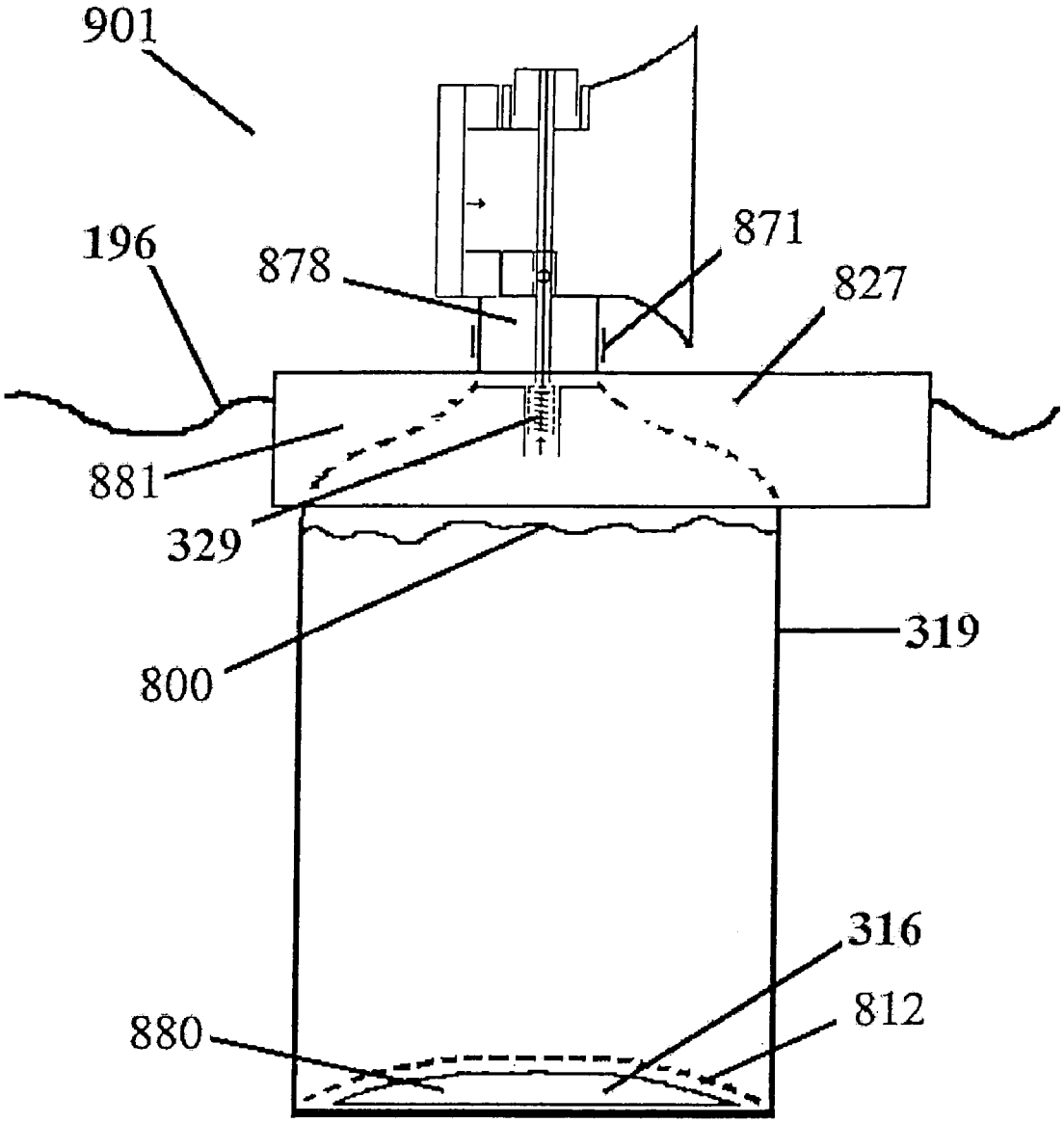

FIG. 55 is a lateral view illustrating a water activated MOB Signal device. Due to the fact that it is thrown in the off position it will not spew freezing liquefied gas. Upon landing on the water its enhanced separation of the ballast and buoyant moments it orients the air horn before the water activated mechanism opens the aerosol can valve so that the draw tube is not submerged in the liquefied contents.

Figure 56:
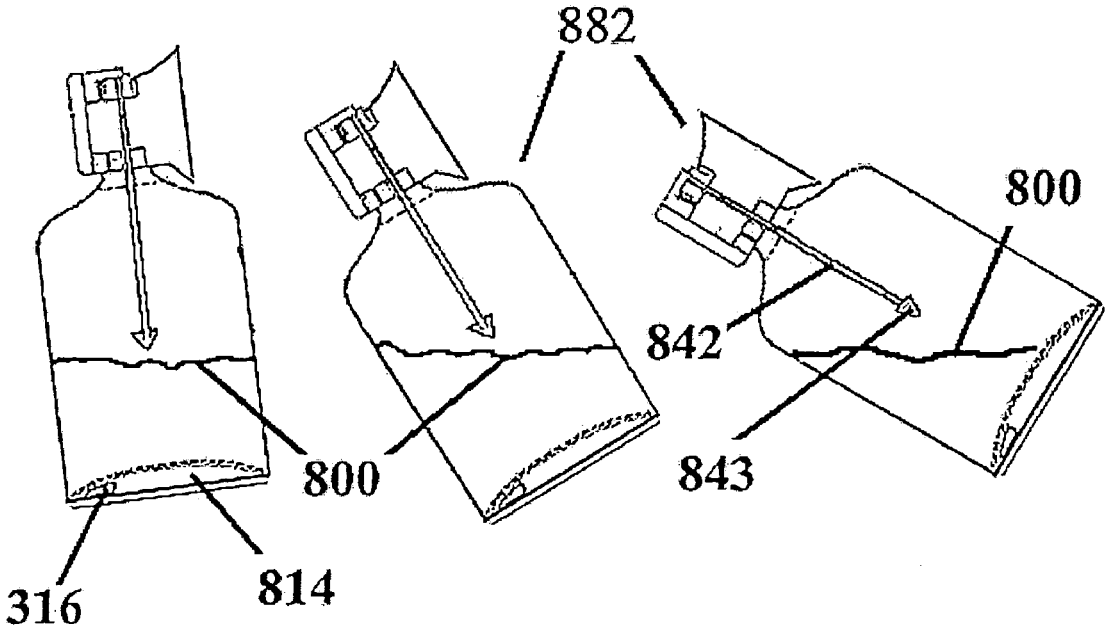
Figure 56:
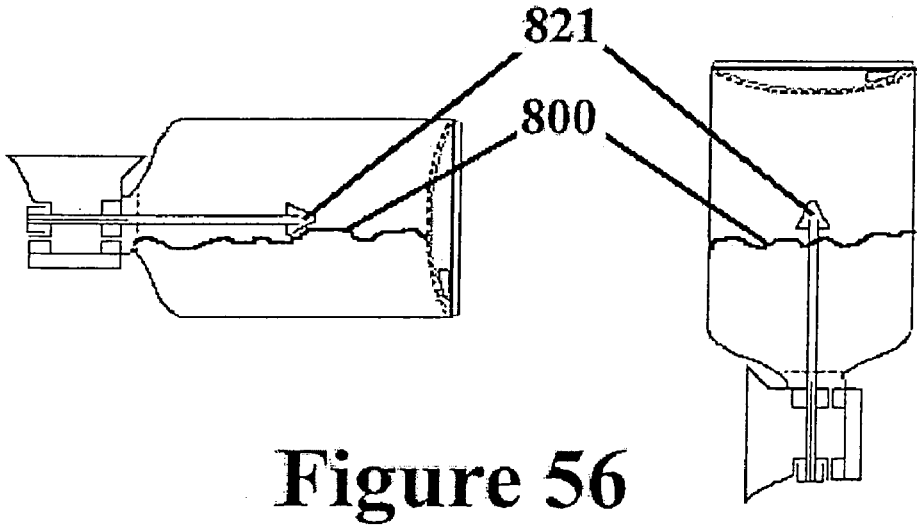

FIG. 56 is a lateral view illustrating the flight of a MOB Signaling device. As the air horn is hurled it spins end for end. Use of a drawtube that is half-length when used with a half filled aerosol canister reduces aspiration of the liquefied contents. Covering the drawtube with a vented cap further prevents inadvertent spraying of sloshed liquefied gas on the thrower or victim.

Figure 57:
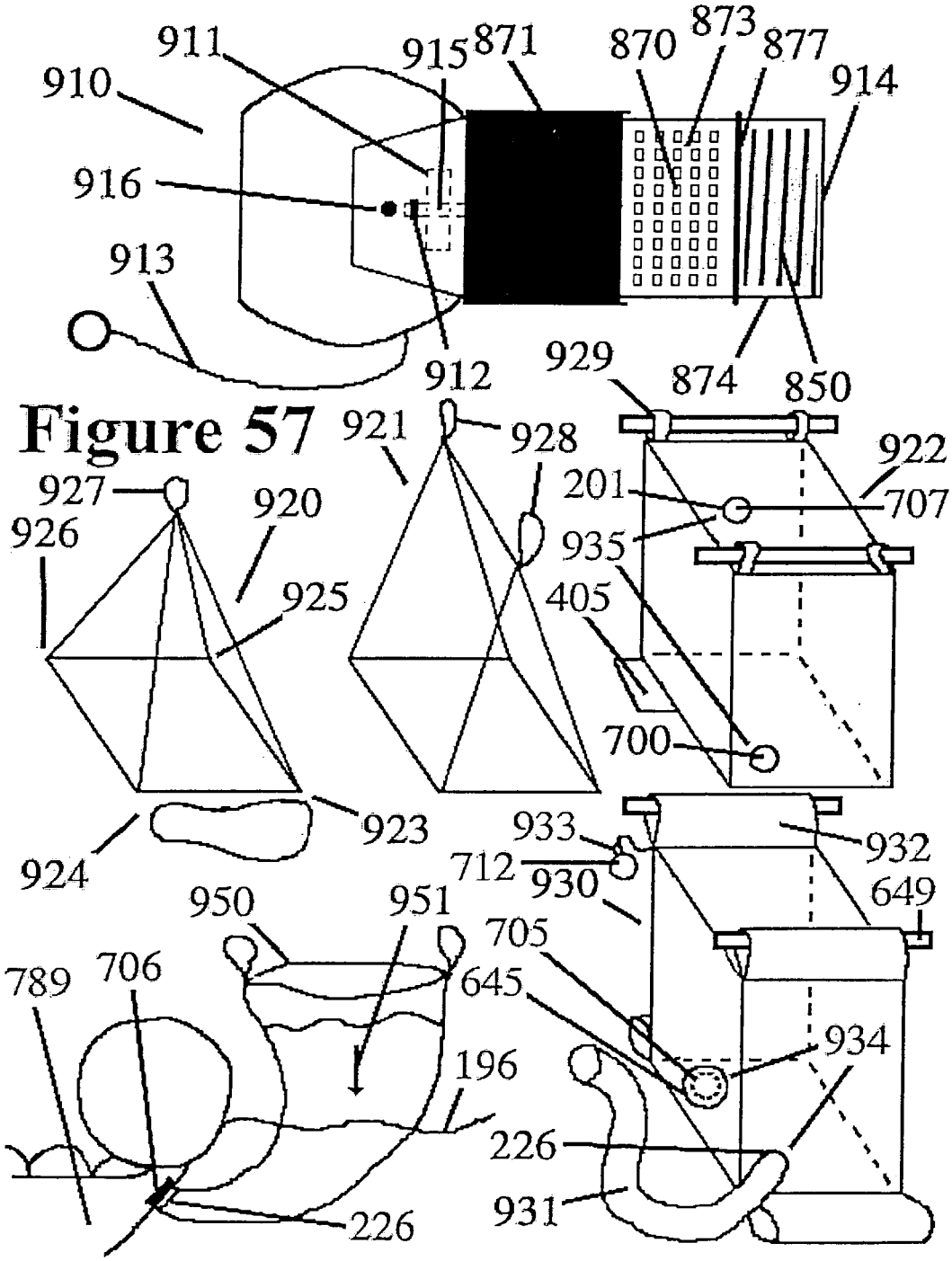

FIG. 57 is a mixed view illustrating an inflator that rapidly converts back and forth between automatic, manual or storage modes of operation with clear indicators as to status. Also illustrated is an eight-point vacuum, siphon and hydraulic pump, which can be used to quickly fill a raft or chamber with air or water and then also pump the water out from within the raft. A rigid arm hydrostatic bladder allows high pressure topping off. A gravity feed drogue pump can also be used to fill the sea ballast chamber.

DESCRIPTION OF THE PREFERRED EMBODIMENTS

FIG. 1 demonstrates a simple orally inflated bladder 1 that can be inflated by valve 19 in anticipation of after water entry. Bladder 1 is attached by reversible mounting means 3 along the edge of flange 17 to an inherently buoyant PFD 4. Bladder 1 can be converted from its participation in a highly effective albeit uncomfortable Hybrid PFD ("HPFD") into an inflatable Garment integrated PFD. Oral bladder 1 is supplied with an integrated CO2 manifold 6 allowing for latter attachment of the compressed gas inflator 10. If the oral bladder 1 is upgraded to include a compressed gas inflator, the previously installed CO2 manifold 6 with integrated oscillator 8, will sound an audible alarm when air is passed through the CO2 manifold during inflation regardless of the type or manufacture of the inflator that is attached.

Use of bladder fabric, which is laminated on only one side, requires creating an attachment flange 2. A reduction weld takes a tuck out of the backside of the bladder by welding the bladder to it self-creating an external flange 2. Onto this external flange can be sewn any manner of attachment means such as zippers, fabric hook and loop, straps, snaps allowing for permanent or reversible mechanical attachment of bladder 1 to foam PFD or garment.

Alternatively bladder 1 can reversibly attached via chest straps 12 to foam PFD 4 or garment 5. The force of the buoyant moment is transferred to the PFD via the chest strap retainer 13. Since the PFD user is directed to snuggly affix the PFD to the wearers body, a bladder edge is attached via a short leash 14 which allows bladder 1 to shorten as it inflates with out compressing the wearer's respiratory system. Bladder 1 and foam PFD 4 are attached by an adjustable quick release buckle 15 which accommodates a variation in size by producing or consuming excess chest strap 16. When bladder 1 is transferred to an alternate garment the chest strap 12 can be passed through garment integrated guide tube 18. Buckle 15 is secured after the bladder is inflated in order to preserve the comfort and convenience of the dress or recreational garment 5.

The convertible bladder 20 shown in the lower drawing of FIG. 1 is supplied with compressed gas inflator 10 already attached to a CO2 manifold 6 which has an integrated oscillator, which sounds an alarm when air is passing through during inflation. The manifold may also integrate a soundboard 7 to amplify the volume of the alarm. The vibratory element 8 can be an edge, reed, diaphragm or similar structure. The low volume bladder 1 can only be connected to a particular size or smaller compressed gas source because of the cylinder specific sleeve 9. This sleeve 9 can be part of the structure of the manifold 10, or welded concurrently during attachment of the manifold 6 to the fabric or bolted on during mechanical attachment of the inflator 10 to the manifold 6. The inflator 10 incorporate an oscillator element harmonically discordant with the vibrating element 8 built into the manifold 6. Complementing the inflator 10 and manifold 6 based oscillators is a pneumatic and or hydrostatic sensor/s as well as a manually activated remote signaling device 11 located above the water line. The remote signaling device 11 includes one or more signaling modalities including auditory, visual or radio frequency.

The lower drawing in FIG. 1 shows the garment 5 with an undersized valise 22 used to stow the deflated bladder 20 in a compacted manner. During inflation bladder 20 expands blowing open the cover closure 23. The collar portion of the cover is splayed open 21. The undersized valise 22 is critical to ensure the bladder is fully released upon inflation, allowing the bladder to rise up, encircle and self close around the neck under the torque generated by the bladder integrated self closing angle 25. The bladder integrated crico thyroid notch 24 prevents the self-closing anterior portion of the bladders 1 or 20 from impinging upon and thereby compromising the unconscious victim's airway. The self-closing bladders 1 and 20 support the unconscious victim's neck and head.

Figure 2:
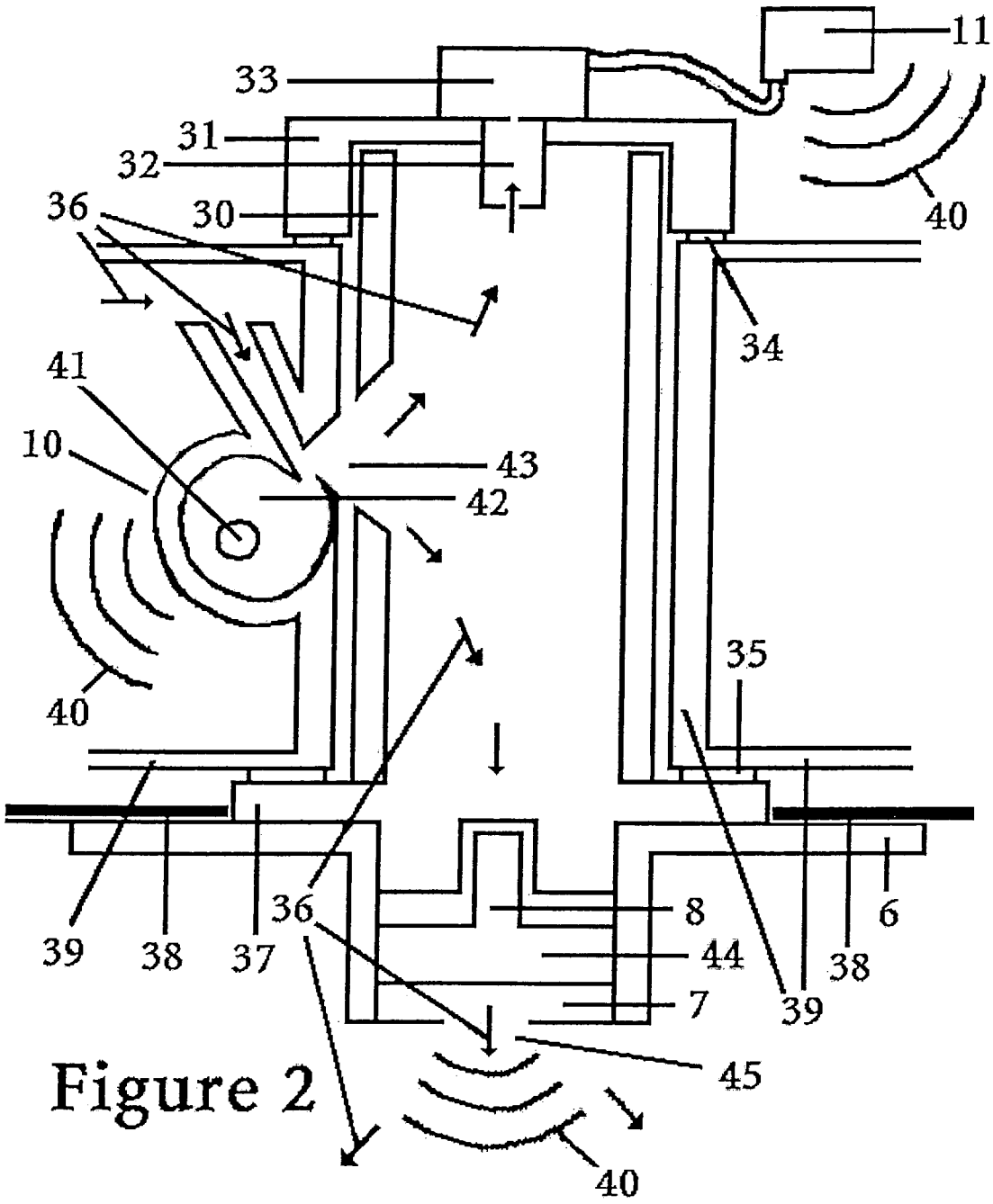

FIG. 2 is a lateral view of three PFD integrated vibratory elements. CO2 manifold 30 receives a threaded cap 31 that bolts the inflator 39 to the CO2 manifold 30. Through cap 30 pressurized air 36 flows into pressure sensor 32 which activates pressure switch 33 supplying power to the signaling means 11. Upper gasket 34 and lower gasket 35 seal the inflator 39 to the manifold stem 30. The manifold stem flange 37 is fused to weldable flange 6 that is welded to laminated fabric 38 to contain the pressurized air 45 within the bladders 1 and 20 upon the pressurized gases release from the cylinder. Auditory signal 40 arises from the passage of air from a zone of high pressure 42 to a zone of low pressure 43 across a vibratory element. The inflator integrated oscillator 10 is the first vibrating element. An auxiliary pea 41 can alter the quality of the signal 40 produced by inflator integrated oscillator 10. The pressurized gas then compresses the pressure switch setting off an extended remote auditory, visual and RF signal 11. Finally high pressure air passes over vibratory element 8 mounted on support 44 which crosses the CO2 manifold exit creating the CO2 manifold oscillator 7. The gas then exits to become pressure within bladder 45. The pitches of the auditory signal 40 created by 10, 11 and 8 can be set to create a discordant note of alarm.

FIG. 3 shows a convertible manibulo-thoracic bladder 50 centrally located on a pullover garment 51. Due to the use of bladder 50 on a midline crossing pull over garment, bladder attachment means 63 can be utilized. Note that when bladder 50 is used with the midline opening PFD 4, attachment means 63 can not be utilized. The chest strap runs through a garment integrated restraint means 55 and is secured through a bladder integrated chest strap attachment means 52. The chest strap has two levels of tensioning, adjustable quick release means 54 and bladder tensioning means 53 which allows a comfortable level of tension before inflation of bladder 50. Upon inflation of bladder 50 the bladder shrinks pulling on lateral edge attachment 53 between bladder 50 and strap 12 to reduce the diameter of the chest strap to keep bladder 50 in position. As the bladder unfolds and inflates the mandibular shelf 58 holds up the chin and the lateral cervical brackets 59 prevent the flaccid neck from rocking side to side.

The midline garment pocket 56 forms the front half of the cover which is secured to the back half of the cover 57 by blow a part complementary closure halves 60 and 61. The status of the automatic inflator wafer and cylinder seal can be visually monitored through window 62.

Figure 4:
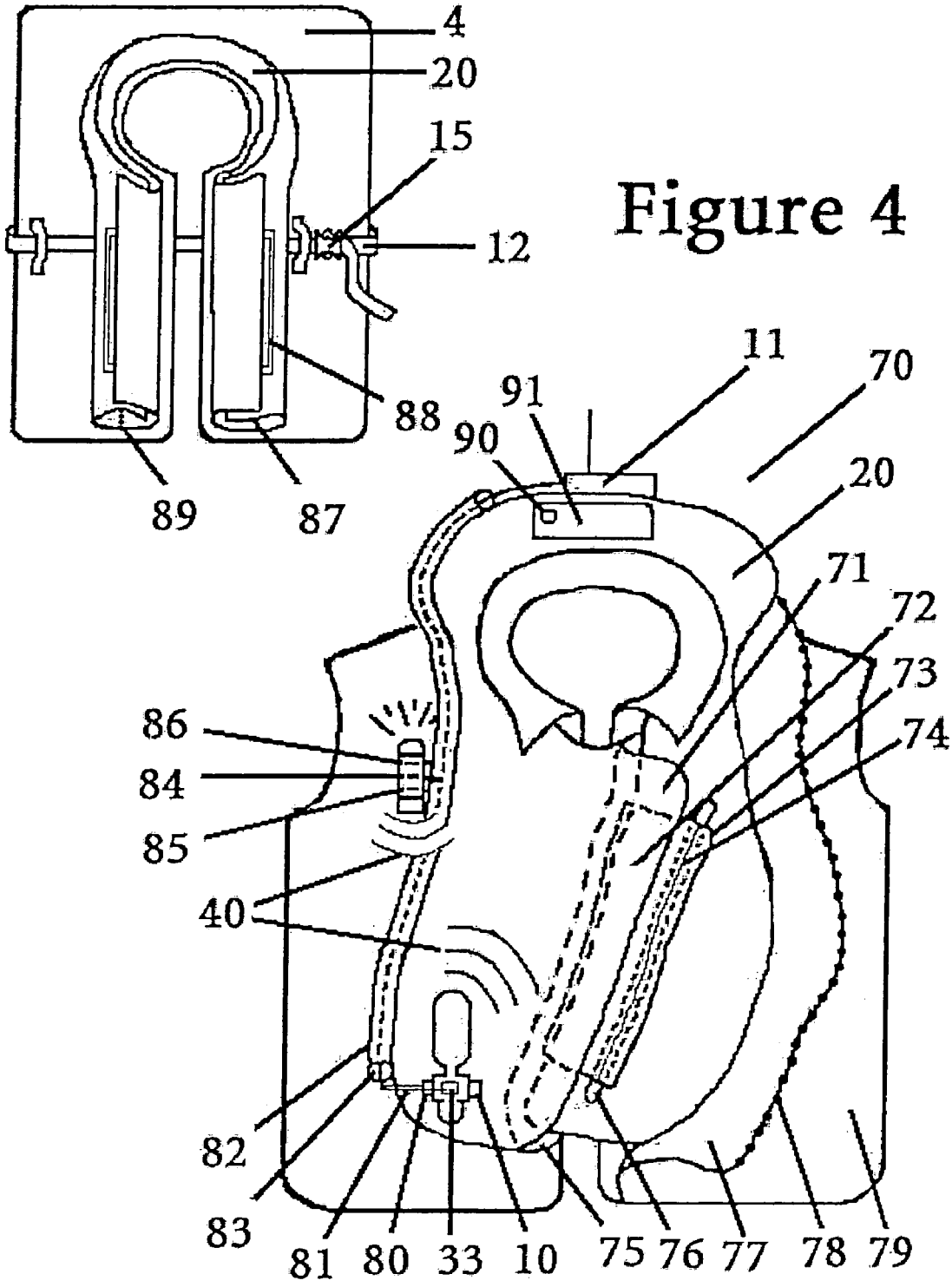

FIG. 4 is a high performance combination of two SOLAS class PFDs. Individually they are each high performing PFDs. The inherently buoyant PFD 4 supplies a level of displacement and capacity for turning that exceeds Type I OffShore Life jackets yet every model tested to date fails to provide corrective turning action for the author. While the dual chamber high displacement inflatable PFD 70 does turn the author it is susceptible to puncture or failure of inflation however remote. The combination as depicted in the upper drawing would the author's life jacket of choice in the event of a disaster at sea. For routine use the traditional midline opening garment 79 with garment integrated inflatable 70 is much more likely to be routinely worn to protect against the elements and as a safety net against the unlikely man over board situation. The bladder 20 relies upon an aggressive self-locking mechanism, a V baffle alligator lock 71 covered in fabric hook 75. The jaws partial open on inflation to envelop the 3-demensional cylinder 72 covered with complementary fabric loop. The cylinder 72 is formed by weld 76. Weld 76 is enlarged to create a dead space for sewing on loop 74. The loop can be securely sewn to both layers of the PFD. Together the jaws 71 and cylinder 73 form a 3-D fabric lock and key which is engaged and compressed by the self closing of the bladder during inflation. The bladder 70 expands upon inflation opening reversible pneumatically operated cover closure means 78 splaying open cover 77.

In FIG. 4 is an alternative MOB signaling system that can be actuated only by exposure to water pressure as occurs during submersion avoiding in advertent activation by rain, coffee or humidity. The hydrostatic pressure switch can be mounted upon the inflator 80. In this position the hydro static pressure switch can be placed in parallel 81 with the switch wire from the pneumatic pressure switch. A second weld 82 paralleling the bladder perimeter weld creates a conduit 83 for housing the parallel switch wires from both sensors. A secure switch 84 allows the victim to manually activate the man over board signal system. Separate auditory switch 85 and visual switch 86 allows inappropriate signals to be turned off conserving battery power. In the upper drawing the bladder 20 has been transferred from the garment to the inherently buoyant PFD 4 converting it to a Hybrid PFD with its improved performance. The deflated PFD bladder 87 is secured by an alternative blow a part closure means 88. Both the garment and foam PFD are midline opening and rely upon a locking reversible mounting means 89 to secure the bladder 20 to the garment 79 or foam PFD 4.

Figure 5:
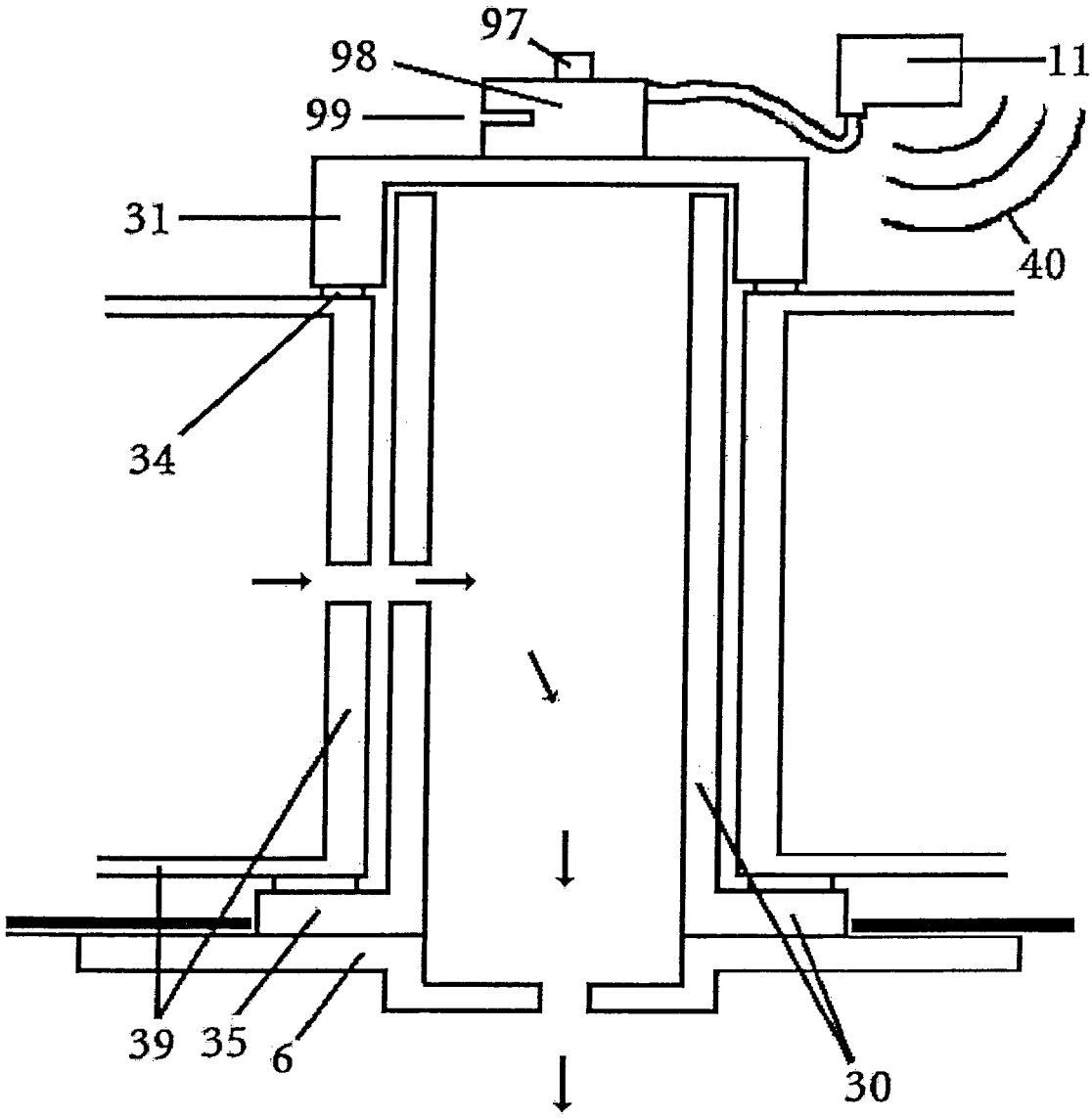

The water pressure activated man overboard signaling system in FIG. 5 is mounted onto the manifold nut 31 that secures the inflator 39 to the CO2 manifold 30. The hydrostatic pressure sensor 99 activates the hydrostatic pressure switch 97. The sensitivity of the hydrostatic pressure switch can be adjusted at 98 as might be advantageous in some active water sports. The exterior mounted sensor does not require intrusion into the pressurized environment of the inflator or bladder, which inevitably is associated with some increased risk of loss of buoyancy. The nut mounted hydrostatic pressure switch can be retrofitted to all existing inflatable PFDs conferring the utility of including a man over board alarm to notify the crew of the onset of an in water emergency. Such an exterior alarm can be easily maintained or replaced as indicated. The remote location of the signaling means assures that the oscillator will be outside the water environment conferring improved transmission of the auditory signal 40.

Figure 6:
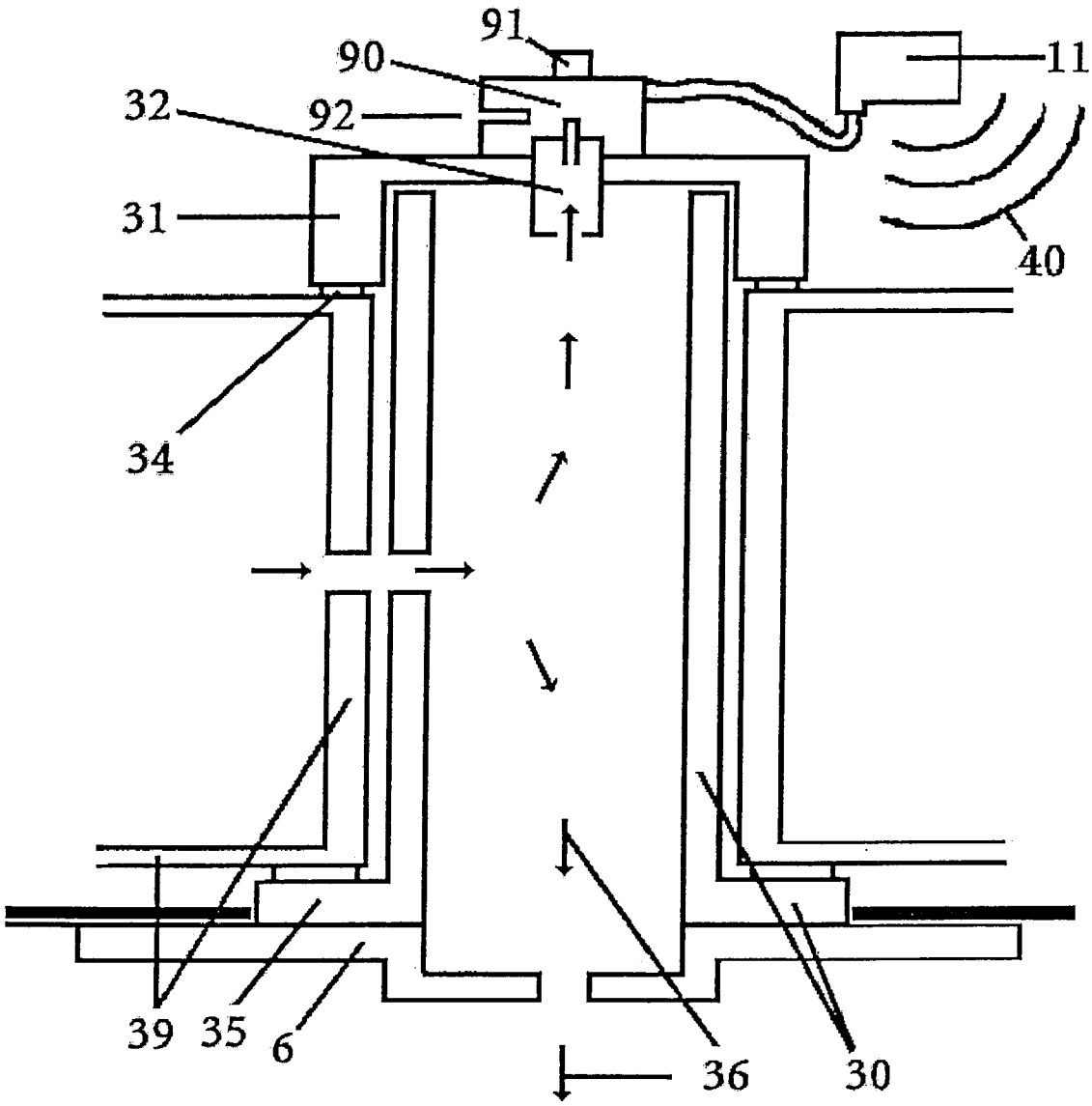

The same pressure switch can have combined pneumatic 32 and hydrostatic input 92 as configured in FIG. 6. In case the compressed gas means fails the man overboard signal system is still operable and will be needed even more than ever since the victim is over board without an operable life jacket.

Figure 7:
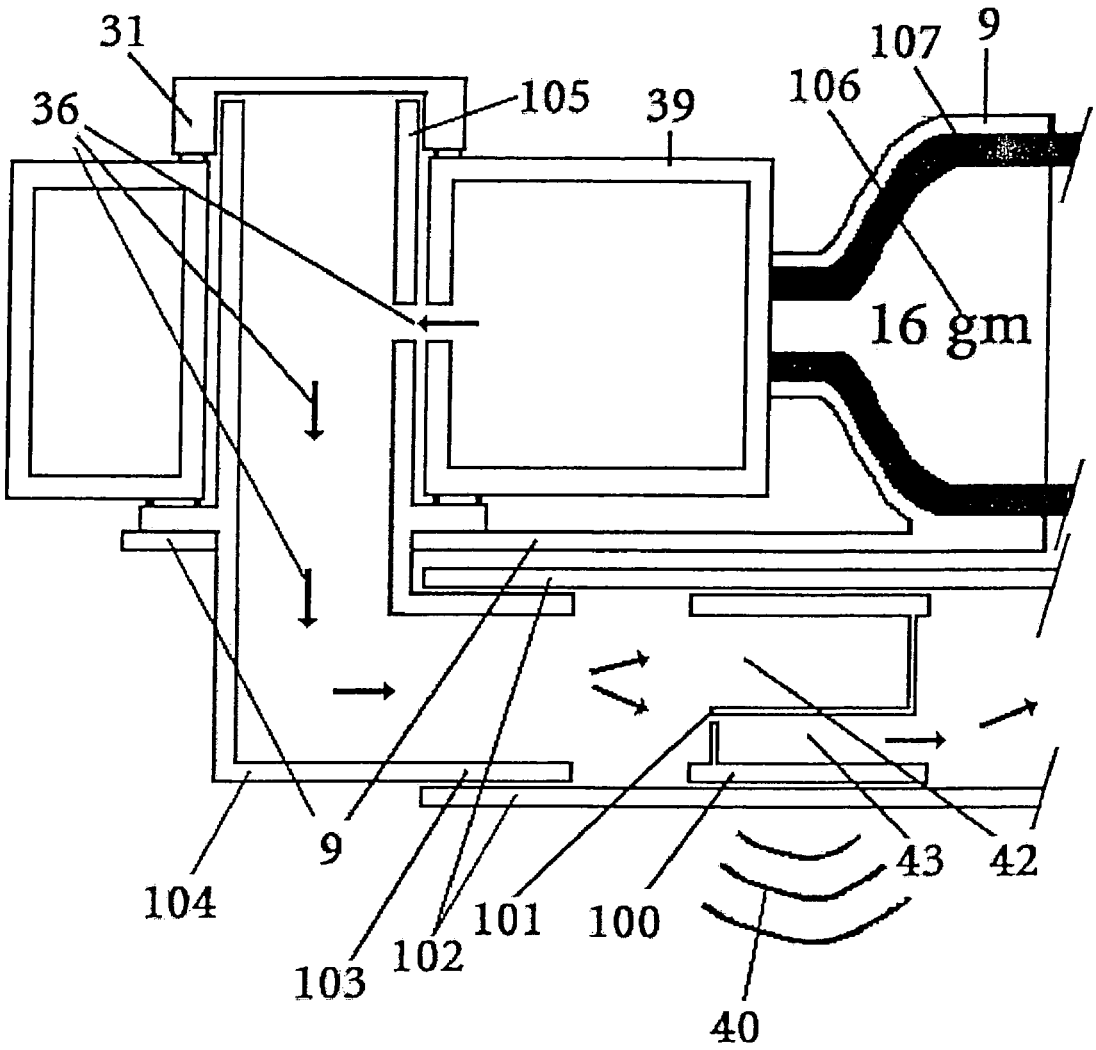

Remote location of the rigid bulky inflator 10 and compressed gas cylinder 107 requires a thread to hose adapter 104 as seen in FIG. 7. The thread to barb adapter 104 is constructed to allow a threaded nut 31 to secure the inflator 39 to the adapter. The other end is a right angle hose coupling 103. In the hose 102 leading from the inflator to the bladder is an inline oscillator 100 with a vibrating reed element 101, oscillating because of the pressure differential across the reed. The compressed gas cylinder sizing restricter sleeve 9 is embossed 106 with the compatible cylinder size so that only an acceptably sized cylinder or smaller can be attached to inflator 39 and through adapter 104 to the tubing leading to the remote bladder 20.

Figure 8:
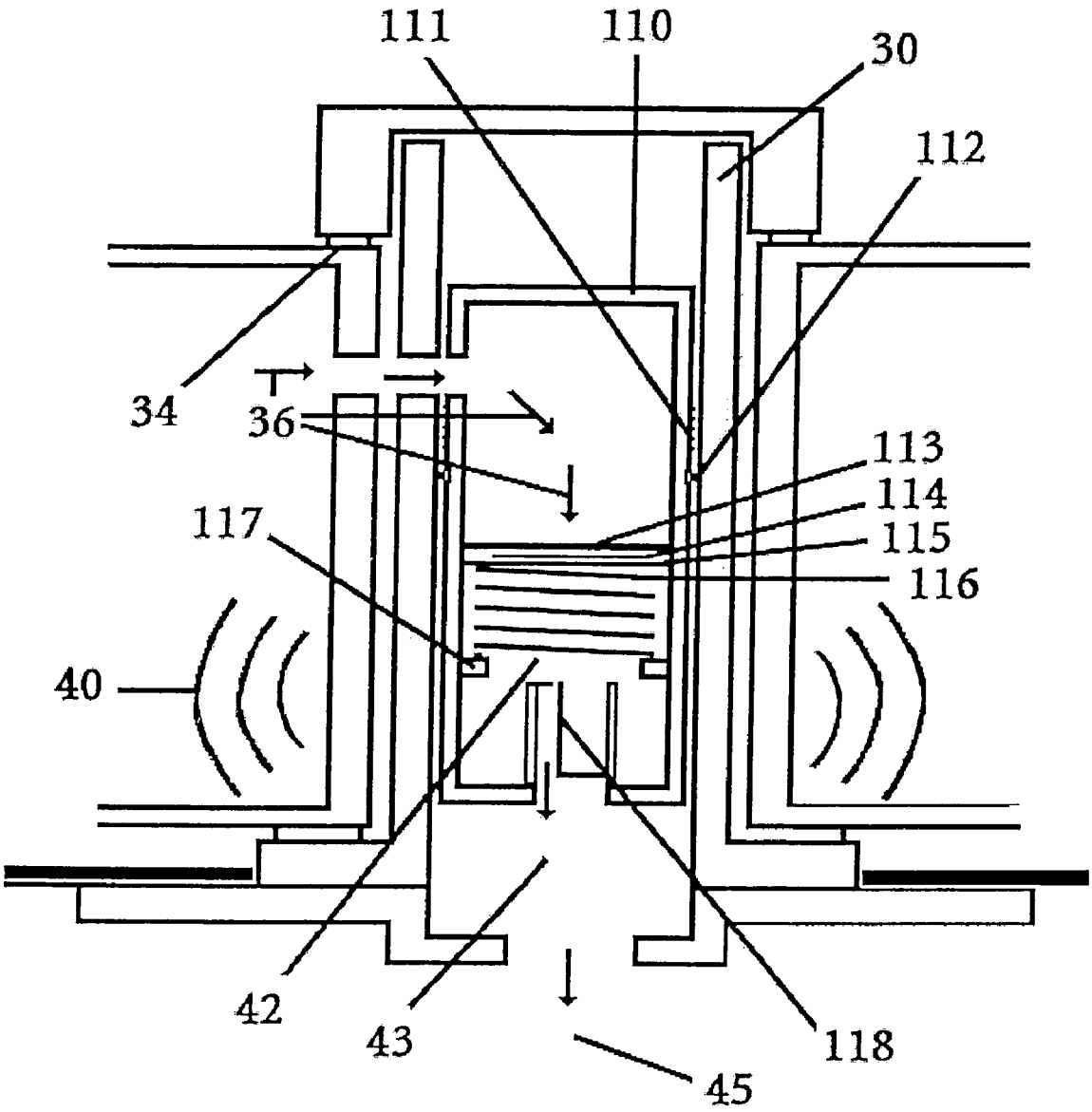
FIG. 8 is a lateral view illustrating a check valve with integrated oscillatory element. The check valve mounts through traditional threaded means within the CO2 manifold allowing retrofit of fielded bladders with a water entry alarm.

A MOB signaling system that can be retrofitted and does not depend upon a penetration of the wall of the inflator/bladder system is a manifold check valve oscillator 110 as drawn in FIG. 8. Current CO2 manifold check valve threads 111 are relied upon, a seal is achieved by an O-ring 112 between the check valvel 10 and manifold stem 30. The check valve seal means 114 is mounted on 115, which is pushed against seat 113 by spring 116. Spring 116 is held in place by spring mount 117. Integrated into the replaceable manifold check valve is an integrated vibratory means 118.

Figure 9:
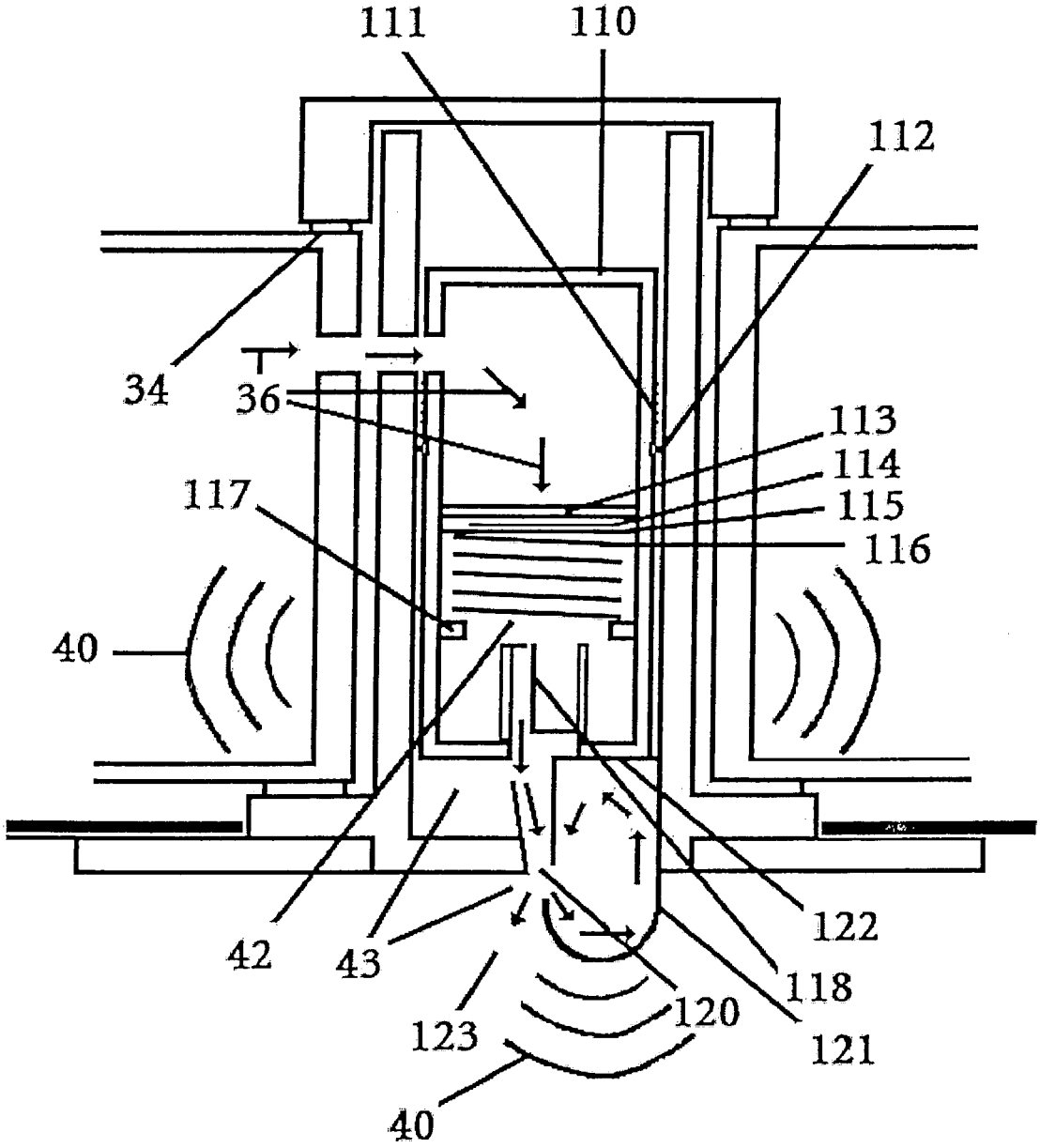
FIG. 9 is a lateral view illustrating a combined manifold check valve oscillator and manifold oscillator with a restrictive orifice for prolonged signal production as is acceptable with the high volume compressed gas cylinders. The use of a sounding board and contrasting tones produces a strident alarm.

An integrated restricter orifice/valve 120 reduces flow rate to rafts or secondary bladders 123 in FIG. 9. Inclusion of an oscillator within the CO2 manifold 121 can also serve as a stop 122 for the check valve and oscillator 110. After air passes through the check valve oscillator 118 the air flow is it constricted and accelerated through the restricter orifice 120 where the high pressure-low pressure differential across oscillator 121 produces a shrill auditory signal 40. If check valve oscillator 118 is tuned to conflict with manifold oscillator 121 and cacophonous alarm is produced.

FIG. 10 illustrates how a restricter valve 120 can be integrated into the threaded 111-barbed 103 adapter 104. The middle left drawing illustrate a restricter valve combined with a barbed 103-barbed 103 coupler 131. Vibratory elements 101 can be included in line as in 130 or within the barbed-barbed coupler fitting as in 131 or barbed-barbed over pressure relief valve 134. The middle right drawing illustrates such a coupler with an integrated over pressure relief valve 134 in which the over pressure spring 133 compresses against gasket seal 135 until air pressure 136 exceeds the strength of in line over pressure relief spring 133 then air 137 is allowed to pass. The lower drawing is a composite fitting 140 in FIG. 10 which combines weldable bladder connector 141 and barbed coupler 103 with bladder protective over pressure relief valve 133 protecting bladder against bleed off of air pressure and maintaining pressurized air to power for the diaphragm oscillator. Composite fitting 140 contains dual oscillatory elements an in line reed 101 and strident diaphragm air horn 148. The air horn 148 balances a mechanical tensioning spring means 143 against the compressed by air across diaphragm 142. The oscillating diaphragm 142 pumps air down the directional horn 144. A very minimal amount of air 145 is passed when the diaphragm is pushed away from the horn 144. Air enters the horn through an orifice 146 in the coupler-connector fitting. A downstream over pressure relief valve 133 maintains the air pressure needed to power the air horn during inflation.

FIG. 11 compares a fixed volume 2-layer 3-dimensional raft plan 770 with a series of variable volume raft plans 771, 772, 773. The single chamber fixed-volume raft 770 must maintain a constant pressure within the primary chamber which is this case includes both the floor and perimeter tube 791. Fixed volume raft plan 770 once welded closed and inflated appears in cross section as raft 774. If pressure is lost in primary tube 791 the fixed volume raft 770 will flex or fold under the weight of the occupant and take on water. When the hull fills with water it reduces or eliminates the internal hull displacement component of the raft's buoyancy and the occupant becomes further immersed and prone to hypothermia.

While an arduous task the torque pump as seen at 379 of FIG. 30 can force water under pressure into a fully pressurized primary chamber 791 of FIG. 11 this is made some what easier if a low psi over pressure valve is part of primary chamber 791 in which case as water is forced in air is vented out through the over pressure valve.

Alternatively some air can first be vented allowing raft 774 of FIG. 11 to soften. Then the same volume of air that has been released can be replaced with water and in a gradual step wise fashion a per cent of the fixed volume of captained air can be replaced with water. There is a minor discrepancy in that air is compressible and water not compressible but at the very low pressures used to shape a fabric life raft the volume difference is negligible. Once the torque pump 397 of FIG. 30 replaces the air removed with water it brings the raft back up to its ideal structural operating pressure.

Fixed volume raft 775 demonstrates the substitution of 15% of its air volume with 15% water volume. Fixed volume raft 776 has converted 30% of its internal volume from air to water.

The plans for variable volume rafts 771, 772 and 773 separate their primary buoyant chamber 791 so that it can maintain the constant pneumatic pressure required for structural integrity of the raft. While the variable volume chamber which is either the single floor 788 of raft 771 the lower floor 789 of raft 772 or the second hull 790 of raft 773 can remain empty or be partially or completely filled with air, fresh or salt water or a combination of both.

The simplest plan for a variable volume raft 771 is still constructed from two layers but the floor chamber 788 is structurally and functionally distinct from the primary buoyant chamber 791. The floor chamber 788 may remain deflated as in raft 777. Alternatively, in raft 778 the floor chamber 788 15% filled with air which buoys the floor up while raft 780 has filled the raft floor chamber 788 15% full of potable rain water for safe keeping or sea water for improved stability which pulls the lower layer down.

In FIG. 11 raft 779 has the floor chamber 788 filled 25% full of air while raft 781 has the floor chamber 788 filled to 25% of its capacity with drinking water or sea ballast. The last example of a two layer variable volume raft 782 has filled the floor chamber 788 to 15% of its capacity with air and in addition has instilled 15% of its rated capacity with drinking water or sea ballast.

A triple layer variable displacement raft plan 772 in FIG. 11 has a middle layer welded to the top or bottom layer creating a dual floor design. The upper floor 788 can insulate the occupant from the lower floor chamber 789 when the lower chamber contains sea ballast for increased stability as shown in raft 784. If the raft is significantly over loaded the lower floor 789 may only contain air as is depicted in raft 783.

If the raft is only mildly over loaded then the lower floor chamber 789 can contain both sea water 610 for ballast and a layer of air to offset the additional load as seen in raft 785. The inclusion of both air and water within the same variable volume chamber provides buoyancy and thermal protection to the occupants in raft 785. A dual floor variable volume raft with a highly segmented upper floor reduces the displacement to match the rated occupancy load. The inclusion of a second variable volume floor allows the same raft to nearly double its displacement so that the 4 person raft can buoy 8 survivors in an emergency. Dual floors also allow the occupants to separately store rain water for drinking in the smaller upper chamber 788 and sea ballast for stability in the larger lower chamber 789.

The dual hulled variable volume raft plan 773 of FIG. 11 takes advantage of the equation that internal volume of the second hull 790 goes up as the cube of the radius. So while both raft 783 and raft 786 are similarly filled with air to 25% of their maximum capacity, the internal volume of the double hull chamber 790 is massive compared to the internal volume of the lower floor chamber 789 of the dual floor raft 783. Raft 787 takes the principle to its extreme, demonstrating the massive contained buoyancy available to a double hulled raft 787 when at 80% of its rated capacity. The volume depicted in raft 787 can be quickly supplied by use of the drogue torque pump 377 shown in FIG. 30 to function as a hydrostatic pump. The restriction to the use of compressed gas for inflation of life rafts in the past has limited the scope of life raft invention because such a volume of compressed gas would require several SCUBA cylinders and is so impractical if not absurd as to be limit the imagination of inventors.

The self-closing bladder of FIG. 12 can reliable cross the open midline when the victim is first oriented on their side by inflation of the primary detonation bladder 150. The air then moves slowly through bladder wall restricter 151 to inflate the secondary bladder 152 still to one side of the midline. If a very small garment was forced on the wearer an emergency blow out scam 166 will allow the bladders 150 and 151 to pull away from the body rather than constrict pulmonary excursion.

Air passes from the lateral bladders then through a combined inline restricter-coupler-oscillator 131. The air then enters the self-closing collar 154 through a combined coupler-connector with built in reed and diaphragm oscillator 140 operating in the air above the water's surface. The posterior cervical bladder 155 can be orally inflated through valve 156 or inflated by excess gas passing through over the pressure relief valve coupler 134. Given the vestigial nature of the oral inflator on a bladder connected to pressurized gas a fabric tube 161 houses the combined connector low profile oral inflator check valve 157. A large mushroom valve 162 seals against valve seat 163. The valve body is curved 165 to complement the lips. The inflation valve 157 is covered by dust cover 164.

Due to the need for protracted containment of elevate pressures the bladders 150 and 152 are over sized and constructed from high strength fabric 169 as shown in FIG. 12. These bladders are contained within an undersized strain relief cover 168 sewn to keep the strain of the elevated pressures from the seams of 150 and 152.

The in wall restricter valve 151 of FIG. 12 relies upon a sharp edged orifice 158 cut into a semi-rigid weldable plastic that forms a clean restricter valve 159. The surrounding stray fabric strands are kept at a distance from orifice 158 by use of a large fabric orifice 160. This reduces the chances that fabric threads will be a nidus for forming dry ice as low temperature CO2 passes through orifice 158.

An oversized hydrostatic collector 170 shown in FIG. 13 can trap air to inflate the raft through fabric tube 174 then through coupler 180 into the raft. For survival bags not used as an inflation device for a raft or other inflatable, an internal check valve 175 will pass air along perimeter tube 180 then into the large diameter tubes 172 on the top of the survival bag as well as inside the small diameter tubes 173 underneath the victim. Inert fiber 181 slows movement of heat across the bags inflatable chamber. A very thin tube 177 acts a hinge separating the top and bottom layers of the thermally insulating survival bag 170. The perimeter of the inner smaller bag is welded to the larger outer bag at weld 184. The chambers in the bag are created by field welds 183. The two layers of fabric are then folded in half and welded along 185. To facilitate use as a collector for inflating the raft, a water activated compressed gas inflator with integrated oscillator 179 inflates circumferential tube 171. Lanyard-stirrups 178 mount in the middle of the survival bag 170.

One half of the survival bag is rolled up to form the hydrostatic collector 186 as demonstrated in FIG. 14. The circumferential tube 171 has been inflated by compressed gas means 179 and the other half of the survival bag is rolled up at 187. The tube for connecting the collector to the raft 174 terminates in connector-coupler 180.

The self inflating life raft 200 of FIG. 15 relies upon collecting air within the hull of the deflated raft, The victim 198 is shown compressing the collected air within the hull of the raft by pulling on raft handles 193 that also function as stirrups 193. The collector of the selfinflating raft creates a water seal 197 at the water's surface 196 pressurizing the entrapped air. The entrapped then pressurized air is passed through a large bore check valve 201 into the air retentive chamber/s of the raft. A bow spray skirt 191 is welded closed increasing the size of the collector and thus decreasing the time it takes to inflate the raft. One half of the deflated floor 195 and outer perimeter tube 194 are stowed held against the other half by a reversible connector quick release buckle 192. As the chamber begins to inflate 199 the buckle 192 is released.

Use of a two-layer raft as a hydrostatic pump collector requires that there be a difference in the size of the inner layer 205 relative to the outer layer 204 as shown in FIG. 16. The outer layer can be constructed so that it is larger by the incorporation of a double Z baffle 202. Since the outer layer is larger it then drapes, under the force of gravity, over the tense inner floor collector establishing the pressure gradient required for air to flow from the collector into the raft. Forcing the collector in particular the inner layer 205 of the collector against the water's surface creates a high-pressure zone 209 inside the collector. The excess fabric 202 in the external layer leaves a structural space between the layers, which by default until fully inflated, and pressurized, is a low-pressure zone 208. With a pressure gradient created by the differential cut between the inner and outer layers, air can flow through wide bore valve 201 from inside the collector to inside the raft.

An alternative means to creating a difference in size between the inner and outer layers of the collector is depicted in the middle drawing of FIG. 16. Inner layer 205 can be transiently made shorter by adjusting buckle 203 in strap 207. Strap 207 is sewn through floor 205. The needle holes resulting from stitching strap 207 onto floor 205 are covered by patch 206 welded to the inside laminate face of floor 205, thus preserving air retention. Tension placed in strap 207 compresses and folds up the inner floor 211 making the inner floor 205 smaller than the outer floor 204, creating the differential cut that allows inflation of the raft by itself.

The third and lowest drawing of FIG. 16 illustrates use of a reduction weld 212 placed into the inner fabric layer 205 after the raft floor has been welded. This tuck weld 212 which removes fabric from inner layer 205 consequently creates a relative excess of fabric 213 in the outer floor. Weld 212 establishes the differential cut so that the inner floor bears all the hydrostatic pressure during pumping leaving the raft chamber at 0 psig (psi gauge). The primary floor welds 214 not only re-registers the inner 205 and outer 204 layers but localizes the size differences between the inner 205 and outer 204 layers directly behind the check valve 201.

The weldable valve flange 224 with mushroom check valve core 215 in the upper drawing of FIG. 17 is designed to be low profile to reduce stowed volume. The quarter turn flapper core 215 has integrated finger grips 218 for installing and removing mushroom flapper core 215. O-rings 112 seal the core2l5 against pressurized air loss from inside the raft. The mushroom valve 162 is held against the mushroom valve mount and seal face 217 by the tension in mushroom post 219. Threaded cap 221 mounts on threads 220 cut into the valve body. Alternatively a quarter turn closure means for cap 221 would reduce cross threading. The mushroom valve 162 is protected from damage during folding and storage by mushroom valve flapper guard 225 as an extension of weldable flange valve body 224.

The lower drawing of FIG. 17 depicts a reversible quarter turn valve core 215, which relies upon dual O-ring seals 112 to seal valve core 215 against pressurized air loss in either direction of valve core 215 installation/operation. The mushroom post 234 is closely trimmed; the finger grips are minimal 235. The mushroom valve guards 232 have been enhanced to serve dual function as the finger grips when the valve core is in reverse position. The lower drawing also illustrates a fabric tube 230 welded to a valve coupler 226 at coupler face 231. For fabric that cannot weld a mechanical a crimp seal gasket 228 seals the fabric 230 under pressure from compression means 229.

The coupler 226 in FIG. 18 is compressing lid 236 against a gasket seal 237 so that the coupler 226 and lid 236 function as an airtight cap. Eye 238 allows the lid to be attached. The lower drawing is a detail of the double pin 216 quarter turn locking means with in recess 233 that allows the directional flapper core to be mounted in either direction. Friction snap lock 239 wedges between the two pins 216 locking the core in place.

FIG. 19 depicts a rigid foam survival raft 240. The floor 245 can be rapidly inflated upon exposure to water by compressed gas means 253. If there are space or cost restrictions on the amount of liquid expanding foam 247 then a hybrid personal flotation survival raft combining foam and air is constructed. The additional fabric of the Z baffle of outer layer 204 of FIG. 16 can be filled with a compressed liquid foam from canister 247 creating just a rigid keel 241 for enhanced steerage. The canister 247 can be separated from the foam delivery manifold 249 and its longitudinal delivery means 250 at its attachment point to a dull barb disconnect 248. The top seam 246 identifies the pleomorphic planar three-dimensional raft from the traditional three-layer raft whose seams are on the outside edges of the perimeter tube. A middle layer 244 allows separation of the rigid foam floor from a manual or compressed gas inflated soft upper floor 245. Use of vertical baffles 243 creates square tubes and a more solid insulating floor. If there is sufficient foam then in addition to the solid foam keel 241 a gluteal cushion 242 makes good use of insulating, inherently buoyant, foam. In those circumstances where there is the space to carry a sufficiently large canister 247, then the entire volume of perimeter tube 194 would also be foam filled. If the raft was deployed initially by compressed gas means to provide a semi-rigid form to shape the expanding foam and to provide instantaneous exit from the water then a combined over pressure relief valve and oral inflate valve 252 allows excess gas to vent during the conversion from inflatable to foam.

The convertible hybrid bladder 256 attached to a Type I Offshore PFD in the upper drawing of FIG. 20 supplies the displacement generated by a 16 gm CO2 cylinder. Due the superior design and 35 lbs. of displacement achieved by the Type I Offshore PFD the 16 gm bladder can be attached at any of the three locations 256, 258 or 260 shown in FIG. 20. The Type II Near Shore PFD has less displacement and looser construction requiring that the 16 gm bladder 258 be located in the centered sub-mandibular position 258 or in the eccentric position 260. The three-strap ski jacket design 259 with foam behind and in front of the unconscious victim can only achieve corrective turning action when the 16 gm bladder 260 is placed eccentrically across the midline.

A self-tensioning, eccentrically buoyant, airway protective garment 272 such as the T-shirt 265 shown in FIG. 21 can be an effective life jacket with only the displacement provided by an eccentric 16 gm bladder 260. The bladder 260 is held in position on the body by two systems. Lateral bladder flange 267 attaches to the right side of lightweight fabric chest strap-band 266. Adjustable buckle 269 connects the left side of the chest band 268 to the 16 gm bladder 260. The diagonal over the shoulder band 270 attaches to the 16 gm bladder at 271. Bladder 261 can be orally inflated at valve 19 or inflated via a remote waist mounted water activated CO2 inflation means. Pocket 275 contains the cylinder 107 selected by restricting sleeve 9 and connected via water activated oscillator integrated inflator 10 to manifold coupler 104 with inline integrated oscillator 100 in the supply line to bladder 260. A heavier garment can comfortably mount the cylinder 107 and inflator 10 directly to the garment wall.

Integration of the air horn into the body of the CO2 manifold cap 280 as shown in FIG. 22 produces a low profile piercing alarm. The tense fabric diaphragm 282 is support on spacers 281 where it vibrates against the directional horn resonator 144. The passage and ultimate loss of a negligible amount of air 145 drives the piercing man over board alarm. Volume is controlled by mounting air horn 280 in a mid-chest position which submerges the horn 280 when the victim is vertical in the water column or swimming face down. The unconscious victim would be floating on their back however with horn blaring from its out of the water position. An air horn orifice 146 can be adjusted at 284 allowing the conscious victim to lower the volume or turn off the alarm. The buoyancy from the bladder is protected from bleed off by the air horn by generic check valve 283. A normally open momentary closed valve 285 allows the victim to use their pressurized PFD as an emergency of pressurized gas to signal a search and rescue party.

FIG. 23 illustrates planar air chamber welded from two or more layers, which can be easily modified into a wide range of raft designs. FIG. 23 shows a one-half pattern 290 that can be re-combined. If pattern 290 is closely abutted, eliminating the bow tube 299, a single person raft 296 is formed. If the pattern 290 is separated partially, creating a narrow bow tube 299 you form a two-person raft 297. Extending the pattern 290 forms a three-person raft 298 with a longer bow tube 558.

The upper right hand one man raft is constructed from three layers. The perimeter of the high pressure floor 294 is formed by weld line 291. Secondary floor die 292 seals the perimeter and places the inner floor welds for both the upper and lower chambers. A strip of fabric 277 is welded to the inside lateral perimeter tubes to the upper and or lower layers above the water line. This creates a chambered that can be filled at fill valve 278 and drained by gravity at drain vent 279. Solar mass chamber 276 can hold either potable rain water or sea water. Being suspended above the water line it absorbs heat from the sun during the day and is insulated from the endothermic water. The solar mass 276 radiates its energy back to the survivor after dark.

The lower left hand drawing in FIG. 23 is of a two-layer dual-chamber raft 297. Compressed gas inflated low volume chamber 294 is sized according to the amount of gas that can be carried, the balance of the raft is inflated with a stuff sack, torque, hydrostatic or expiratory pump through large bore inflate-deflate valve 201. This two person raft is designed as a back packer's raft with the floor 294 rarely inflated by compressed gas rather it is routinely inflated with the stuff sack pump. The stern tube contains a inner layer 262 that forms an independent pillow 264 inflated through fill valve 278 to complement the air mattress floor 294. An option transparent or translucent fabric panel 261 allows the inner stern tube chamber 264 to be filled with water and laid out in the sun for a warm water shower in the evening. The inner stern tube chamber 264 also provides a level of redundancy buoyancy displacement in the event of puncture. When the inner layer 262 is welded against the inner floor if the victim's belt or attached gear punctures the inner wall the pillow will be sacrificed and not the primary displacement chamber 285. If raft 297 was a two person ocean survival raft the smaller upper floor chamber would be for drinking water and the lower layer without floor welds would make a full floor sea ballast chamber beneath the high pressure floor. The secondary welds 287 in raft 297 are shorter than usual increasing the displacement of the secondary chamber which is inflated by manual means through large bore valve 201 rather than with compressed gas. The displacement of the high pressure floor chamber is restricted to equal the size of the cylinder by increasing or decreasing the number of floor weld lines 291.

In two layered construction the low volume compressed gas chamber is a small component complemented by a high volume manually inflated larger chamber. The compressed gas chamber is created by weld 291 and the secondary weld 292 creates the high volume secondary perimeter chamber. As a last step the vertical closure welds 293 seal the inner laminate of the outer fabric layer of the raft back onto itself in a plane perpendicular to the floor/s converting the previously 2-D planar inflatable mattress into a 3-D inflatable hulled raft.

In the lower right drawing of FIG. 23 is of a three-layer four chambered raft 298. In a three layer raft the compressed gas inflated chamber 294 is created by welding a film or supported fabric to either the inner or outer layer at weld 291. The inflatable upper floor 286 the third large structural chamber is made by welding the middle layer of film or supported film to the top layer of fabric by welds 291 formed from the same die used to create the high pressure chamber 294. The volume of the upper floor 286 or third chamber is limited for improved stability by placement of weld lines 291. The die that makes the weld lines 292 encloses the secondary chamber or manually-inflated high displacement perimeter tube 285. In raft 298 the full floor ballast is made simultaneously by the inner weld of die 292.

Raft 298 of FIG. 23 is divided into four chambers. In FIG. 44 the raft is a dual chamber design where the upper floor is called the Primary chamber because it is inflated first with compressed gas and the balance of the raft is the secondary chamber which is manually inflated and serves as a holds for drinking water or sea ballast. Examples of dual chambered rafts are in FIG. 23 are rafts 297 or 296.

Raft 298 of FIG. 23, due to its size, the primary or high-pressure chamber 294 is now restricted to a perimeter ring chamber that quickly establishes the three dimensional shape of raft 298 thereby facilitating inflation by a range of manual inflation methods. The upper floor in raft 298 is now a third chamber 286. Floor 286 can receive both compressed gas through bypass over pressure valve 288 if the operator selects an over sized cylinder 588 or can be inflated or topped off by a manual inflation means through valve 201. The sequence of inflating raft 298 proceeds with the rapid inflation of struts 289 helping the survivors to envision the final shape of raft 289 once the secondary high displacement perimeter tube 285 is inflated. Upon release of the excess gas stored in an optional oversized compress gas cylinder 588 the excess gas passes through over pressure relief valve 288 into raft floor 286. The balance of gas needed to fully inflate floor 286 comes form a manual inflation means through valve 201.

Since storage of fresh water gathered during a squall can be the single most important contributor to extended survival at sea, a variety of chambers to serve as flexible canteens 587. While some bladders may initially serve as compressed gas inflation chambers if excess fresh rain water becomes available they converted for the clean storage of potable water. Some chambers are designed to separately manipulate both gas and liquid through use of a dual lumen connector with integrated draw tube 620 expressly to facilitate judicious use of limited drinking water reserves. The upper floor 286 of raft 298 of FIG. 23 has such a split lumen connector with integrated draw tube 620 that allows pressurized air to be vented during filling or instilled or to relieve any vacuum that might form during drinking. The inflatable floor 286 is converted into a flexible canteen 587 once the chamber becomes employed to protect potable water from contamination with sea water, emesis, urine of fish remains. The position of the end of the draw tube within the flexible canteen floor is marked on top of the floor at 585. This mark 585 guides the survivor to place their palm or knee in this position to collect by gravity any residual potable water about the opening in the draw tube which is affixed to the floor beneath mark 585. The lower full floor chamber 589 can be inflated manually through valve 645 that passes through the first floor. If the lower full floor chamber 589 is not filled with sea water it can also be used as a flexible canteen 587. A second dual lumen connector 640 is through-welded into the lower chamber. The location of the inlet of the second draw tube is indicated by mark 641 on the floor of the raft. A third mark 639 identifies the location of an optional drain vent. In FIG. 44 a locking-open locking-closed manual drain valve 642 is mounted within a radio frequency welded recessed flush mounted connector 642. In FIG. 23 the location of the drain valve is marked at 639 on the rafts floor for ease of operation. Opening the drain vent 642 in the bottom layer allows sea ballast to forced out of the lower chamber upon installation of air from the torque pump through large bore valve 645. The bottom vent 642 can be closed after the vent begins to bubble indicating that the lower chamber has been emptied of its sea ballast contents. If desired the lower chamber can then be off gassed of the air instilled to displace the sea ballast by opening the combined over pressure—vent valve located in pneumatic end of the dual lumen draw tube connector 640. If the raft is suddenly over occupied by survivors the full floor chamber provides enormous potential displacement to buoy not only those riding within and those hanging on to the perimeter tube 285 awaiting rescue.

For a single use emergency survival 'Mylar' raft constructed of unsupported film without compressed gas means, three layers can create two fully redundant life rafts. The inner and outer rafts are identical size and shape. The raft is constructed from a single die that makes weld 292. In this design weld 292 places all floor and perimeter seals creating two identical stacked 'Mylar' disposable life rafts. The middle layer would be a non-metalized film allowing it to weld to both the top and bottom metalized layers. FIG. 24 depicts the unique plasticity of the two layer raft 300 welded in three dimensions. The tapered side tube 301 abuts against a straight or curved bow 302 without the distortion that would occur with such a transition in a traditional three layer three dimension raft. The stem tube 304 is significantly higher that the juxtaposed sidewall tubes 301. Further this stem tube 304 can be modified after the air retentive bladder has been welded to create a whole series of different rafts by curving or baffling the chamber.

FIG. 24 depicts the unique plasticity of the two layer raft 300 in which the air bladders are welded first in one plane then the planar mattress is converted into a three dimensional raft by welding the bow 302, stem 303 and side walls 301 perpendicular to the compressed gas inflatable floor 294. In distinction to gradual radii and gradual changes in tube diameter required when constructing a three layer raft sequentially in a single plane, the tapered side tube 301 of a two layer raft can abut against a straight or curved bow 302 without the distortion that would occur if such a transition were attempted in a traditional three layer three dimension raft. The stem tube 304 has a significantly larger diameter than the juxtaposed sidewall tubes 301 such a steeped transition would cause conformational havoc in a traditional three layer raft. Further this stem tube 304, side wall tube 301 or bow tube 302 can be modified after the air retentive bladder has been welded to create a whole series of different rafts by curving or baffling one or more chambers at a latter date.

The lower series of drawings in FIG. 23 illustrate the flexible power of a variable volume life raft. The center configuration is typical of a 4–12 man offshore life raft. The series of raft outlines along the left hand edge compare the appearance of raft in filled to various with air or water. In raft 757 the lower chamber is 100% full of air or water. If the four man raft was unexpectedly occupied with 8 people aboard and 4 people hanging onto the perimeter, the fully inflated floor which can bulge to a hemispherical bladder would provide the enormous buoyancy needed for safety in that scenario. The same raft 757 if only occupied by a single person in an agitated sea state would completely fill the full floor chamber 589 with sea water 610 for maximum stability and minimum buoyancy. Excess buoyancy that is not loaded with passengers produces a light life raft that can be blown across the water's surface. Raft 758 is 50% full of air which in addition to the displacement held in the upper floor and perimeter tube would be sufficient for 2–3 extra occupants in at 4 person raft. If raft 758 was carrying 50% of its rated sea ballast it would complement 2 adults in a 4 man life raft in a mild to moderate sea state. Raft 759 demonstrates a raft with 25% of its full floor chamber inflated with air sufficient to offset an additional passenger in a 4 person raft. If raft 759 was filled to 25% capacity with sea water there would be improved adhesion to the waters surface in a moderate sea for a 4 occupants in a 4 person life raft. Raft 760 has no additional ballast or buoyancy in the lower chamber and would make its best course made good in trying to reach a shipping lane down wind.

Along the far lower right hand side of FIG. 24 a series of rafts illustrates the range of air to water ratios possible in a variable volume raft 750. In raft 753 the lower chamber is filled with 90% water and 10% air. This gives a very stable raft with a thermal layer at the top which in combination with an inflatable upper floor provides optimal protection from hypothermia. The lower chamber of Raft 754 is fully occupied by a ratio of 75% sea water to 25% air as would be indicated for a slightly over loaded raft desiring improved thermal protection in a moderately agitated sea. The lower chamber of raft 755 is 100% over loaded with survivors which requires the marked increase in displaced buoyancy associated with the lower chamber being 75% inflated with only a 25% sea anchor. While raft 756 would require massive over loading of a four person raft in order to keep the raft from turning into a beach ball at 90% inflation The center section 649 of the canopy support structure can be employed as the rigid arm for additional leverage when operating the power torque pump 379 as seen in FIG. 30. The use of one or both canopy side struts 761 in association with the power torque collector's hydrostatic pump sleeve/s 405 and or 404, also seen in FIG. 30, can create a long armed hydrostatic collector that can be operated from the door of the life raft for the generation of high PSI topping off pressure required for the structural integrity of heavy duty neoprene or vinyl 12–20 person life rafts.

FIG. 25 is an adapter for swivel mounting an air horn 310 onto a modified CO2 manifold cap 315. The swivel allows the direction of horn to be pointed away from the wearer ears. The direction of air horn 310 is selected before securing the air horn to the inflator regardless of where the manifold 30 has been welded in the PFD. The air horn 310 comes with an integrated threaded female coupler 312, which receives adapter 311. The modified CO2 manifold cap 315 has an internal gasket 314 for sealing the adapter 311 against the manifold 30. A small amount of air 145 passes through the adapter 311 then through the air horn orifice 146 where it pushes against the diaphragm 142 which is supported by gasket 281. The diaphragm 142 rebounds. The diaphragm's oscillation produces a piercing audible man over board alarm 40. The air in the bladder is kept from slowing bleeding out through the air horn by check valve 283.

FIG. 26 the upper drawing is of a high-pressure water activated air horn 320. The ballast of 8 gm CO2 cylinder 179 acts as a keel for buoyant moment 324 placing the inclined self draining air horn 323 out of the water in a slightly declined position. The air horn can be removed at release means 321 so the horn can be orally operated. The water activated compressed gas inflator 179 releases compressed CO2 into a pressure regulator 325, which is held in place by nut 328. A small amount of gas 145 passes along air horn supply line 329 to the air horn floating above the water. The normally closed valve 322 after pressurization can then be opened by the victim to save the gas until a rescuer is in sight. The lower portion of the housing is vented 326 to allow water to reach the water-activated inflator 179. Garment or PFD attachment means 327 for the extended duration water activated man over board signal 320 allows existing boating gear to add a water emergency alarm. Alternatively, water activated alarm 320 can be thrown in the direction of a man over board to help mark their location.

The lower drawing in FIG. 26 is of a water actuated 318 low-pressure aerosol canister 319 air horn. Manual operation is via button 317 as is traditional. Ballast plate 316 orients the horn so it is held out of the water.

The upper left hand drawing of FIG. 27 depicts a quarter turn self-ejecting, manual or water activated or hydrostatic activated inflator 330 which relies upon an adapter 333 that locks the threaded compressed gas cylinder 334 into a quarter turn adapter. An ejection spring 331 forces the adapter 333 and cylinder 334 out of the inflator 330 if it is not in the secured position. When in the secured position the cylinder 334 is held a constant distance from the piercing pin 332 preventing failure of inflation due to partially or loosely installed threaded cylinders.

The lower right hand drawing of FIG. 27 is of a two-part crimp seal to quarter turn adapter 335. The adapter locks over the crimp seal 336 converting it to a quarter turn fitting for mounting the crimp sealed compressed gas cylinder 337 into the quarter turn inflator 330.

The upper right hand drawing of FIG. 27 is of the preferred embodiment in which the quarter turn connector 338 is integrated into the compressed gas seal obviating the need for an adapter.

In the upper left hand drawing of FIG. 28 an alternative quarter turn mounting means 343 which relies upon a cylinder housing that is an extension of the inflator 330 to utilize existing cylinders of any seal type 340. An ejection spring 341 pushes the cylinder and cap 344 away if the quarter turn pin 346 is not secured in the quarter turn recess 345. The cap compresses the cylinder 340 against the compression seal 342 to maintain a constant distance from the piercing pin 332. In the lower drawing a longer compressed gas 349 cylinder that has a crimp seal 347 is held in place a longer quarter turn cap 348 within the same housing 343.

FIG. 29 shows a universal inflator base with quarter turn connector 350 mounted to a variety of cylinder specific quarter turn housings 351, 356 adapting a range of cylinder widths and lengths to the inflator 350. An ejection plate 352 powered by a base ejection spring 353 assures that a loose cylinder will be forced away from the inflator 330 rather than giving the false appearance of being correctly installed. The quarter turn housing 351 or 356 compress the cylinder 354 or 355 against the compression gasket 342 supported by compression gasket stop 357 establishing an air tight seal and a constant distance to piercing pin 332 for reliable puncture by the manual, water or hydrostatic inflator 330. In the lower left hand drawing an indicator window 360 displays the status of the closure of the housing 351 or 356 relative to the inflator 350, warning whether the cylinder 354, 355 and housing 351, 356 are fully mounted.

FIG. 30 demonstrates the manual inflation of the raft on either land or while remaining inside the raft while floating on the water by operation of a manual torque pump 371. The victim 198 scoops and entraps air within the collector 375. Once the air is collected and sealed inside by closure of the opening the user secures the base of the torque collector with their feet by placing them through fabric stirrup or loop 370 which is securely attached to the fabric 373 outside the welded line 376. The triangulating stirrup or foot brace 370 splits the torque applied by manual or levered arm means to the two corners of the triangles base 718. The twisting force which otherwise would be focused at a single point, the attachment of the pump to the raft. The force being generated if not arrested by the rigid base 370 would tear the fabric coupler 705 out of the fabric wall of the collector 375. An alternative triangulation is to attach the corners 719 of the pump 378 through complementary fasteners 720 to the wall of the raft or other rigid means such as a spent cylinder or paddle which could then be secured by the feet. The triangulate base of the torque pump creates a clear path for the transfer of air being pressurized by the torque pump 371 to the raft check valve.

In the drogue torque pump of FIG. 30 the torque collector 375 tapers to a fabric tube terminating in an inline valve coupler 226 that attaches to valve 201 which is welded into the raft. The drogue torque pump 377 is conical shape and the inline coupler 226 allows water to flow smoothly through the drogue when used to steer the raft at sea. In the stuff sack torque pump 378 a long neck collector facilitates inflation because when the user squeezes the neck closed when collecting air a significant portion is squeezed out and lost. The flush mounted fabric coupler 705 is easier and sufficient for a torque pump that is not envisioned to be pressed into service as a sea anchor or drogue. As the victim 198 applies manual torque to the collector 375 he converts it into a torque pump 371 and creates a pressure gradient 374. When the pressure in the pump exceeds the pressure in the raft it opens valve 201 and air passes into the raft. First inflating then pressurizing the raft tube 285 and floor. A power torque pump 379 combines features from both pumps. Intended for use with large neoprene and vinyl 4–20 person life rafts the power torque pump 379 includes a heavily reinforced orifice flange 407 that allows passage of a reinforced lever handle 649 or spent CO2 cylinder 715. The rigid lever arm 649 also serves as a section of the canopy support and an intermittent component of a fishing pole. The increased train generated by the lever arm is distributed through a strain relief reinforcement means 408. Additional strain generated on the fabric collector from use as a paddle or rigid arm pump is transferred to reinforcement about the inlet 409.

The power torque pump 379 of FIG. 30 also includes means for connect the collector to a rigid arm such as a paddle or fishing pole in order to submerge the air collector 375. As the collector 375 is submerged it is compressed in proportion to its depth of submersion. The collector can be attached at either a single point through use of a single rigid-arm hydrostatic pump sleeve 406 in which case the collector inlet angles up under the enclosed buoyant force with some air escaping or the collector inlet can be held parallel through the use of a nested pair of pump handle sleeves, 404 within 405. Both the top mounted smaller inner sleeve 404 and a larger full side mounted outer sleeve 405 are securely attached to the pump collector 375 by reinforced attachment means 406. A length of tubing 716 sufficient to generate the intended pounds per square inch of pneumatic pressure connects the raft and pump. At the hydrostatic pump end a quarter turn locking coupler 647 connects the tubing through over sized right angle connector 646 to the collector 375. After air is caught within the collector 375 and the collector inlet sealed against the water's surface a rigid arm such as a paddle or canopy support is placed within the inner sleeve 404. Then both the end of the paddle and the inner sleeve 404 are placed inside the outer sleeve 405 and the hydrostatic pump is pushed down until the desired psi is achieved.

The torque pump can be converted into a bail bucket or water proof container for collecting rain. The use of a locking and sealing cap 712 attached at to cap at 713 and attached to the pump 379 by reinforced lanyard means 403 to a reinforced lanyard attachment means closes off the collector. Alternatively, by folding back the coupler 705 of the stuff sack torque pump or the inline coupler 226 of the drogue torque pump, the torque collector 375 can now be used to gather and hold rain water directly or gather and hold the runoff from the rafts canopy. The torque pump can collect and store the rain water but ideally the drinking water is transferred under pressure if necessary into one of the raft's flexible hydration chambers 587 as seen in FIG. 23 for protection of the drinking water from spillage or from contamination until used.

In FIG. 31 an ionic switch 381 activates a local oscillator 391 and a base station oscillator 399 via a transmitter 389 to produce audible alarms 40. The switch contacts 386 abut against a cellulose pad 381 holding powdered crystalline salt. Upon immersion the ballast of batteries 387 and circuitry 389 mounted via 390 in position to contribute its ballast to submerging the ionic switch 380 and floating the oscillator 391 and antenna 392 out of the water. The combined ballast 387 and 389, quickly submerge immersion chamber 385. Air rapidly exits via hidden vent 382 then through exterior louvered fenestration 384. The inner vent 382 is offset from exterior vent 384 to protect the salt strip 381 from inadvertent water splash or rain. Buoyant chamber 393 exceeds all integrated ballast to provide net buoyancy and orient the oscillator 391 and antenna 392 out of the water. A clear cover 383 allows monitoring of water indicator die integrated into the ionic switch 381 to alert that the strip 381 has been wet and the batteries 387 may be dead. The user can then press switch 388 to test battery condition and circuitry. An integrated low power circuit 389 continuously beeps through the local oscillator 391 and at the base station 398 oscillator 399 when the batteries fall beneath an acceptable voltage threshold until the batteries are dead. The ionic switch 380 can be attached via eyelet 394 to a swivel 395 to facilitate the device orienting the oscillator and antenna once it enters the water. Lanyard 396 and attached clip 397 secure the sensor to the garment or life jacket.

FIG. 32 is a planar schematic and lateral cross section of ionic switch 380 identifying the segregation of ballast 387 and 389 and buoyant moments 393. The lateral view shows the ionic switch 381 held aloft on pedestal 400. Retainer 401 holds the replaceable salt strip 381 in place. The evacuation of air during flooding of the immersion chamber 385 occurs by way of offset vent 383 and vent 384 working in conjunction with offset cross ventilation means 402. As water floods in from either direction air is allowed to escape from the other. The clear cover 383 allows inspection of status of strip 381. Cover 383 slides open to replace ionic switch 381 as indicated.

FIG. 33 integrates the ionic switch 380 with a solenoid 411 actuated, cam 412 amplification to initiate automatic inflation. Upon immersion chemical switch 381 closes and the transmitted signal is received by antenna 392 integrated into inflator body. The signal connects batteries 387 to solenoid 411. The solenoid 411 acts through cam 412 amplification to remove a latch arresting compressed spring 418 allowing it to drive the piercing pin into the compressed gas cylinder 419. The lower drawing illustrates an ionic switch 417 hardwired to the solenoid 411 obviating the need for transmitter and receiver. For trained rescue personnel jumping from helicopters, an adjustable delay means 415 allows a 5 or 10 seconds delay before the compressed gas cylinder 419 is pierced. Ideally once the circuitry has been connected to power via conduction through the water activated ionic switch 381, the reset or kill switch 416 is tripped by the operator interrupting the automatic inflation cycle, allowing them to swim rapidly to the victim unimpeded by an inflated lifejacket. Should the rescuer become unconscious on impact they would not be able to manipulate reset switch 416. In which case the solenoid 411 with assistance from cam 412 would after expiration of the preset delay 415 release the piercing pin to inflate the unconscious victim's life jacket rolling them into an airway protected position.

The upper drawing in FIG. 34 is of a dual chambered PFD 430 in which orally inflated or rapidly inflated compressed gas inflated chamber 434 is backed up by an orally inflated or expanding liquid foam which inflates then convert to rigid foam chamber 431. A through weld in chamber 431 forms a hinge 432 behind the neck so the wearer can separate the rigid arms allowing them to be able remove the inherently buoyant chamber once the liquid foam has converted to rigid foam. Bladder 431 relies upon a manual activation means 433 to release the contents of the compressed liquid foam canister 247. The lower right hand drawing illustrates the liquid foam delivery manifold 249 and its connection to the large bore perimeter delivery means 436 with its multiple delivery ports 438 and to the small bore perimeter delivery means 437. Distributed perforated vent line and over pressure relief valve 439 removes excess gas. A enlarged detail of the manifold is seen in the lower left hand drawing showing the weldable flange 141 the barbed coupling 103 and the continuous manifold 435 the distributes the liquid foam to the large bore 436 and small bore 435 delivery tubes. Manifold 435 is sized to offset the unequal lengths of the delivery tubes thereby achieving the installation of similar amounts of liquid foam into each half of the PFD. Alternatively, the back up chamber 431 can be orally inflated and deflated through valve 19 to routinely achieve additional displacement and freeboard. Once filled with foam compressed gas inflated chamber 431 is replaced with a new deflated chamber 431 to which is attached a charged compressed liquid foam canister 247.

FIG. 35 illustrates the applications of compressed liquid foam in a range of personal flotation devices. The upper left hand drawing is of a PFD 440 that is inflated orally 456 or with manually activated 433 compressed liquid foam 247. The upper right drawing is of single chambered PFD 441 that is inflated orally 19 or with compressed gas 10 and or two-part rapid-expanding rapid-set compressed liquid foam 429. Over pressure relief valve 456 allows gas to be displaced by expanding foam. The lower left hand drawing is a dual chambered PFD 442 in which the forward chamber is inflated with water activated compressed gas 10 and the rear chamber 431 is inflated with liquid foam manually 433 or automatically upon contact with water 445. The lower right hand drawing is of a dual chambered PFD 443 in which the compressed gas and compressed liquid foam rely upon the same water activation means 444 to activate the compressed gas cylinder and the liquid foam canister 247.

FIG. 36 illustrates a dual chamber garment based PFD 450 in which the initial low volume corrective turning bladder 451 is initial inflated by a 16 gm CO2 by a quick change inflator 453. The compressed liquid foam canister 247 is water activated 442 with manual activation 433 in case of failure of the water activation mechanism 433. As the liquid foam expands CO2 is passed through the inline foam arrest fitting 452 then through the over pressure relief valve 454 then through an inline oscillator 100 before passing into the freeboard chamber 455. Given the possibility of over inflation a combined oral inflate deflate and over pressure valve 456 allows excess gas to escape.

FIG. 37 is a cross section through a keyed single position quick-change inflator 460. The manifold is solid at the top 461 and the inflator is locked in place by a exterior locking spring clip 462 which is recessed into the inflator body 463 holding the inflator 39 against the inflator body seat 472. The check valve spring 467 applies tension against the check valve plate 466 which is sealed by gasket 465 held against check valve stop 464. The check valve body 468 is held inside the manifold 30 by internal spring clip 469. The inflator body can only be oriented in a single direction because of the CO2 manifold key 470 that inter-digitates with the inflator body key way 471.

FIG. 38 is a superior and cross sectional view illustrating a miniature manually activated, remotely activated or water activated signaling system 480 that initiates a local alarm and alerts a permanently installed or portable base station to the onset of an immersion or other emergency. The cathode and anode sandwich of salt impregnated absorbent, agar, gel and or cellulose matrix 488 contained within a single use switch module 385 during a water emergency is flooded within immersion chamber 385. Ionic facilitated conduction closes the normally open ionic switch 488 supplying power to the transmitter circuit 481 signaling the base station 398 and simultaneously initiating the local oscillator 483. Once initiated by the remote signal, which marks the onset of water immersion, base station circuitry 492 sustains that alarm without the need for continuous signal input from the remote transmitter. Alternatively, manually actuated emergency switch 482 alerts base station 398 of the need for assistance. Remote locator button 491 on the base station initiates remote oscillator 483 allowing remote receiver 480 and attached child or adult to be located. Further switch 482 on remote transceiver 480 can be used as an emergency call button to signal need for assistance or to test for battery condition. Low voltage circuitry 481 actuates oscillator 483 when battery capacity falls below a pre-set voltage. Local oscillator 483 when activated by the base station remote locator switch 491 or when activated locally by emergency call function 482, can be terminated by depressing sealed reset button 490 located within a recessed space 489 on the remote transceiver 484. However, when oscillator 483 is set off by flooding of immersion chamber 385, the activated ionic water detector 488 and oscillator 483 can only be deactivated by removal of replaceable ionic switch module 485.

FIG. 39 depicts a series of water-switched and ion-enhanced water-switched alarm systems. The upper left drawing is of a simple man over board signal means 515 in which the current from battery 512 flows through insulated switch leads 501 into the non-corroding electrodes 502 such as a gold plated electrode. Water first floods the splash diversion chamber 504 then spills into the splash protected immersion chamber 503 where the water conduction closes switch 527. The electrodes 502 are spaced a sufficient distance apart 505 so that a single condensation or inadvertent drop can not span the distance between electrodes 502 but rather the electrodes 502 must be immersed before conduction sufficient to trip switch transistor 508 can occur.

The amount of voltage conducted through the water switch is adjusted by selection of resistor R1 507 to safely operate gate leg of switch transistor Q1 508. Switch transistor Q1 is selected by the voltage supply and power requirements of switched loads. The fluid switch voltage effectively closes switch transistor Q1 508 so that current then passes from the power supply lead 506 through the transistor switch Q1 508 onto activate external alarm oscillator 483. The current loop is completed by the electron's return to the battery through conductor 525. The passage of current through oscillator 483 produces audible alarm 40 alerting others to the onset of a water emergency. Twisting the cap integrated fluid switch 500 transiently closes the normally open test switch 510. Current from the battery 512 passes through conductor 509 through the temporarily closed switch 510 through conductor 511 that leads the oscillator 483. Strength of signal 40 produced by oscillator 483 reflects condition of the batter 512. When the cap 500 is in the closed position, battery test switch 510 is open. Alternatively when the two part quarter turn locking pin 216 is locked into body 513 recess 233, then switch 514 is closed allowing the current carried by conductor 506 to reach switch transistor 508. In the event of a water emergency the oscillator will run until the cap is turned from the locked position thereby opening switch 514 and stopping the alarm.

The upper right hand drawing of FIG. 39 is of a man over board signaling device 516 which relies upon an ion-enhanced water activated switch. Single use cap 519 includes a clear window 383 to see if salt impregnated pad 381 has been exposed to water as indicated a change in color. After recovery from a man over board event, single use cap 519 is replaced by a new cap with dry salt pad 381.

The lower left hand drawing of FIG. 39 is of a waterproof flashlight 517 with integrated multi-modal alarm means. On submersion water closes the fluid conduction switch 527 passing voltage onto switch transistor Q1 508 which is thereby closed allowing voltage to pass through transistor 508 and conductor 522 onto both the oscillator 483 as well as on to the light bulb 520 by way of conductor 529. The water switch 527 circuit is in part established by the continuous compression of the base of bulb 520 against continuous compression contact 529. Parallel to compression contact conductor 529 is conductor 524, which is functionally, separated by insulation 528 in the area between the battery 512 and transistor 508. Conductor 524 is in continuous contact with battery 512. Conductor 524 serves the triple functions of supplying continuous voltage to the water switch 527, continuous voltage to switch transistor Q1 508 as well as being the manual switch leg for routine operation of bulb 520. In manual operation of light 517 the globe of the flashlight is screwed down it compresses both the bulb 520 and continuous compression contact lead 529 against normally open contact 524. This closes the circuit allowing current to flow through conductor 524 through bulb 520 and back to battery 512 via conductor 525. The light is turned off by backing the bulb 520 and continuous compression contact 529 away from the normally open switch lead 524, which opens the manual compression switch. Continuous compression contact 529 maintains contact with the base of the bulb as it moves away from conductor 524. When not serving as a manual switch leg, conductor 524 continues to supply voltage to water switch 527 and switch transistor Q1 508 and requisite circuitry leaving it ready to close or activate upon submersion.

Emergency or automatic operation of dual function flashlight 517 in the lower right hand corner of FIG. 39 selection of the electrode 530 relies upon surface area, distance apart 505, electrode coating, use of semi-conductive material 505 combine to functionally integrate the resistance of resistor R1, thereby safely limiting power supplied to gate of Switch transistor Q1. When immersed water or ion-enhanced water closes switch 527 passing operational voltage onto the gate of switch transistor Q1 508. The water switch voltage pressure supplied by fluid conduction through switch 527 closes transistor 508 which thereby allows current to flow from battery 512 onto oscillator 483 and bulb 520. The circuit is completed by the return of current from oscillator and bulb through conductor 525 back to the battery 512.

The lower right hand triple function flashlight 518 of FIG. 39 complements a manually operated flashlight and water activated audible and visual alarm with RF transmission 523 notifying observers at a distance of the onset and location of a water emergency. Additional circuitry 523 can amplify voltage, create warbling/piercing auditory alarm, improve visibility through a capacitance-powered strobe marking the location of the MOB.

FIG. 40 is water or ion-enhanced 381 water activated toddler alarm 539. Disposable cap 519 provides correctly mounted dry ion matrix 381 positioned over the water switch electrodes 502. Window 383 allows parent to check status of salt pad 381 via an integrated color indicator which changes color upon exposure to water indicating need for replacement. The water activated switch 527, battery 512 and switch transistor Q1 508 and support circuitry 531 is attached to garment via clip 533 in the area of the child's airway. Every time water alarm 539 is transferred from garment to garment closure of attachment clip 533 closes test circuit switch 534. Current from battery 512 via conductor 535 to test switch 534 then on through conductor 536 which transiently energizes the alarm system 539 to assesses operational integrity of circuitry, transmitter, oscillator and battery. Buoyant lanyard 532 includes buoyant mechanical support; antenna 392 and power supply 525 to oscillator 483. The bumblebee's buoyant body 537 assists in positioning the oscillator 483 and antenna 392 at or above the water's surface to improve efficacy of transmission and audible alarm 40 passes through grille 538. The separation of the oscillator 483 from the water switch 527, battery 512 and circuitry 508 & 531 via lanyard 532 makes the product difficult to swallow by the very young toddler.

FIG. 41 is a Light Emitting Diode flashlight with integrated multi-modal water activated MOB alarm system 548. The filamentous leads of the LED 549 require an LED socket 541 allowing a permanent connection between LED 540 and the water switched 527. Photo sensor 547 limits operation of LED 540 during daylight hours conserving battery 512. Depending on the sensitivity and direction the photo sensor is facing it can also create an intermittent flashing signal in which as it activates the LED the light emitted shuts off the power supply. Manual operation occurs by compressing switch 542 against the compression shelf 543 closing the circuit allowing routine continuous use as an LED flashlight 548. If the LED socket can only be installed in a single orientation then the compression contacts 545 built into the parabolic LED housing 546 connect with the water switch contacts 544 at a single point. If the LED housing can be mounted in multiple positions then the water switch contacts 544 are circular or hemi-circular as indicated. Additional circuitry 523 allows an increasing range of electronic sophistication from amplified voltage for a louder oscillator 483 and brighter LED 540 signals to incorporation of a transceiver for RF, EPIRB or GPS signals. Water conduction switch 527 is located below globe O-ring 112 and is therefore exterior to flashlight body 556. Sponge 558 once immersed mechanically sustains conduction allowing continued operation of gate of Q1 transistor 508 leading to the continued provision of power to the various local and transmitted alarm signals. Louvered cross ventilation 402 redirects splash yet air can escape rapidly upon unexpected water entry allowing quick flooding of electrodes 530 which then supply power to the oscillator 483, RF circuitry 523 and creates flashing LED 540 at night.

FIG. 42 is a composite drawing illustrating four different dry suit modifications 561, 562, 563, 564 allowing the reversible, secure mounting of an inflatable PFD 576 to a dry suit 571 creating a dry suit PFD 560. Many current dry suits 571 are constructed from nylon fabric coated on one side by radio frequency welded plastic. In a hooded dry suit fabric in the collar area can be welded back onto it self, creating an exterior flange 561 to which can be sewn reversible attachment means 566 without damage to the waterproof integument.

While the external ballistics protection means 573 in FIG. 42 protects the dry suit 571 from puncture in the area immediately behind the body armor, ballistic penetration at any other site leads to flooding and reduction if not loss of mobility. The dual compression stowed inflatable PFD 576 can be manually inflated by pulling on handle 567, which detonates a compressed gas cylinder 340. A redundant compressed gas and puncture sealant cylinder 578 is available to restore buoyancy in the event of a ballistic impact. Compressed gas or compressed liquid foam blows open closure means 568 in PFD cover 574. Until the PFD is inflated, gun butt zone 572 is free of intrusion by either the stowed PFD or mounting hardware allowing uncluttered shouldering of the rifle. Due to the strong forces transferred between a reversibly mounted PFD 576 and the garment 571 the reversible mounting means 566 is securely yet reversibly locked by locking means 577 that passes through modified zipper pull 565. The locking means is shown in the release position at 575 at the terminal end of reversible attachment means 566 mounted on the exterior welded flange 561.

Alternatively, for non-hooded dry suits such as the sample in FIG. 42 with glued collars 570 the reversible PFD mounting means 566 and the locking means 577 cab be attached to collar seam area 569 before it is glued to dry suit 571. In this fashion the reversibly PFD attachment means 566 also preserves the waterproof integrity of dry suit 571. Alternatively, the sewing of reversible attachment means 566 and mounting of zipper lock means 577 can be covered by an interior patch 563 sealing off the needle perforations from air loss and water entry. For dry suits laminated exteriorly the reversible PFD attachment means 566 can be glued to dry suit 571 or sewn to a flange 544 welded to the exterior of the dry suit 571.

FIG. 43 is a hypothermia mitigation and water extrication bladder. Due to minimal baffling between the inner and outer floor 594 and inner and outer sides 596 there is a high chamber displacement per square foot of raft surface area achieved. Due to the very deep sides 598 relative to width 599 and the square outline 593, the internal volume 592 is a near maximum achievable per square foot of fabric bulk. The automatically compressed gas 419 inflated upper perimeter tube 294 and eight vertical struts 591 creates a rigid box shaped collector 593 whose collection capacity equals the internal volume of the manually inflated chamber 600 allowing the raft to be self-inflated with a single hydrostatic pump. The manually inflated chamber 600 is comprised of the high volume gluteal cushion 595 and the billowing high volume walls 597. The reduction welds 212 in the floor create an inner floor that is smaller than the outer floor establishing a pressure gradient through valve 201 when pulling on hydrostatic pump handles 601 which are attached to the planar raft top seam 246. The rigid upper perimeter tube 294 creates a quick, easy and secure seal against the water's surface without loss of entrapped air. Water activation of the compressed gas inflator results in immediate inflation of the upper tube 294, which suspends the manually deflated lower tube and floor 600. Immediate entry is possible because of the enormous displacement created when the internal volume 592 is pressed beneath the water's surface by the weight of the victim. The victim is then able to use the manual torque pump to inflate and pressurize chamber 600 through valve 201 if they do not want to enter the water to use the raft to inflate itself. Alternatively the water extrication bladder 590 can be primary or secondarily inflated by rapid expanding two part compressed liquid foam 429.

FIG. 44 is a cross section of a raft with a pneumatic or hydraulically adjustable sea ballast 610. Torque collector 375 can be used to instill water or air into chamber 600 through valve 201 in the inner floor. Excess pneumatic pressure can be vented through variable over pressure relief valve with lock cap 616. Applying torque 371 to collector 375 varies the air to water interface 615 in chamber 600. The ratio of air to water can be varied to meet the size or number of victim aboard and the Sea State. The deep walls of the raft 598 create the sizable internal displacement 592. The floor welds can be left off completely making the raft floor hemispherical. Weld 291 separates the compressed gas inflated upper chamber 294 from the combined floor and lower chamber 600. Sea ballast vent 611 allows water to be vented through site tube 612 once the site tube is release from restraining strap 613 and the locking cap 614 is opened.

In the lower right hand drawing of FIG. 44 a single lumen right angle connector 627 which integrates a mechanical stop 629 to prevent over insertion of the mobile ballasted draw tube 581 .Draw tube 629 is through welded 792 allowing the user to access the lower chamber through the upper chamber. Through welding requires that the middle layer be either an unsupported film or fabric laminated on both sides 793. A ballast means with integrated cutting barbs 582 is permanently secured to the tip of the mobile draw tube so that it is always positioned at the lowest point in the hull allowing access to the last of any drinking water that might be stored in the primary high pressure chamber 294 or secondary low pressure chamber 285 acting as drinking water and or sea ballast holds of the raft. The locking inflate/deflate valve serves as the draw tube valve 628. If the chamber is pressurized the fluid pours out upon opening valve 628. If there is no pressure above the fluid then the drinking water can be drawn up through draw tube 581 by sucking valve 628. The right angle connector is welded to the raft upper layer by way of connector flange 624 which is attached by adhesive for neoprene, radio frequency welded for polyurethane or polyvinyl or heat seal for linear low density polyethylene film.

The left hand drawing is of a dual lumen right angle connector 620 with integrated draw tube insertion stops 629. The gas lumen 583 of the tube 620 allows bi-directional access to gas. Either acting as a vent to relieve increasing pneumatic pressure as water is added or used to instill air to pressurize the fluids delivery. The fluid lumen 584 allows access to the rain water 586 which is protected from contamination by salt water or body fluids, emesis or urine within either the primary chamber 294 or secondary camber 285. Alternative the secondary fluid lumens allows the salt water to be removed adjusting the amount of sea ballast such as would be indicated if the raft should picked up additional passengers and need additional buoyancy. Further in fair weather the ratio of buoyancy to sea water can be adjusted to optimize headway over stability. The fluid lumen 584 through use of a bi-directional locking sharp-barbed one way connector 623 securely mounts the external end of the internal and permanently mounted draw tube 619. The dual lumen tube 620 with integrated mechanical stops 629 prevents over insertion of either the locking coupler 623 or the draw tube 619. Welded to the bottom layer of either the primary chamber 294 and or secondary chamber 285, is the draw tube locator fittament 625. Integrated sharp locking barbs 626 prevent the draw tube 619 from working free of the locator fittament 625. The position of the locator fittament 625 is marked 585 on the surface of the raft floor facing the survivor informing the survivor where to place their weight to gather together any residual water in the life raft integrated canteen 587 to be certain they are withdrawing every last bit of water stored in the drinking hold.

FIG. 45 shows the construction sequence of the convertible planar raft. First handles 601 are sewn to inner layer 619. Stitch perforations can be cover by welded or glued internal patch 563. Next valves 201 and 632 are installed into inner layer 619. Floor applique 609 is then sealed against the inside of inner layer 619. Closure of raft chamber/s can create either a single chamber by formation of seam or weld 292 or multiple chambers can be created by a die combining welds 292 with 291. The total potential displacement of raft is doubled when the sealed planar bladder is converted into three-dimensional vessel by vertical welds 293 made from welding the edge of the outer fabric 620 back against itself. The internal volume of raft 590 can be set to be less, equal or exceed the manually inflated bladder volume 600

The combination of welds 291 and weld 292 in FIG. 45 creates a compressed gas inflated superior wall chamber 294 and a manually inflated inferior wall and lower floor chamber 600. Handle 601 is mounted to only the inner layer 619 X distance 631 from the outer perimeter so that when a downward force is applied to handle 601 against the water's surface fabric equal in amount to X 631 width and Y 632 is reduced from the inner layer and functionally added to the exterior layer 620.

The differential shift in size per side, between the inner collector formed by layer 619 in FIG. 45 and the outer collector formed by layer 620, is 2 times the single sided surface or twice X times Y in square units per side. The Total Differential shift in Surface Area from the inner to the outer layer of the collector includes the inner reduction and outer expansion on both sides of the hydrostatic pump collector, that is the Total Differential Shift=2 sides[2 faces (X times Y)] or 2[2(X×Y)]. This transient increase in the size of the exterior layer 620 relative to the interior layer 619 relieves the outer layer of the pneumatic force of the entrapped air as the collector is forced beneath the surface. This transient laxity in the outer layer of the collector allows a pressure gradient to be established across the inner layer 619 of the raft when the raft is operating as the hydrostatic collector during self-inflation. The pneumatic pressure generated when force is applied to handles 601 in compressing the collector against the water seal, can only escape from the inner collector by opening flapper valve 637 and entering the raft. The reduction in the size of the inner bag 619 relative to the outer bag 620 creates the pressure gradient, which allows air to move quickly from inside the collector to inside the raft. Note valve 638 is located between the inner wall and the appliqued floor 609. Since there is no differential cut the pneumatic force of the hydrostatic pump is transferred from the inner layer directly to the appliqued floor layer. Since no gradient is established, no air moves from the collector into the gluteal cushion 595.

FIG. 46 shows a multi-voltage power pack 650 integrated with the solar collector 91. Charging diode and circuitry 656 prevent discharge. Individual 1.5 volt cells 651 and connected and accessed by waterproof touch switches. 3.0 volts at switch 653, 9.0 volts at switch 654 and 12.0 volts at switch 655. Multi-head jack 657 can be permanently adapted by a selection of jack heads 659 and are sealed from the elements by cap 658. LED flashlight 548 with is attached and recharging its internal 3.0 volts battery bank 512. Man Over Board transmitter 11 has receptacle 660 protected by plug 661 while the power cord is in use charging LED light 548.

In FIG. 47 illustrates a low profile, weldable, reversible, combination inflate, deflate and locking sealed valve 215. In the upper drawing is a flush mounted locking quarter turn low-profile high-bore fabric coupler 705 in which the quarter turn pin 216 slides down the external quarter turn track 711 and turns into valve body 206 recess 233. The core is turned by gripping the integrated finger grips 235. The fabric coupler 705 is hermetically sealed by O-Rings 112 to the valve body 706 and thus to the raft so that high pressure air generated in the amplified lever arm torque pump can only flow into the raft once internal pressure is exceeded. The torque pump collector 701 is welded at 231 to the fabric coupler 705. The body of the collector is of to the right of the drawing indicated at 702. Reversible inlet or outlet check-valve core 707 mounts inside the weldable valve body 706 in quarter turn guide track 710. The valve core 707 seals with the lower O-Ring 708, the upper O-Ring 709 is only functional when the check valve direction is reversed. The mushroom flapper valve 162 mounts on post 219 and is secure to valve core 707 by low profile post 234. The flapper valve 162 seals against valve face 217. The valve body 706 is fused directly to the raft fabric 703 at weld 704. The locking cap 712 seals the check valve against leaks. The cap 712 is attached by lanyard 714 though attachment means 713. In the lower drawing a onepiece valve body core allows ultra-low profile wide-bore inflation from a fabric coupler 705. However the one-piece weldable check valve does not allow rapid deflation since the check valve cannot be removed from the valve body.

In FIG. 48 a self orienting free floating manually actuated air horn 802 is a composite of several of the principles involved in being assure the air horn is positioned out of the water 819. Some low-pressure aerosol canisters 319 with attached air horn 801 are negative when filled and will sink if thrown into the water. The fill level of propellant 800 can be lowered so that the displacement of the gas phase 820 increases until the air horn and cylinder float or an orienting foam collar 827 can be placed that serves both bring the air horn 801 to the water's surface 196 as well to orient the air horn out of the water 819. The inherently buoyant collar 827 can be shaped so that the posterior arm 810 is shorter than the anterior arm 809 which under influence of the inherent ballast of a negative cylinder or attached orienting ballast means 316 tilts the exit of the horn up into the air. As the aerosol canister empties it becomes strongly positive and the cylinder floats on its long axis at which time the lateral flare indicated at 811 prevent the horn from rolling onto its side an submerging part of all of the horn. Contributing to the operational self-orientation of the air horn 802, the horn itself is ideally constructed from a low-density material and is as short as possible 818. Certain air horns are very long and though they have an elegant look and sound they are relegated to remain on board boat horns because the horns length and leveraged weight strongly roll the horn into a submerged position where the alerting signal fails. If both pieces of the air horn are reformed an anterior buoyant chamber 826 can be incorporate into the body of the horn 801 which in conjunction with a superior and posterior ballast means can cleanly provide a self orienting air horn 802.

Other air horns when full are buoyant and therefore only require orienting ballast to assure the air horn is positioned out of the water 819 regardless whether the canister 319 is full or empty. One solution is to enhance the separation of ballast and buoyant moments by placing a foam plug 814 in the recess of the base 812 which helps locate and secure the orienting ballast means 316. In addition the foam can extend below the ferrous band 815 at the base of the canister 319. When the air sits on the boat exposure to water quickly rusts the ring 815, which then stains fiberglass boat surfaces. In addition a skim or textured surface 817 reduce sliding as the boat rocks in the waves. Further the foam is quieter and reduces chances of scratches. Alternatively a high density ballast means 804 can be incorporated within rear of the air horn rear cover where the ballast is secure, easily mounted, and posterior of the axis of orientation.

The manual actuated, thrown MOB air horn 802 of FIG. 48 requires the valve be held in the on position. If the rear cover is modified so that an extension 805 slides over to hold the button 317 in the then the entire rear cap 803 can be cast from a higher density material to supply the self orienting ballast. The metal would also confer a sense of quality and durability appreciated by boaters. The actuator arm 805 has a stop 807 to prevent the arm from swinging past the position required to lock the horn button 317 in the on position.

When the air button 317 in FIG. 48 is pushed down it advances the push button rod 322 against the compression actuated compressed gas valve 329 allowing pressure to escape the canister and press against the oscillating membrane 900. An orifice in a rotating sleeve would allow button to be turned and thereby regulate the flow and pressure striking the membrane 900. High volume short duration signal would be available at one position in order to be heard over a loud motor but at the other position the signal volume would be reduced in exchange for a longer signal duration thus continuing to mark the site of the man over board as the vessel comes about.

Signal duration can also be achieved by use of a pulsed signal a pulse chamber in the horn or draw tube 813 has a series of check valves. The first check valve 824 has a severely restricted orifice and a cracking pressure close to the phase change pressure while the second has a very large orifice and an even higher cracking pressure. The pulse chamber 813 slowly fills then quickly empties, slow fills then quickly empties producing an irregular signal of longer duration. More sophisticated pneumatic cam valve would lead to longer periods of silence between periods of sounding.

Current air horns must be held up right or the freezing liquefied propellant is spewn under pressure from the air hom. Throwing a current air horn could bum the skin or cornea. Disclosed in FIG. 48 is a self orienting conical float 806 which supported the gas pick up inlet 821 above the liquid propellant 800. A flexible temperature stable draw tube 823 has a pick up float ballast element 822. The conical shape of the pick up float 806 keeps the gas pick up inlet out of the propellant even when the canister is nearly empty and the float is resting on its side against the side of the can.

FIG. 49 shows a range of orienting ballast means 316 for inherently buoyant canisters. In the upper left-hand drawing a lanyard 828 has a very small mount of ballast 316 attached to the end converting the lanyard into a swing arm 828. The amplified force is applied to the rear of the air horn positioning the air horn out of the water 819. A check valve 883 allows oral operation of the horn when out of propellant yet the check valve 883 prevents compressed gas from exiting when gas is available The middle drawing in the upper row of FIG. 49 a belt or pocket clip 829 to which is attached the orienting ballast 316. The upper right drawing positions the orienting ballast 316 on an inherently buoyant cylinder within the canister recess 812 to provide free floating base mounted orienting ballast 830 that positions the horn reliably above the waters surface. The lower left hand drawing of FIG. 49 places the orienting ballast 316 with the rear cap 831 while the in the lower right hand drawing the ballast is built into the cap 832. The choice is a function of cost and end use. A lanyard mounted ballast can use the ballast as a marketing medallion and be quickly accomplished while the cap contained or cap integrated have a higher up front mold costs but cannot be inadvertently removed with the resultant loss of function.

FIG. 50 shows a range of solutions for the inherently negative cylinders all of which require buoyancy and in general a small amount of ballast reduces the amount of buoyancy required to floating the air horn. A purely buoyant solution requires both net positive and oriented results. The upper left combines the asymmetric orienting buoyant collar 827 and orienting ballast 316 on the lanyard. The middle drawing enlarges the internal volume 833 of the rear cap to provide net buoyancy while placing orienting ballast 316 on the belt clip. The upper right drawing places an enlarged buoyant moment 826 with the anterior portion of the air horn and an orienting ballast moment 316 in the recessed base. The lower left-hand drawing places the requisite buoyant moment in the base recess and the ballast with the rear cap. The lower right-hand drawing places the requisite buoyancy within the anterior air horn body 826 and integrates the ballast 316 into the substance of the rear cap.

FIG. 51 demonstrates the impact of the loss of propellant 834 on the air horns position at the water's surface 196. The upper left-hand drawing is of an inherently buoyant canister full of propellant 835. The existing air horn body 839 when combined with the orienting ballast 316 and foam insert in the base orients the air horn out of the water 819. In the upper right-hand drawing of a canister ⅓ empty the buoyant conical float 806 positions the inlet 821 into the gas phase while the mobile ballast 822 slides along the flexible draw tube 823. In the lower left hand drawing a canister ⅓ full 837 continues to roll back from an inclined position towards the horizontal position as the liquid propellant is consumed. A rigid ½ length draw tube 842 has the inlet covered 843 to prevent liquefied contents from being blown out of the horn. In the lower right hand drawing the cylinder is nearly empty of propellant 838 and the conical float 806 is no longer floating but is now resting on its side where the side angle of the float is responsible for positioning the inlet 821 out of the propellant and into the gas phase. A valve lock 841 is now mounted around the anterior aspect of the horn 840 keeping the horn operating as it floats with the horn remaining out of the water 819 even now when it is 90 degrees to where it began when full of propellant.

FIG. 52 compares the use of split ballast and buoyant bases 844 on an air horn, which is negative when full 845 versus buoyant when full 846. The negative cylinder requires an enhanced foam base 847 that assists in orientation as well as providing net positive buoyancy so the horn does not sink. The amount of ballast is shown as also enhanced 849. In the buoyant air horn the inclusion of a buoyant moment is not critical but provides increased stability and reduces rust stains on the fiberglass shelves about the helm. The orienting ballast 316 however is critical to operational self-orienting at the water's surface 196.

FIG. 53 is a side view of a water activating mechanism for use with an existing air horn 857. The air horn body is seen at the top of the page at 801. The existing aerosol canister is at the bottom of the page at 319. The upper part of the insert 868 threads into the air horn body 801 at 869. The lower half of the insert body 859 is threaded onto the existing canister 319 at threads 863. Then the water sensitive bobbin 853 is placed into the lower half of the insert body and the spring loaded plunger 852 is part of the plunger plate 851 that compresses spring 850 as the lower half of the body 859 is threaded at 856 onto the upper half of the body 868. The upper half 868 and lower half 859 are sealed water tight at O-Ring 858. Opaque slide 871 also seals watertight when slid into the up position over the top of 0Ring seals 877 by sealing off the fenestrations 870. When slide 871 is in the up position, it convert air horn into a manual only mode fully protected from splash or direct down pours. When slide 871 has compressed O-Ring 877 it seals off the water activated mechanism not only from submersion but it effectively blocks the degrading effects of humidity over time on the longevity of the water sensitive bobbin 853. Since most boat horns spend 90 to 95% of their life waiting in port their active life is dramatically lengthened.

A secondary silica gel bobbin 876 further extends the life of the stored water sensitive bobbin 853 yet does not interfere in the rapidity of activation once the fenestrations 870 pass liquid water. The fenestrated upper body in FIG. 53 is painted a brilliant green to indicate that the water activating mechanism is in operation. When slide 871 is in the up or manual mode position the over body which is red is exposed alerting the operator that the water activated feature is not operational. The opaque slide 871 blocks the erroneous color coded signal. The other color coded in status signals in FIG. 53 informs the operator of the status of the water-activated bobbin 853. The upper body is clear 874 so that the status of the bobbin can be ascertained. If the bobbin is in good condition green stripes 875 painted on the side of the spring 850 cage are seen through the wall of the upper body 874. If the bobbin is spent then the plunger 852 is down and the red edges of the spring 850 are no visible through the clear upper body 874.

Use in the manual mode requires the operator push on the button 317 seen in FIG. 48. That force is transmitted through activation push rod 322 seen at the top of the FIG. 53. A nesting seat 867 mirrors the face on the valve that the push rod was designed to press upon. A transfer push rod 860 transits through the center of the water activating insert mechanism 857. When the helmsman pushes on the button that pushes rod 868 against transfer rod 860 that depresses the normally closed valve 861. Released gas passes through seal 862 and up sleeve 864 to oscillate the air horn 801 membrane. Upon release of the push button spring 866 restores the normally closed valve to the closed position.

In FIG. 53 water activator operation would begin with the unexpected water entry. If the child slips off the dock while playing in the backyard, water enters fenestrations 870 saturating bobbin 853. Water dissolves the soluble core, deteriorating the bobbins structural integrity and plunger now presses into bobbin 853. Extended plunger sleeve 855 presses upon a stop on the water activated sleeve transferring the force onto the water activated sleeve 864 which depresses and holds the valve 861 in the on position. Released gas passes through seal 862 and up sleeve 864 to oscillate the air horn 801 membrane.

In FIG. 54 the water-activated mechanism is integrated 878 into the manufacture of the air horn 801. The push rod 322 is continuous from the button at the top of the horn to the valve 861. The water activated sleeve 864 slides within a support sleeve 879 from the body of the air horn. Otherwise the structure and function is the same for the retrofit 857 of FIG. 53 and the built in mechanism 878.

In FIG. 55 is a fully assembled water activated self-orienting Man Over Board signal system 901 designed for being thrown to the mark the spot of the a victim. The integrated water activated mechanism 878 can be converted to manual mode for use as a boat horn in a downpour or for storage by sliding fenestration cover 871 over the openings in the body. Since horn 901 can be water activated, the horn can be thrown with impunity since it does not activated until it hits the water 16 where it quickly self rights due to the orienting buoyant collar 827. It clearly will not spew liquefied propellant on the operator until the water activated mechanism 878 actuates valve 329 which occurs once it is in the water 196. Of note the self orienting ballast 316 in this case has been over sized 880 to override the loss of ballast as the propellant 800 is consumed keeping the horn in a vertical position. The oversized orienting ballast 880 is contained with the canister recess 812 and requires that the buoyant collar 881 also be designed to support both the fully loaded canister 319 and oversized ballast 880.

FIG. 56 is a series of drawings depicting throwing an omni-directional air horn 882 as it somersaults through the air. The rigid half-length draw tube 842 with it inlet 821 and protective cap 843 is never submerged in the liquid propellant 800 in any position. So although the air horn is locked into the on or signaling position it does not blow liquefied contents during its flight.

As to FIG. 57, a sealed bag or box with inlet and outlet check valves which is externally framed and operated now confers upon the survivor the ability to move large quantities of air or water quickly. The life rafts of the future will supply a compressed gas platform from which vastly improved survival rafts will arise as the result of advanced design manual inflation means. The high volume cubic vacuum, siphon and hydraulic pump 922 can fill the raft then fill and empty the sea ballast chamber as indicated by occupant load or changing weather conditions. For the first time repair kits will be provided to those who may spend 5–6 months adrift.

While a large raft could have complementary attachments to affixing the four points that define the bottom plane to the raft, a small raft is likely to rely upon the outer edges of the feet. As shown in the middle left hand drawing the right toe 923, right heel 924, left toe 925 and left heel 926 define and provide external rigidity to the bellows. If there is on a single pull point at the top you have a 5-point vacuum, siphon and hydraulic pump 920. If you have two handles at the top you have a liner pull 928 and create a 6-point vacuum, siphon and hydraulic pump 921. If you have two rigid arms such as 649 from the canopy arch and a large spent cylinder you create a square upper plane. Each end creates a pull point 929, which in combination creates the external framework for the upper plane. The lower plane attached to the raft or secured by the feet and the top plane together defines an 8-point vacuum, siphon and hydraulic pump 922. The internal volume and therefore pump efficacy go up enormously as you go a pyramid 920 to an A frame 921 to a box 922 pump. A universal sleeve 932 accepts a foot or rigid arm. A pair of check valves 201 direct water or air into to fill and out to pump. When the inlet valve is up the outlet valve faces sideways 935 it is positioned to be a vacuum filled air pump and is ideal for filling, maintaining or repairing the large perimeter tube. When the outlet valve is down it can lock onto the through valve 645 in the raft floor to fill the sea ballast chamber 789 such as a second hull. The side inlet valve is connected to a tube a placed over board. After the initial priming vacuum pump a siphon is established. After the pump is sat upon to pump the seawater into the sea ballast chamber 789 the operator stands up and the siphon fills the pump for the next cycle. In an emergency the operator can pull on the upper plane while securing the lower plane to speed the filling process. Emptying the sea ballast chamber can be done by opening a port in the hull and filling sea ballast chamber with air or if the operator the valve core can be reversed in through-valve 645 and the converting the 8 point vacuum, siphon and hydraulic pump into a hydraulic pump. First part of the cycle the top plane is pulled up and water is drawn in the pump. Second the operator sits on the pump and the water flows out the outlet valve into the tube and overboard. The offshore raft freed from the constraints of compressed gas can now move to a mixed inflation raft where a compressed gas platform is provided from which point manual inflation can create massive protection from the sun wind and sea. Final pressurization can be achieved by connecting tube 931 to the outlet valve then the vacuum pump fills the collector and the inlet valve is sealed with cap 712 after removing it from its lanyard 933. Then a rigid arm from a paddle or canopy is inserted into remote hydrostatic pump sleeve 405 and the collector forced under water until the desired pounds per square inch are generated and the raft brought to full structural integrity.

INDEX OF REFERENCE NUMERALS IN DRAWINGS

1 Low profile, low volume, orally inflated compressed-gas inflator-ready convertible hybrid personal flotation device
2 Welded attachment flange for mechanically securing reversible mounting means
3 Cervical flange mounted reversible mounting means
4 Inherently buoyant PFD with integrated reversible bladder mounting means
5 Garment integrated bladder mounting means
6 Weldable flange mounting universal CO2 manifold with integrated oscillating element means
7 CO2 manifold with integrated sound board amplifier
8 CO2 manifold with integrated vibratory edge, reed or air horn diaphragm oscillator
9 Compressed gas cylinder sizing restricter sleeve
10 Water activated compressed gas inflator with integrated oscillating element and soundboard amplifier.
11 Extended duration, transducer and or manually activated, man overboard auditory, visual, radio frequency, infrared, GPS-EPIRB or other signaling system
12 Chest strap
13 Inherently buoyant PFD integrated strap retainer means
14 Bladder seam mounted short leash strap retainer means
15 Adjustable quick release chest strap buckle
16 Excess chest strap
17 Collar mounting flange
18 Garment integrated chest strap guide tube
19 Oral inflation check valve
20 Water activated compressed gas inflated transferable bladder
21 Pneumatically released collar cover splayed open
22 Garment integrated undersized bladder valise
23 Pneumatic blow apart cover closure means
24 Crico-thyroid notch
25 Self closing angle
30 CO2 Manifold
31 Threaded cap, gasket sealed, secures inflator body to CO2 manifold
32 Pressure sensor
33 Pressure switch
34 Upper CO2 manifold to inflator body gasket
35 Lower CO2 manifold to inflator body gasket
36 Direction of flow of pressurized gas from compressed gas cylinder to bladder
37 Brass CO2 manifold flange fused to weldable flange
38 Bladder fabric
39 Inflator body
40 Auditory signal
41 Optional free moving secondary vibratory element
42 High pressure zone
43 Low pressure zone
44 Mounted reed vibratory element
45 Inside of air retentive bladder
50 Convertible mandibulo-thoracic bladder
51 Pullover garment with central pneumatically releasing container for convertible mandibulo-thoracic bladder
52 Bladder integrated chest strap attachment means
53 Tensioning attachment between bladder and chest strap
54 Combined quick release and chest diameter adjustment means
55 Garment integrated chest strap retaining means
56 Combined utility pocket and front half of cover for convertible PFD bladder splayed open
57 Back half of bladder cover integrated into garment
58 Mand8bular shelf
59 Lateral cervical splints
60 One half of complementary fabric lock or zipper blow apart cover closures means
61 Complementary fabric lock or zipper blow a-part cover closures means
62 Clear indicator window to monitor
63 Reversible bladder attachment means for use in only certain of the garments to which the convertible PFD bladder mounts
70 Dual chambered, Self-closing and Self locking garment PFD with hydrostatic, pneumatic and or manually activated man over board signal system
71 Alligator fabric lock member
72 Inflatable cylindrical means
73 Loop fabric lock surrounds cylinder
74 Fabric lock welded to front and back walls before closure or stitched through bladder dead space after closure
75 Alligator baffle mounting fabric hook welded to inner face, hidden away until exposed upon inflation
76 Through bladder weld area for sewing or attachment of compression fabric lock
77 Left blow a part cover splayed open
78 Zipper bow apart bladder cover closure means
79 Open, midline closing recreational or dress jacket
80 Inflator mounted hydrostatic switch
81 Parallel hydrostatic and pneumatic switches to activate extended man over board signaling system
82 Secondary parallel perimeter weld
83 Open tube conduit for man over board switching wires
84 Secure manual on-off switch for man over board signaling system
85 Auditory signal offswitch

86 Visual signal off switch
87 Convertible bladder folded for storage
88 Pneumatic blow a-part closure means
89 Reversible mounting means for securing inflatable and inherently buoyant components of convertible hybrid personal flotation device
90 Light detector over powers visual signal during daylong hours
91 Solar panel keeps combined battery and ballast device 111 charged for 24 hour a day signaling.
97 Inflator nut mounted hydrostatic pressure switch activating remote man over board signal system
98 Pressure sensitivity adjustment means
99 Hydrostatic pressure sensor
100 Inline oscillator element means
101 Vibrating reed element
102 Tubing from remote inflator to bladder
103 Tubing coupler means
104 Thread to hose inflator adapter
105 Threaded adapter means
106 Embossed identification on restricter of specific cylinder acceptable to mount to bladder
107 16 gram compressed gas cylinder
110 Check valve integrated oscillatory means
111 Standard CO2 manifold thread mounting means
112 O-Ring seal
113 Gasket seat or Seal face means
114 Gasket seal means
115 Gasket seal mounting means
116 Cracking pressure spring means
117 Spring mounting means
118 Check valve integrated vibratory means
120 Restricting orifice prolongs inflation and prolongs vibration signal
121 CO2 manifold integrated vibratory element of dual oscillator man over board signal system
122 Check valve stop
123 Secondary bladder supplying freeboard slowly inflated, primary bladder unrestricted for rapid inflation
130 CO2 manifold threaded mount with barbed coupler and restricter valve
131 Barbed-barbed coupler with combined restricter and inline oscillator
132 Inflator stop
133 In-line over pressure relief valve means
134 Barbed-barbed over pressure relief valve
135 Gasket seal for over pressure valve
140 Combined barbed coupler, reed oscillator, check valve, air horn oscillator and weldable right angle connector
141 Weldable right angle connector flange means
142 Air horn diaphragm
143 Diaphragm tension spring
144 Directional horn resonator
145 Minimal air consumption
146 Air horn orifice restricter
148 Air horn integrated into connector
150 Primary detonation bladder located at lateral edge of the garment. Constructed of high strength fabric capable of withstanding sustained elevated psi as air is slowly passed through restricter valve providing 2–4 seconds to position the victim on their side prior to inflating the midline crossing or closer arm.
151 Inter-bladder restricter valve/port delays inflation of remainder of PFD until victim is on their side
152 Secondary Bladder, inflates to just left of garment midline, begins to apply corrective turning torque after 90 degree position achieved by primary bladder
154 Pressurized gas inflated midline crossing corrective turning mandibulo-thoracic bladder
155 Cephalo-cervical free board bladder, orally inflated or inflated by excess gas from corrective turning bladder
156 Traditional oral inflation valve means
157 Combined low profile bladder connector with integrated check valve and dust cover
158 Sharp edged orifice in rigid material to reduce freeze up from CO2
159 Weldable plastic restricter valve
160 Large orifice in fabric wall to reduce stray fabric fiber from crossing orifice
161 Fabric tube for oral inflation stows flat when deflated
162 Removable mushroom flapper valve core
163 Valve seat
164 Dust cap
165 Curve complementary to shape of lips to hold during inflation
166 Emergency blow out seam to prevent respiratory obstruction by accidental use of a garment sized to small for the wearer and fully zipped at time of inflation
167 Garment locating envelope locates initiation bladders, primary and secondary, against shoulder
168 Undersized strain relief sewn cover bears the high transient pressures developed during the first two stages of corrective turning
169 Over sized outer secondary bladder, constructed of high strength fabric or airtight weldable and flexible fabric.
170 One or more chambered, dual function, buoyant, loculated, thermal survival bag and hydrostatic collector for self inflating and inflating life raft or other chambers
171 Minimal displacement inflatable orifice of hydrostatic collector
172 Large diameter tubes of top of survival bag
173 Increased number of lower diameter tubes of bottom of thermal survival bag
174 One half of fabric tube for connecting collector to raft or back onto itself for passing pressurized air for inflation, welded together during second weld operation.
175 Combined disconnect-check valve and straight connector to bladder, which also serve as oral inflator from the outside of the bag into the air retentive chamber between the inner and outer walls
176 Alternative check valve between inner bag and surrounding inflatable chamber for use in survival bags that are not to be used as a collector for inflating some other chamber.
177 Hinge between floor and top of survival bag
178 Midpoint handles and stirrups for use as in-water hydrostatic pump collector
179 Water activated 8 gm CO2 inflator with integrated oscillatory element
180 Connect-disconnect means for inflation tube from collector to raft or survival bag
181 Hydrophobic fibers suspend within inflated survival bag to disrupt conductive and convective heat loss
182 Common perimeter inflation tube
183 Welds between inner and outer layer of bag
184 Closure weld for inner smaller bag
185 Closure weld for larger outer bag
186 Thermal survival bag reduced to half size to function as hydrostatic collector for inflating life raft.
187 Other half of bag rolled up at opening
190 Large bore one way check valve inside on the floor leading into the air retentive chamber/s of raft
191 Bow spray skirt welded closed creating collector

192 Reversible connector means consolidates raft during early collection
193 Raft handles and stirrups for hydrostatic pumping
194 Outer perimeter chamber of raft
195 Floor chamber of raft
196 Water's surface
197 Water creates seal for hydrostatic collector
198 Man Over Board/MOB
199 Partially inflated chamber
200 Self inflating raft
201 Combined weldable and reversible, check and deflate low profile wide bore valve
202 Double Z fold baffle in outer layer of raft
203 Adjustable quick release buckle
204 Outer layer of raft floor
205 Inner layer of raft floor
206 Welded patch covering stitched webbing
207 Webbing sewn through coated single side, inner fabric floor. Construction with double-coated fabric for floor allows webbing to be welded to outside face.
208 Low pressure chamber between layers of floor
209 High pressure generated by hydrostatic pump collector.
211 Excess fabric from external tension creating transient differential cut between inner and outer floors allowing air to flow from zone of higher pressure into zone of lower pressure inflating raft from entrapped air
212 Secondary differential-inner floor reduction weld
213 Excess fabric created by removing part of the fabric from the floor
214 Primary floor welds, re-registers the inner and outer layers of fabric
215 Low profile, weldable, reversible, combination inflate, deflate and locking sealed valve
216 Two part quarter turn locking pins
217 Mushroom seal face and mount
218 Finger grip for installing and removing valve core
219 Mushroom post
220 Threads
221 Threaded cap
222 Gasket for threaded cap
223 Seat for cap seal
224 Combination valve weldable flange
225 Mushroom valve guard
226 Inline valve coupler for weldable or compressible connection of fabric tube to check valve
227 Coupler gasket
228 Crimp seal gasket for mechanical fastening of non-weldable fabric or film
229 Compression means
230 Walls of fabric or extruded tube
231 Welded seal between coupler and conduit
232 Flapper guard finger grips for reversible valve core
233 Body recess for quarter turn, snap lock pins
234 Low profile mushroom post
235 Low profile finger grips an extension of mushroom valve mount
236 Lid for tube coupler
237 Gasket seal for lid
238 Integrated attachment point to secure lid when not in use as component of air tight cap
239 Quarter turn pin friction snap lock means
240 Rigid foam survival raft
241 Extended rigid keel, primary use for limited amount of rapidly expanding foam shaped by film or fabric container
242 Gluteal foam cushion and or full foam floor as dictated by cost, weight and bulk
243 Vertical baffles to square up hull bottom
244 Middle layer
245 Soft inflatable upper floor
246 Top seam indicative of construction of two layer three dimension life raft
247 Compressed liquid foam container
248 Dull barb disconnect
249 Flexible liquid foam delivery manifold
250 Longitudinal liquid foam delivery means
251 Perimeter tube liquid foam delivery means
252 Combined oral inflate and over pressure relief valve
253 Compressed gas inflatable floor
255 Inherently buoyant yoke collar style Type I Offshore Life Jacket
256 Convertible 16 gram CO2 bladder
257 Inherently buoyant yoke collar style Type II Near Shore PFD.
258 Sub-mandibular 16 gram CO2 bladder
259 Three strap Ski Vest, Type III PFD
260 Eccentric sub-mandibular 16 gram CO2 bladder
261 Exterior clear panel for integrated solar heating camp wash water
262 Middle layer light absorbing
263 Rapidly inflated/deflated sleeping mattress
264 Inflatable inner stern tube chamber as camping pillow
265 T-shirt or light weight garment
266 Lightweight fabric band, translucent
267 Bladder flange sewn to chest band
268 Left portion of light weight fabric chest band with quick release adjustable buckle
269 Quick release buckle
270 Diagonal over-the-shoulder fabric band
271 Bladder flange attachment to over shoulder fabric band
272 16 gram air way protective eccentrically buoyant self tensioning PFD
273 Marlin spike boaters knife
274 Pen light
275 CO2 and implements waist mounted pocket
276 Solar mass chamber
277 Fabric coated on one side welded on to inside of the top and or bottom layers above water line
278 Fill valve
279 Drain vent valve
280 Inflator integrated air horn
281 Spacer
282 Tense fabric air horn diaphragm
283 Generic check valve
284 Air supply valve
285 Secondary low pressure high volume perimeter tube chamber
286 Compressed gas inflated high-pressure low volume perimeter ring flotation chamber
287 Inflation valve from lower floor chamber passing through opening in upper floor
288 Over pressure relief bypass valve
289 Vertical struts supporting bathtub walls
290 One half die of a fully redundant, three dimension, personal life raft.
291 Perimeter weld of a supported or unsupported film layer which welds to either the top or bottom layer creating a low volume, high pressure compressed gas inflated three dimensional raft.
292 Secondary weld closes the top and bottom layers
293 Tertiary perpendicular closure welds converting the planar two layer air mattress into a vertically enclosed raft
294 Primary high pressure compressed gas chamber created from a welding middle layer to inner or outer layer

295 Side wall tubes of the rapidly deployed raft inflated from compressed gas
296 One-person triangular raft created with three perpendicular vertical welds
297 Two person life raft created from four perimeter tubes/four perpendicular vertical welds.
298 Three person raft with larger bow tube
299 Bow tube creates additional width forward.
300 Tubes of diverse morphology can abut in a two layer raft welded in two planes
301 Tapered side tubes terminate against straight tubes
302 Straight bow tube
303 Large diameter straight stern tube abuts smaller diameter side wall tube
304 Cross compatible polyurethane to polyvinyl fittament strips constructed of polyether or
polyester or similar cross reactive plastic bridge tape
305 Polyvinyl zip lock storage bags
306 Cross compatible polyurethane to polyvinyl fittament strips
307 Polyurethane zip lock closure on fabric supported film
310 Manifold nut mounted oscillator
311 360 degree adjustable adapter
312 Threaded female coupler integrated into existing air horn
313 Threaded adapter
314 Gasket sealing adapter to modified CO2 manifold cap
315 Modified manifold cap to pass and seal air horn adapter
316 Orienting ballast means
317 Manual air horn button
318 water activated air horn actuator
319 Low pressure aerosol canister
320 Extended duration self-orienting water activated garment mounted or thrown man over board signal system
321 Release means for oral use of air horn
323 Inclined self-draining horn
324 Buoyant chamber
325 Pressure regulator
326 Vented submersion chamber
327 Attachment means
328 Nut securing inflator to air horn supply line
329 Air horn supply line
330 Locking/ejecting quarter turn, manual, water activated or hydrostatic inflator
331 Ejection spring
332 Piercing pin
333 Adhesive thread to quarter turn pin adapter
334 Threaded compressed gas cylinder
335 Crimped sealed cylinder to quarter turn adapter
336 Crimped compressed gas seal
337 Crimp sealed compressed gas cylinder
338 Quarter turn pin integrated into cylinder structure
340 Compressed gas cylinder of any seal type
341 Quarter turn ejection spring
342 Compression seat and seal for cylinder
343 Combined inflator and cylinder housing body
344 Quarter turn cap
345 Quarter turn pin recess
346 Quarter turn pin
347 Crimped cap compressed gas cylinder
348 Extended cap to accommodate longer compressed gas cylinder
349 Longer compressed gas cylinder
350 Universal inflator base quarter turn connector
351 Cylinder specific quarter turn housing
352 Ejection spring plate
353 Ejection Spring
354 Largest compressed gas cylinder for a given neck diameter that will fit inflator
355 Smaller compressed gas cylinder
356 Quarter turn housing adapted to match cylinder to inflator's universal connector
357 Compression gasket stop
359 Status warning indicator, color, symbol and word
360 Indicator window in cylinder housing
370 Triangulating rigid stirrup or foot brace
371 Torque pump
372 Pedal brace attachment outside air retentive collector
373 Excess fabric outside weld
374 Pressure gradient
375 Torque pump collector
376 Collector air tight weld line
377 Drogue Torque pump with in-line fabric coupler
378 Stuff sack torque pump with long neck collector
379 Power torque pump combines a lever arm amplified torque pump and rigid arm hydrostatic pump
380 Chemically switched audible oscillator and transmitter
381 Ionic conductor switch and status indicator strip, powdered crystalline-salt impregnated hydrophilic cellulose
382 Air vent fenestration in interior cover of immersion chamber
383 Water proof clear window
384 Inferior louvered fenestration's in exterior cover
385 Splash protected chemical switch immersion chamber
386 Electrical contacts
387 Battery pack and combined orientation ballast for splash protection and transmitter float
388 Battery and circuitry test switch
389 Sealed circuitry, low battery, transmitter and oscillator, contribute additional orienting ballast
390 Transmitter ballast mounts
391 Electronic Oscillator marking immersion or low battery
392 Antenna
393 Sealed buoyant cell and sound box?
394 Eyelet
395 360 degree swivel attachment means
396 Lanyard
397 Attachment means
398 Remote receiver base with multi-modality alarm
399 Base station oscillator alarm
400 Ionic conductor switch pedestal mount
401 Ionic switch retainer
402 Offset cross ventilation/flooding
403 Sealing cap lanyard attachment means
404 Inner nesting rigid-arm hydrostatic pump sleeve
405 Outer nesting or single rigid-arm hydrostatic pump sleeve
406 Reinforced paddle pump sleeve to torque pump body attachment
407 Heavy duty lever arm orifice flange
408 Heavy duty inner strain dispersal means
409 Perimeter re-enforcement means
410 Remote ionic switch activated inflator
411 Solenoid
412 Cam amplified latch-release of spring driven piercing pin
414 Hardwired ionic switch activated automatic inflator
415 Variable delay adjustment means
416 Kill/reset switch
417 Hardwired ionic switch
418 Spring driven piercing pin
419 Compressed gas cylinder
429 Rapid-expanding rapid-set two part compressed liquid foam

430 Dual chambered compressed gas and compressed liquid foam inflated PFD
431 Oral inflatable back up chamber alternatively serving as a foam-forming chamber for shaping installed liquid foam
432 Hinge divider for liquid to rigid foam chamber
433 Liquid foam manual release means
434 Oral or compressed gas inflated PFD
435 Liquid foam manifold part of weldable barbed connector
436 Large bore delivery line
437 Small bore delivery line
438 Multiple instillation ports
439 ¼" perforated soaker tubing vented through over pressure relief valve
440 Compressed liquid foam inflated PFD
441 Water activated compressed gas and manual liquid foam PFD
442 Dual chamber PFD one chamber compressed gas PFD and other chamber water or manually activated PFD
443 Combined water activation of dual medium compressed gas and compressed liquid foam PFD
444 Reversible attachment means for compressed liquid foam cylinder to common water activation means
445 Quick change water activation means for compressed liquid foam canister
450 Garment integrated, dual chambered, water actuated dual medium PFD
451 Single use 16 gm CO2 gas inflated bladder and liquid foam forming bladder
452 In line foam arrest restricter fitting
453 Quick change, locking, quarter turn inflator assembly
454 Quick disconnect inter-bladder over pressure relief valve
455 Freeboard chamber inflated with displaced re-cycled compressed gas displaced from corrective turning bladder.
456 Oral inflate over pressure relief valve
460 Single position, quick change CO2 inflator body
461 Solid top of CO2 manifold
462 Exterior locking retaining ring
463 Recess for locking clip
464 Check valve stop
465 Check valve seal gasket
466 Check valve plate
467 Spring tension forcing plate against gasket
468 Check valve body
469 Internal locking retaining ring
470 CO2 manifold key
471 Inflator body key way
472 Inflator body seat
480 Transceiver, locator, emergency alarm and man over board signal system
481 Transmitter, water-current detector, switch amplifying circuitry and transmitter, locator receiver, manual and low voltage battery test, alarm transmitter and voice receiver circuitry
482 Battery test and emergency alarm
483 Oscillator for locator, alarm, immersion in water, battery test
484 Sealed miniature transceiver
485 Single use manufactured ionic alarm activation and deactivation switch module
486 Switch module contacts with power and transceiver
487 Waterproof enclosure for oscillator
488 Cathode and anode sandwich of salt impregnated absorbent, agar, gel, or cellulose matrix
489 Recess in sealed transceiver body
490 Sealed reset button for locator and alarm functions
491 Remote locator button
500 Reusable, end cap integrated fluid-switch for activation and mechanical deactivation of water entry alarm
501 Insulated switch leads
502 Non-corroding electrodes
503 Splash protected water immersion chamber
504 Splash diversion chamber with high, low and cross ventilation or drainage ports as determined by orientation
505 Distance between electrodes is greater than maximum diameter of droplet that can form as determined by water surface tension
506 Power supply lead from battery to switch transistor
507 Resistor R1 accommodates electrode material and distance apart to adjust Low voltage leg from water conduction switch includes circuit determined resistor R1 supplying power to gate of switch transistor
508 Q1 Switch Transistor determined by voltage of system gate selected by water conduction voltage
509 Power supply to battery test switch
510 Normally open temporarily closed cap integrated switch to test battery and operation of man over board alarm
511 Power supply from test switch to oscillator
512 Battery
513 Body of MOBS
514 Normally closed temporarily open reset switch
515 Reusable water actuated auditory alarm
516 Disposable ion enhanced water actuated auditory alarm
517 Waterproof flashlight with integrated water actuated multi modal alarm
518 Water proof flashlight with integrated visual, electronically enhanced auditory, and RF transmitted water emergency alarm means
519 Single use cap with integrated ionic switch
520 Light bulb
521 Manual quarter turn switch for use of flashlight
522 Fluid switched power supply actuating both visual and auditory signals
523 Electronically enhanced auditory volume, stroboscopic visual alarm and RF actuated remote man over board signal
524 Normally open temporarily closed manually operated compression switch
525 Power supply return conductor to battery
526 Indicator status marker identifies if cap is in the on position
527 Water conduction switch, normally open
528 Insulation
529 Continuous water switch compression contact
530 Semi-conductive electrode total exposed surface area and coating sufficient to integrate resistance required for safe operation of transistor Q1 gate.
531 Oscillator power amplification and RF transmitter broadcasting to pre-existing baby monitor station of submersion in water
532 Buoyant lanyard, conductor and antenna
533 Garment attachment means
534 Normally open alarm test switch currently in the temporarily closed position
535 Power supply to test switch
536 Power supply from test switch to oscillator and transmitter
537 Buoyant bumble bee body
538 Sound passage grille
539 Toddler water immersion alarm
540 Light Emitting Diode ("LED")
541 LED socket

542 Manual On-Off, Compression switch
543 Compression shelf
544 Single point or hemi-circular water switch contacts
545 Compression contacts
546 Parabolic reflector built into LED socket and circuitry housing
547 Photo sensor strobe switch
548 MOBS LED emergency light
549 Filamentous LED leads
550 Spring continuous battery connector and upward force pushing LED housing away from compression shelf
551 Flashlight globe threaded to flashlight housing
552 Led housing lip engages lip on globe to operate compression switch 542
553 LED housing contacts
554 Batteries and LED housing in continuous contact
555 Platinum catalyst
556 LED Body
557 1.5 volt reduced power supply to water conduction switch
558 Three person bow tube
560 Body armor dry suit with reversibly mounted inflatable PFD
561 Mechanical attachment flange welded out of single or double-coated fabric from body of dry suit
562 Mechanical attachment flange sewn through collar seal before gluing to dry suit
563 Interior welded patch sealing perforating stitching and zipper lock mount
564 Mounting flange welded or glued to exterior
565 Enlarged complementary perpendicular eye lock integrated into zipper pull
566 Reversible PFD mounting means
567 Handle of manual activation of compressed gas inflation means
568 Blow a part cover closure means
569 Seam between water seal collar and dry suit
570 Dry suit water seal collar
571 Dry suit
572 Gun butt zone of military dry suit
573 Body armor exterior to dry suit
574 Cover securing stowed PFD
575 Secure quick release zipper pull lock in release position
576 Dual compression stowed inflatable PFD
577 Zipper pull lock in locked position
578 PFD inflation cylinder of compressed gas and puncture sealant
580 Pressurized variable displacement raft with ballasting water keel
581 Mobile ballasted gravity located draw tube
582 Permanently attached ballast with cutting barbs
583 Gas lumen
584 Fluid lumen
585 Draw tube in-port marking on raft floor
586 Protected rain water for drinking/washing
587 Integrated flexible fabric canteen
588 Oversized CO2 cylinder
589 Full floor sea ballast chamber
590 Single pump self-inflating Heat Escape Lessening Position/HELP raft
591 Box collector with rigid opening and 8 vertical pneumatic struts
592 Very efficient internal volume per square foot of material
593 Square outline
594 No inner to outer layer floor baffle welds
595 Thermal gluteal cushion chamber
596 Minimal volume reducing baffle welds between inner and outer layers
597 Billowing and enveloping high volume walls
598 Deep side walls
599 Width
600 Manually inflated high volume lower perimeter tube and floor chamber
601 Hydrostatic pump handles
602 Elevated stern back support
603 Radar, thermal and solar reflective, detachable cover
604 Pneumatic canopy arches
605 Locking oral inflation valve
606 Reversible canopy mounting means
607 Anti-emesis clear view port
608 Dual opening cross ventilating side panels
609 Gluteal applique on inside of inner layer
610 Adjustable volume of sea ballast
611 Sea ballast drain vent
612 Sight tube
613 Releasable sight tube retaining strap
614 Locking water ballast drain cap
615 Contained air-water interface
616 Locking cap on variable over pressure relief valve and pneumatic vent
617 Pressurized variable displacement component and first gaseous conductive barrier
618 Vent and valve pass through gluteal cushion
619 Internal permanently mounted draw tube
620 Dual lumen right angle connector with integrated draw tube
621 Combined Over Pressure Valve and manual inflate-deflate air vent
622 Pressurized or vacuum delivered fluid
623 Bi-directional dual locking sharp barbed coupler
624 RF welded flange
625 RF welded tube locator fittament
626 Integrated sharp barb
627 Single lumen right angle connector with integrated draw tube stop
628 Locking inflate-deflate and liquid draw tube valve
629 Draw tube insertion stop
630 Void in baffle between inner layer to outer layer of raft
631 The distance the handle is inset form the outer perimeter
632 Length of the side wall mounting the handle
633 Single chamber HELP raft with floor applique
634 Compressed gas chamber designed to hold 16 gm of CO2 the balance being manually inflated
635 Compressed gas chamber designed to hold 38 gm of CO2 the balance being manually inflated
636 Compressed gas chamber designed to hold 320 gm of CO2 the balance being manually inflated
637 Check valve across inner wall of the hydrostatic collector operated by pressure gradient passing pressurized air between collector and the inside of the raft
638 Check valve connecting inside of collector or raft with inside of inflatable gluteal cushion.
639 Mark on raft floor indicating location of full floor sea ballast drain vent
640 Second split lumen draw tube accessing lower full floor chamber
641 Mark locating fixed inlet of draw tube on the lower floor chamber
642 Lock open-lock closed drain valve
643 Welded recessed connector
644 Stirrups or wrist lanyards
645 Through welded large bore valve to lower/second floor
646 Large bore right angle connector

647 Permanently attached quarter turn locking coupler
648 Attached quarter turn locking and O-ring sealed cap
649 Reinforced lever arm torque pump handle, section of canopy support and fishing pole
650 Solar charged power pack
651 1.5 Volt
652 3.0 volt
653 6.0 volt
654 9.0 volt
655 12.0 volt
656 Charging diode and electronic buffering
657 Multi-headed jack selection permanently mounted
658 Water proof cap for jacks
659 Selection of jacks to match existing equipment
660 Female receptacle in multi-modal remote man over board signal means
661 Jack receptacle waterproof plug
700 Quarter turn combined, weldable, reversible, check and deflate low-profile wide-bore valve
701 Weldable film or laminate walls of tube to or body of hydrostatic, torque, or windsock pump
702 To body of pump collector
703 Fabric wall of raft
704 Weld between valve body and weldable film or laminate of raft wall
705 Locking quarter turn low-profile high-bore fabric coupler
706 Weldable valve body
707 Reversible inlet and outlet check valve core also serves as a removable large bore locking deflate port.
708 Functional inlet O-Ring
709 Non-functional outlet O-Ring seal broken when O-ring crosses over quarter turn track in valve body
710 Internal vertical quarter turn track for valve core
711 External vertical quarter turn track for fabric coupler
712 Quarter turn O-ring sealed cap
713 Lanyard attachment means
714 Air tight cap lanyard
715 Perforated or spent CO2 cylinder as short lever arm
716 6 foot length of tubing
717 Complementary quarter turn locking coupler connecting tube hydrostatic pump and raft
718 Triangulating corners of fabric stirrup rigidified by feet
719 Triangulating corners of fabric base rigidified by attachment to raft, cylinder, paddle
720 Reversible rigid base mounting means
730 Single piece weldable valve body and check valve core
750 Variable-displacement variable-ballast 1 to 20 person life raft
751 Amount of contained sea ballast inversely proportional to the amount of buoyant displacement in full floor chamber
752 Variable amount of contained ballast or contained buoyancy in full floor chamber of life raft
753 100% sea ballast 0% air displacement
754 75% sea ballast 25% air displacement
755 25% sea ballast 75% air displacement
756 10% sea ballast 90% air displacement
757 100% ballast or buoyancy
758 50% ballast or buoyancy
759 25% ballast or buoyancy
760 0% ballast or buoyancy
770 Two layer, single chamber, 3 dimension life raft
771 Two layer Two Chambered Full Floor Variable Volume Life Raft/VVLR
772 Partial three layer three chamber dual floor variable volume life raft/vvlr
773 Full three layer, dual-hulled variable volume life raft
774 Single chamber fixed displacement raft 100% of internal volume air at 1.5 psi
775 Single chamber fixed displacement raft 85% of internal volume air and 15% of internal volume air ballast at 1.5 psi
776 Single chamber fixed displacement raft 70% of internal volume air and 30% of internal volume air ballast at 1.5 psi
777 Dual chamber variable-displacement raft with floor chamber deflated and perimeter tube at 1.5 psi.
778 Dual chamber variable-displacement raft with floor chamber 15% inflated with air and perimeter tube at 1.5 psi.
779 Dual chamber variable-displacement raft with floor chamber 25% inflated with air and perimeter tube at 1.5 psi.
780 Dual chamber variable-displacement raft with floor chamber 15% filled with water and perimeter tube at 1.5 psi.
781 Dual chamber variable-displacement raft with floor chamber 25% filled with water and perimeter tube at 1.5 psi.
782 Dual chamber variable-displacement raft with floor chamber 15% filled with air and 15% filled with water and perimeter tube at 1.5 psi.
783 Partial three-layer three-chamber variable-displacement raft with full floor chamber filled 25% with air
784 Partial three-layer three-chamber variable-displacement raft with full floor chamber filled 25% with water
785 Partial three-layer three-chamber variable-displacement raft with full floor chamber filled 15% with air and 15% with water
786 Full three-layer three-chamber double-hulled variable-displacement raft with second hull 25% full of air
787 Full three-layer three-chamber double-hulled variable-displacement raft with second hull 80% full of air
788 Upper floor chamber
789 Lower floor chamber
790 Double hull chamber
791 Fixed displacement structurally distinct perimeter tube
792 Through weld of connector accessible on the floor to the lower chamber
793 Middle layer must be film or fabric laminated on both sides Index for MOBS Air Horn

FIG. 1

316 Orienting ballast means
317 Manual air horn button
319 Low pressure aerosol canister
322 Push button rod
324 Buoyant chamber
329 Compression actuated compressed gas valve
800 332 Propellant
801 333 Airhorn
802 400 Composite of means to orient a manually activated signaling air horn
803 401 Rotating high density/keeling rear cap
804 402 Internal high density keeling means
805 403 Push button actuator arm maintains normally open valve in closed position
806 404 Self orienting buoyant and conical gas vent platform
807 405 Stop for push button actuator arm
808 406 Flow regulation of loud versus long duration MOBS

809 407 Length of anterior arm inversely proportional to amount of keeling ballast
810 408 Short posterior arm complements horn out of water rotation
811 409 Flared lateral buoyant moment orients horn out of water
812 410 Recess in bottom of canister
813 411 Pulse chamber
814 412 Low density or buoyant anterior means
815 413 Ferrous band
816 414 Non-rusting base
817 415 Non-skid surface
818 416 Short low-density horn
819 417 Air Horn positioned out of the water
820 419 Gas just below liquification pressure
821 420 Gas pickup oriented into gaseous zone
822 421 Pick up float ballast component
823 422 Flexible, temperature stable draw tube
824 423 Cracking pressure close to ambient pressure with high back pressure
825 424 Second inline pressure relief valve with zero psi back pressure
826 425 Orienting buoyant chamber built into anterior air horn
827 426 Orienting buoyant foam collar
FIG. 2 Orienting Buoyant Air Horn/AH
828 430 Swing arm/lanyard mounted orienting ballast/keel
829 431 Belt or pocket clip mounted orienting ballast
830 432 Base mounted orienting ballast
831 433 Cap enclosed orienting ballast
832 434 Cap integrated orienting ballast
FIG. 3 Orienting Negative Air horn
833 440 Increased displacement rear cap
FIG. 4 Changing Buoyant Moment
834 450 Impact of lost of propellant on air horn orientation
835 451 Cylinder full of liquid propellant
836 452 Cylinder ⅓ empty of liquid propellant
837 453 Cylinder ⅔ empty of liquid propellant
838 454 Cylinder nearly completely empty of liquid propellant
839 455 Original low-density rear ½ of the air horn
840 456 Mounting means valve lock
841 457 Rigid valve lock means secures valve in on position
842 458 Rigid half length draw tube
843 459 Draw tube vented cover
FIG. 5 Orienting Base
844 470 Split ballast and buoyant moment air horn bases
845 471 Air horn negative when full
846 472 Air horn buoyant when full
847 473 Base supplying orientation and net positive displacement
848 474 Base supplying only orientation
849 475 Increased orienting ballast to balance positive displacement buoyancy
FIG. 6
850 323 Spring
851 324 Spring compression plate
852 325 Spring loaded plunger
853 326 Water sensitive bobbin
854 327 Canister threaded stem
855 328 Extended plunder sleeve
856 329 Aerosol valve actuator
857 350 Retrofit water activating insert
858 351 Existing airhorn
859 352 Existing aerosol canister
860 353 Transfer manual push rod
861 354 Normally spring closed valve
862 355 Canister outer seal to water activated sleeve
863 356 Canister to Insert threads
864 357 Water activated sleeve
865 358 Water activated sleeve transfer stop
866 359 Fenestrated air passage
867 360 Transfer push rod seat
868 361 Original air horn manual push rod
869 362 Water activating insert to existing air horn threaded connector
870 363 Fenestration of bobbin chamber
871 364 Opaque dual position fenestration cover
872 365 Red color indicating immersion chamber closed
873 366 Green color indicating immersion chamber open to water
874 367 Transparent cover
875 368 Red Indicates canister spent
876 369 Water sensitive bobbin indicator Sleeve
877 370 O-Ring sealed when closed extending water sensitive bobbin life during storage
FIG. 7 Integrated water activated air horn
878 380 Integrated water activated air horn
879 381 To manual button at top of air horn
FIG. 8
880 382 Oversized ballast overrides loss of liquid ballast
881 383 Oversized buoyant moment supports full cylinder and oversized ballast
FIG. 9
882 384 Omni-positional operation of liquefied gas air horn
FIG. 10
883 336 Oral operation check valve
884 500 Self orienting manual, locked manual and auto MOBS device
885 501 Fluted high surface area radiator body
886 502 Flared buoyant orienting body
887 503 Quarter turn manual and locking manual valve push button
888 504 Quarter turn pin on locking manual button
889 505 Pressurized chamber
890 506 Paper wafer
891 507 Paper wafer protected Schrader valve
892 Keeling high-density water activating mechanism
893 508 Spring tensioned Schrader driver
894 509 Manual Schrader valve
895 510 Cylinder specific shim ballast
896 511 Pivoting/directional air horn
316 Orienting ballast means
317 Manual air horn button
319 Low pressure aerosol canister
322 Push button rod
324 Buoyant chamber
329 Compression actuated compressed gas valve
800 Propellant
801 Air horn
802 Self-orienting, free floating manually activated Man Over Board signaling air horn
803 Rotating high density/keeling rear cap
804 Internal high density keeling means
805 Push button actuator arm maintains normally open valve in closed position
806 Self orienting buoyant and conical gas vent platform
807 Stop for push button actuator arm
808 Flow regulation of loud versus long duration MOBS
809 Anterior arm
810 Short posterior arm complements horn out of water rotation
811 Flared lateral buoyant moment orients horn out of water
812 Recess in bottom of canister

813 Pulse chamber
814 Low density or buoyant anterior means
815 Ferrous band
816 Non-rusting base
817 Non-skid surface
818 Short low-density horn
819 Air Horn positioned out of the water
820 Gas phase
821 Gas pickup inlet oriented into gaseous zone
822 Pick up float ballast component
823 Flexible, temperature stable draw tube
824 First check valve with very small bore passage and a valve cracking pressure close to ambient pressure with high back pressure
825 Second inline pressure relief valve with large bore valve and zero psi back pressure/rapid dump and close
826 Orienting buoyant chamber built into anterior air horn
827 Orienting buoyant foam collar
828 Swing arm/lanyard mounted orienting ballast
829 Belt or pocket clip mounted orienting ballast
830 Base mounted orienting ballast
831 Rear cap enclosed orienting ballast
832 Cap integrated orienting ballast
833 Increased displacement rear cap
834 Impact of loss of propellant on air horn orientation
835 Cylinder full of liquid propellant
836 Cylinder ⅓ empty of liquid propellant
837 Cylinder ⅔ empty of liquid propellant
838 Cylinder nearly completely empty of liquid propellant
839 Original low-density rear ½ of the air horn
840 Mounting means valve lock
841 Rigid valve lock means secures valve in on position
842 Rigid half length draw tube
843 Draw tube vented cover
844 Split ballast and buoyant moment air horn bases
845 Air horn negative when full
846 Air horn buoyant when full
847 Base supplying orientation and net positive displacement
848 Base supplying only orientation
849 Increased orienting ballast to balance positive displacement buoyancy
850 Red edged spring
851 Spring compression plate
852 Spring loaded plunger
853 Water sensitive bobbin
854 Canister threaded stem
855 Extended plunder sleeve
856 Spring compression threads
857 Water activating mechanism for use with an existing air horn
858 O-Ring seal between upper and lower body halves
859 Lower half of water activated body, bobbin housing
860 Transfer manual push rod
861 Normally closed valve
862 Canister outer seal to water activated sleeve
863 Canister to Insert base threads
864 Water activated sleeve
865 Water activated sleeve transfer stop
866 Aerosol valve closure spring
867 Transfer push rod seat
868 Upper half of water activated body
869 Water activating insert to existing air horn threaded connector
870 Fenestration of bobbin chamber
871 Opaque dual position fenestration cover
872 Red color indicating immersion chamber closed
873 Green color indicating immersion chamber open to water
874 Transparent cover
875 Green stripes indicates canister spent
876 Silica gel bobbin
877 O-Ring for fenestration cover
878 Integrated water activated air horn
879 To manual button at top of air horn
880 Oversized ballast overrides loss of liquid ballast
881 Oversized buoyant moment supports full cylinder and oversized ballast
882 Omni-positional operation of liquefied gas air horn
883 Oral operation check valve
900 Oscillating membrane
901 Water activated self righting thrown Man Over Board Signal
910 Real time convertible automatic-manual compressed gas inflator
911 Lack of lower cross venting which is present here on current 6F inflator
912 O-Ring sealed piercing plunger
913 Lanyard for manual levered pierce means
914 Lack of vents in top of cap
915 Piercing plunger
916 Rivet
920 5 point vacuum, siphon and hydraulic pump
921 6 point vacuum, siphon and hydraulic pump
922 8 point vacuum, siphon and hydraulic pump
923 Toe right foot
924 Heel right foot
925 Toe left foot
926 Heel left foot
927 Single point pull
928 Linear 2 point pull
929 One corner of a planar 4 point pull
930 Siphon Sea ballast pump
931 Siphon hose for sea ballast pump
932 Universal foot or rigid arm sleeve
933 Releasable cap lanyard
934 Siphon and hydraulic pump orientation
935 Vacuum pump orientation
936 Externally framed billows pump
950 Gravity drogue sea ballast pump
951 Gravity filled sea ballast chamber It should be recognized that all values, ranges, dimensions, percentages, sizes, etc. all given in approximates.

Some of the advantages and characteristics for of the present invention, include, but are not limited to, (a) one of more chambers, floors or hulls whose contents can be adjusted; (b) one of more chambers, floors or hulls whose contents can be 0 to 100% gas; (c) one of more chambers, floors or hulls whose contents can be 0 to 100% liquid; (d) one of more chambers, floors or hulls whose contents can be any ratio of air to water; (e) two or more variable volume chamber, floors or hulls to separately store rain water from sea water ballast; (f) one of more chambers, floors or hulls primarily inflated or secondarily filled with expanding foam; (g) fabric torque pump with rigid triangulating base; (h) stirrup for fixing and triangulating base of torque pump; (i) reversible attachment for fixing and triangulating base of torque pump to raft; (j) rigid lever arm force amplified torque pump; (k) torque pump collector for gathering, holding and transferring drinking water or sea ballast; (l) torque pump collector with lanyards for attaching as passive steering drogue; (m) one or more chambers of raft serving as hydration chambers; (n) single lumen fluid draw tube connector; (o) dual lumen fluid draw tube combined with gas vent; (p) one or more raft chambers providing inflatable mattress and pillow; (q) one or more insulated chambers of raft for water as solar mass; (r) self-righting air horn; (s) self-orienting air horn; (t) ballast integrated into air horn, onto aerosol canister or attached to posterior lanyard for orienting horn out of the water; (u) buoyant means attached to establish net positive buoyancy; (v) buoyant means attached to orient horn out of the water; (w) sealed chamber integrated into air horn construction to buoy and orient horn out of the water; (x) rapidly convertible water activated to waterproof compressed gas actuator; (y) rapidly inter-convertible manual automatic inflator; (z) sliding water tight fenestration cover; (aa) integrated humidity and water proof storage means; (ab) signaling means indicating operational status of water sensing mechanism; (ac) water activated mechanism inserted between existing air horn and aerosol canister; (ad) water activated mechanism integrated into construction of air horn; (ae) integrated storage means to protect the water sensitive bobbin; (af) manually locked aerosol actuator means; (ag) volume versus duration flow-pressure regulated air born signal; (ah) intermittent air horn signal; (ai)

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A combination inflator and manifold assembly, comprising:

a manifold having a body member, said manifold body member having a closed first outer end, a gas inlet opening and an open second end, said body member defining an internal passageway, said gas inlet opening in communication with said internal passageway, said manifold body member having a mounting flange for attachment to a bladder fabric;

an inflator having a body member, said inflator body member having an gas outlet opening, said inflator disposed over a stem portion of said manifold body member, means for creating a seal between said inflator body member and said manifold body member;

means for securing said inflator body member to said manifold body member, and means for properly aligning said inflator body member with said manifold body member when securing said inflator to said manifold;

wherein said means for creating a seal comprises a first o-ring seal disposed between said inflator body member and said manifold body member on a first side of said gas inlet passageway and a first corresponding side of said gas outlet passageway and a second o-ring seal disposed between said inflator body member and said manifold body member on a second side of said gas inlet passageway and a second corresponding side of said gas outlet passageway.

2. The combination inflator and manifold assembly of claim 1 wherein said inflator body member comprises a first exterior annular groove located on the first corresponding side of said gas outlet passageway and a second exterior annular groove located on the second corresponding side of said gas outlet passageway, wherein said first o-ring is disposed within said first exterior annular groove and partially protrudes outward therefrom and said second o-ring is disposed within said second exterior annular groove and partially protrudes outward therefrom.

3. A combination inflator and manifold assembly, comprising:

a manifold having a body member, said manifold body member having a closed first outer end, a gas inlet opening and an open second end, said body member defining an internal passageway, said gas inlet opening in communication with said internal passageway, said manifold body member having a mounting flange for attachment to a bladder fabric;

an inflator having a body member, said inflator body member having an gas outlet opening, said inflator disposed over a stem portion of said manifold body member, means for creating a seal between said inflator body member and said manifold body member;

means for securing said inflator body member to said manifold body member, and means for properly aligning said inflator body member with said manifold body member when securing said inflator to said manifold;

further comprising a check valve disposed within said internal passageway of said manifold body member approximate to the second open end of said manifold body member.

4. A combination inflator and manifold assembly, comprising:

a manifold having a body member, said manifold body member having a closed first outer end, a gas inlet opening and an open second end, said body member defining an internal passageway, said gas inlet opening in communication with said internal passageway, said manifold body member having a mounting flange for attachment to a bladder fabric;

an inflator having a body member, said inflator body member having an gas outlet opening, said inflator disposed over a stem portion of said manifold body member, means for creating a seal between said inflator body member and said manifold body member;

means for securing said inflator body member to said manifold body member, and means for properly aligning said inflator body member with said manifold body member when securing said inflator to said manifold;

wherein said means for securing is a locking ring or spring clip partially disposed within a recess on said inflator body member and partially disposed within an exterior annular groove disposed on said manifold body member approximate to the closed first end of said manifold body member.

5. A combination inflator and manifold assembly, comprising:

a manifold having a body member, said manifold body member having a closed first outer end, a gas inlet opening and an open second end, said body member defining an internal passageway, said gas inlet opening in communication with said internal passageway, said manifold body member having a mounting flange for attachment to a bladder fabric;

an inflator having a body member, said inflator body member having an gas outlet opening, said inflator disposed over a stem portion of said manifold body member, means for creating a seal between said inflator body member and said manifold body member;

means for securing said inflator body member to said manifold body member, and means for properly aligning said inflator body member with said manifold body member when securing said inflator to said manifold;

wherein said means for properly aligning said inflator body member with said manifold body member comprises a shaped pattern disposed at a base area of said manifold body member and a corresponding shaped bottom area of said inflator body member.

6. The combination inflator and manifold assembly of claim 5 wherein only one position of said inflator body member on said manifold body member permits the shaped pattern on said base area to properly mate with the corresponding shaped bottom area of said inflator body member.

7. The combination inflator and manifold assembly of claim 6 wherein said when said inflator body member is properly mated with said manifold body member said gas outlet passageway of said inflator body member is properly aligned with said gas inlet passageway of said manifold body member to permit a substantial portion of gas leaving said outlet passageway to enter said gas inlet passageway and into said internal passageway of said manifold body member and ultimately into an associated inflatable bladder.

8. The combination inflator and manifold assembly of claim 1 wherein only one position of said inflator body member on said manifold body member permits the shaped pattern on said base area to properly mate with the corresponding shaped bottom area of said inflator body member.

9. The combination inflator and manifold assembly of claim 8 wherein said when said inflator body member is properly mated with said manifold body member said gas outlet passageway of said inflator body member is properly aligned with said gas inlet passageway of said manifold body member to permit a substantial portion of gas leaving said outlet passageway to enter said gas inlet passageway and into said internal passageway of said manifold body member and ultimately into an associated inflatable bladder.

10. The combination inflator and manifold assembly of claim 3 wherein only one position of said inflator body member on said manifold body member permits the shaped pattern on said base area to properly mate with the corresponding shaped bottom area of said inflator body member.

11. The combination inflator and manifold assembly of claim 10 wherein said when said inflator body member is properly mated with said manifold body member said gas outlet passageway of said inflator body member is properly aligned with said gas inlet passageway of said manifold body member to permit a substantial portion of gas leaving said outlet passageway to enter said gas inlet passageway and into said internal passageway of said manifold body member and ultimately into an associated inflatable bladder.

12. The combination inflator and manifold assembly of claim 4 wherein only one position of said inflator body member on said manifold body member permits the shaped pattern on said base area to properly mate with the corresponding shaped bottom area of said inflator body member.

13. The combination inflator and manifold assembly of claim 12 wherein said when said inflator body member is properly mated with said manifold body member said gas outlet passageway of said inflator body member is properly aligned with said gas inlet passageway of said manifold body member to permit a substantial portion of gas leaving said outlet passageway to enter said gas inlet passageway and into said internal passageway of said manifold body member and ultimately into an associated inflatable bladder.

14. The combination inflator and manifold assembly of claim 1 wherein said means for securing is a locking ring or spring clip partially disposed within a recess on said inflator body member and partially disposed within an exterior annular groove disposed on said manifold body member approximate to the closed first end of said manifold body member.

15. The combination inflator and manifold assembly of claim 3 wherein said means for securing is a locking ring or spring clip partially disposed within a recess on said inflator body member and partially disposed within an exterior annular groove disposed on said manifold body member approximate to the closed first end of said manifold body member.

16. The combination inflator and manifold assembly of claim 5 wherein said means for securing is a locking ring or spring clip partially disposed within a recess on said inflator body member and partially disposed within an exterior annular groove disposed on said manifold body member approximate to the closed first end of said manifold body member.

17. The combination inflator and manifold assembly of claim 3 wherein said means for creating a seal comprises a first o-ring seal disposed between said inflator body member and said manifold body member on a first side of said gas inlet passageway and a first corresponding side of said gas outlet passageway and a second o-ring seal disposed between said inflator body member and said manifold body member on a second side of said gas inlet passageway and a second corresponding side of said gas outlet passageway.

18. The combination inflator and manifold assembly of claim 4 wherein said means for creating a seal comprises a first o-ring seal disposed between said inflator body member and said manifold body member on a first side of said gas inlet passageway and a first corresponding side of said gas outlet passageway and a second o-ring seal disposed between said inflator body member and said manifold body member on a second side of said gas inlet passageway and a second corresponding side of said gas outlet passageway.

19. The combination inflator and manifold assembly of claim 5 wherein said means for creating a seal comprises a first o-ring seal disposed between said inflator body member and said manifold body member on a first side of said gas inlet passageway and a first corresponding side of said gas outlet passageway and a second o-ring seal disposed between said inflator body member and said manifold body member on a second side of said gas inlet passageway and a second corresponding side of said gas outlet passageway.

* * * * *